US009920984B2

(12) United States Patent
Lee et al.

(10) Patent No.: US 9,920,984 B2
(45) Date of Patent: Mar. 20, 2018

(54) COOLING APPARATUS

(71) Applicant: LG ELECTRONICS INC., Seoul (KR)

(72) Inventors: Heejun Lee, Seoul (KR); Younseok Lee, Seoul (KR); Junsoo Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 237 days.

(21) Appl. No.: 14/592,318

(22) Filed: Jan. 8, 2015

(65) Prior Publication Data

US 2015/0198363 A1 Jul. 16, 2015

(30) Foreign Application Priority Data

Jan. 10, 2014 (KR) ..... 10-2014-0003185
Jan. 10, 2014 (KR) ..... 10-2014-0003186
Jan. 10, 2014 (KR) ..... 10-2014-0003187

(51) Int. Cl.
*F25D 31/00* (2006.01)

(52) U.S. Cl.
CPC ..... *F25D 31/007* (2013.01); *F25D 2331/803* (2013.01); *F25D 2331/805* (2013.01); *F25D 2400/28* (2013.01)

(58) Field of Classification Search
CPC ..... F25D 23/04; F25D 2317/062
USPC ..... 62/377, 381, 440, 457.1, 457.7
See application file for complete search history.

(56) References Cited

U.S. PATENT DOCUMENTS 4,580,405 A 4/1986 Cretzmeyer, III
5,282,368 A * 2/1994 Ordoukhanian ..... F25D 31/007 248/214
5,505,054 A 4/1996 Loibl et al.
5,966,964 A * 10/1999 Pattee ..... F25D 3/08 62/378
6,237,360 B1 * 5/2001 Corona ..... A47G 23/0241 62/457.4
6,945,069 B2 9/2005 Lee et al.
7,343,748 B2 3/2008 Freesmeier et al.
7,703,301 B2 * 4/2010 Loibl ..... F25D 3/08 62/373

(Continued)

FOREIGN PATENT DOCUMENTS

JP 2004-176977 6/2004
KR 2001-081386 8/2001

(Continued)

OTHER PUBLICATIONS

International Search Report dated Apr. 17, 2015.
European Search Report dated Jul. 17, 2017 issued in Application No. 15735221.2.

*Primary Examiner* — Melvin Jones
(74) *Attorney, Agent, or Firm* — Ked & Associates LLP

(57) ABSTRACT

A cooling apparatus is provided in which items to be cooled may be vertically stacked on each other in a state in which the items to be cooled are laid out or laid on their sides. When the items to be cooled are vertically stacked in the cooling apparatus, a problem in that an upper space of the cooling apparatus is not utilized may be solved to efficiently utilize an inside of a refrigerator or a back surface of a door. Also, a problem in that capacity within the refrigerator is reduced when the items to be cooled are horizontally received may be solved.

49 Claims, 53 Drawing Sheets

(56) References Cited

U.S. PATENT DOCUMENTS

| | | | | |
|---|---|---|---|---|
| 7,980,116 | B2 * | 7/2011 | Koda | G01N 27/16 422/94 |
| 8,863,549 | B2 | 10/2014 | Cho et al. | |
| 2002/0124576 | A1 | 9/2002 | Loibl et al. | |
| 2012/0011882 | A1 | 1/2012 | Cho et al. | |
| 2012/0011885 | A1 | 1/2012 | Cho et al. | |

FOREIGN PATENT DOCUMENTS

| | | |
|---|---|---|
| KR | 10-2002-0057633 | 7/2002 |
| KR | 10-2012-0007768 | 1/2012 |
| KR | 10-2012-000960 | 2/2012 |
| WO | WO 2004/113808 | 12/2004 |
| WO | WO 2010/088747 | 8/2010 |

* cited by examiner

COOLING APPARATUS

CROSS-REFERENCE TO RELATED APPLICATIONS

This application claims priority under 35 U.S.C. § 119 to Korean Application Nos. 10-2014-0003185, 10-2014-0003186, and 10-2014-0003187 filed in Korea on Jan. 10, 2014, whose entire disclosures are hereby incorporated by reference.

BACKGROUND

1. Field

A cooling apparatus is disclosed herein.

2. Background

In general, refrigerators are home appliances that provide a low-temperature storage space, which is opened or closed by a door, to store food or other items at a low temperature. In recent years, refrigerators have increased more and more in size. Also, refrigerators provide multiple functions due to trends in changes in diet and life quality, and accordingly, refrigerators having various structures in consideration of user convenience have been brought to market.

For example, consumer demands for apparatuses that quickly cool beverages, including alcoholic beverages, to under room temperature, in a short amount of time are increasing. To satisfy these demands, various types of cooling apparatuses provided in a refrigerator to quickly cool such beverages are being proposed.

However, there are several technical matters to consider in order to provide more efficient cooling apparatuses to users.

First, such a cooling apparatus may receive a plurality of items to be cooled, such as beverage cans, at once. However, in this case, a storage space of the refrigerator may be narrowed. Thus, it may be necessary to minimize reduction in storage capacity of the refrigerator due to the cooling apparatus.

According to one a cooling apparatus, which has been applied for by the present Applicant, U.S. Patent Publication No. 2012/0011885 A1, published Jan. 19, 2012, an item to be cooled (hereinafter, referred to as a "cooled item") is placed on a tray of the cooling apparatus in a single direction. Thus, to receive a plurality of cooled items, it may be necessary to elongate the tray. As a result, the cooling apparatus may increase in length.

As the case is increased in length, a storage compartment in which the cooling apparatus is installed may be reduced in capacity. Thus, such a cooling apparatus may not be installed in a small capacity refrigerator including a storage compartment having a short length in a front to rear direction.

In addition, when the plurality of cooled items are received end to end or in a lengthwise direction of the cooling apparatus in the front to rear direction, it may be difficult to withdraw a cooled item positioned at a relatively rear side.

A structure in which a tray is laterally expanded to receive a plurality of cooled items may be proposed. However, in this case, the storage compartment of the refrigerator, which stores food or other items, may be reduced in use capacity.

Second, a cooled item to be received in the cooling apparatus has to be efficiently cooled. In general, quick cooling in the cooling apparatus installed in a refrigerator door or a storage compartment of a cabinet may be performed by an agitating motion including supply of cool air into the cooling apparatus and rotation of the cooled object. For example, according to a cooling apparatus disclosed in Japanese Patent Publication No. 2004-176977 A or U.S. Pat. No. 7,343,748 B, a beverage can is received in the cooling apparatus, rotated with respect to a central axis in a longitudinal direction thereof, and then, cool air is supplied into the cooling apparatus to quickly cool the beverage can.

However, in the case of an agitation mechanism, in which a rotational center or agitating center of the cooled item is a central longitudinal axis of the cooled item, even though the cooled item rotates, agitation of a liquid containing within the cooled item may not actively occur. Thus, as the cool air supplied into the cooling apparatus and the liquid with the cooled item are not smoothly heat-exchanged, a cooling time may be extended.

U.S. Patent Publication No. 2012/0011885 A1, which has been applied for by the present Applicant, discloses a cooling apparatus for solving the above-described limitations. In this cooling apparatus, a beverage received in the cooling apparatus does not simply rotate, but rather, is swung, that is, repeatedly reciprocated a predetermined distance on a circular arc to actively agitate the liquid. Also, cool air may be sprayed at a high speed onto a lower side of the beverage can, and the sprayed cool air may maximally collide with a circumferential surface of the beverage can to improve cooling efficiency.

However, in the case of U.S. Patent Publication No. 2012/0011885 A1, there are the following limitations.

FIG. 51 is a schematic view illustrating an agitation motion of a cooling apparatus according to the related art. Referring to FIG. 51, in the cooling apparatus disclosed in U.S. Patent Publication No. 2012/0011885 A1, a beverage can K, which is a cooled item, is reciprocated along a moving trace S having a circular arc shape between a first point A1 and a second point A2 using agitation axis X as a center. Cool air J is supplied onto a lower side of the beverage can.

In the case of the above-described agitation motion, during the swing motion reciprocated along the trace S in the circular arc shape, agitation of liquid contained in the beverage can K may actively occur at both ends of the trace and weakly occur at a central portion of the trace. That is, the beverage may have an inertial force that continuously ascends at a time point at which descent of the beverage can K starts at the first point A1 and the second point A2. The liquid within the beverage can K may ascend along an inner circumferential surface of the beverage can K and then drop down due to gravity and be agitated by the inertial force. However, as the beverage rotates along a moving direction of the beverage can K in one direction in a region in which the beverage can K passes through a lowest point, that is, at the central portion of the trace, the agitation may be relatively less. Also, as the cool air is concentratedly sprayed onto the central portion of the trace, at which the agitation intensity is relatively weak, it may be difficult to realize maximum cooling efficiency.

In more detail, as the beverage can K moves in a direction that approaches the first point A1 and the second point A2, the beverage can K moves out of a cooling air supply region, in which the cool air is supplied, and thus, an amount of cool air colliding with the beverage can K may be reduced. That is, a portion of the supplied cool air may not heat-exchange with the beverage can K in a portion of the region, reducing cooling efficiency.

In addition, when the moving direction of the beverage can K changes in a dropping direction of the beverage can K at the first point A1 and the second point A2, inertial forces of the beverage, the beverage can K, and a beverage holder may act as resistance to a link member for driving the beverage holder. Thus, the link member may be damaged and short-lived, and also, noise may occur during the agitation.

Also, in the case of the swing motion, a width and height of the cooling apparatus have to be designed in consideration of the trace of the cooled item. Thus, when compared to a cooling apparatus having the agitation mechanism that rotates using the central longitudinal axis of the cooled item as the agitation center, the cooling apparatus may occupy a larger space in the storage compartment of the refrigerator.

BRIEF DESCRIPTION OF THE DRAWINGS

Embodiments will be described in detail with reference to the following drawings in which like reference numerals refer to like elements, and wherein.

DETAILED DESCRIPTION

Figure 1:
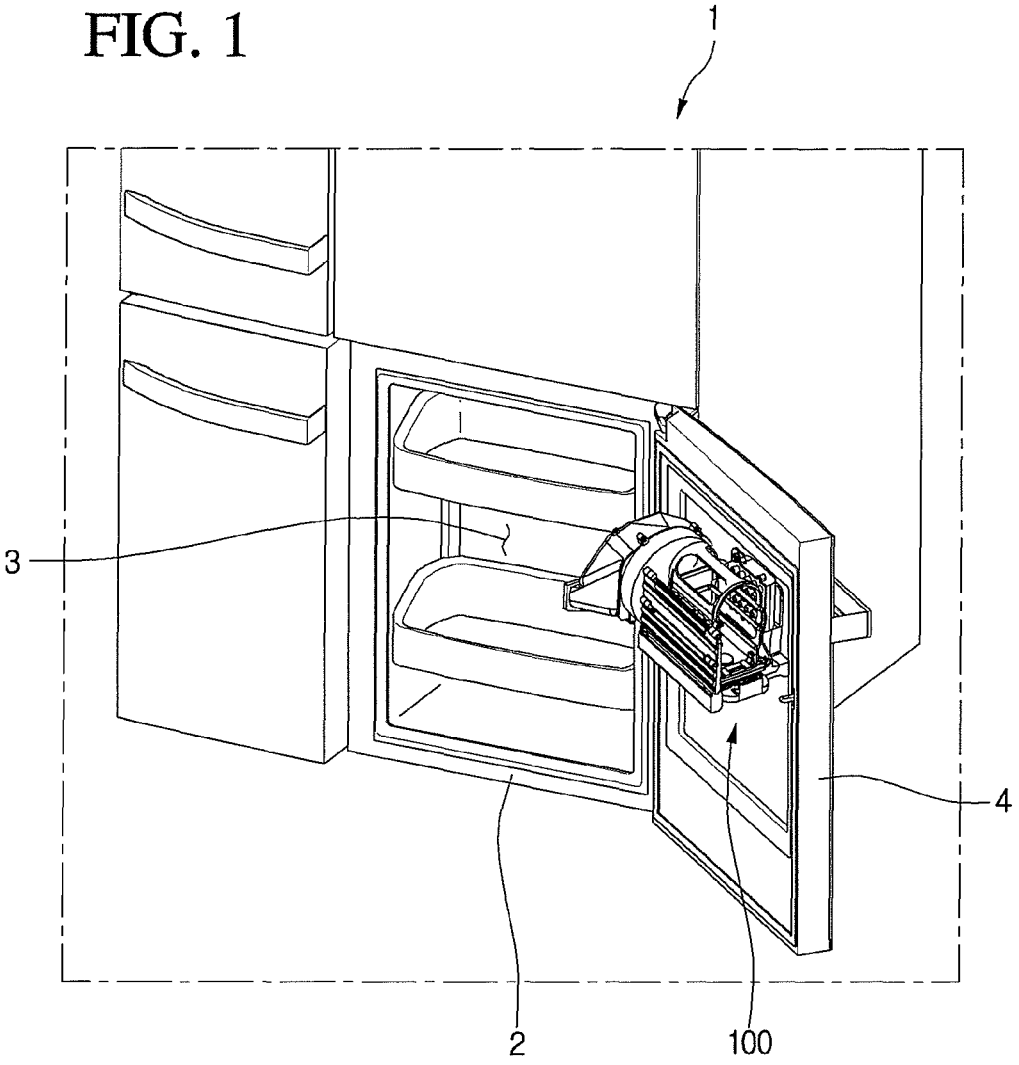
FIGS. 1 and 2 are views illustrating a state in which a cooling apparatus is mounted in a refrigerator according to an embodiment.

Hereinafter, embodiments will be described in detail with reference to the accompanying drawings. Where possible, like reference numerals have been used to indicate like elements, and repetitive disclosure has been omitted.

Figure 2:
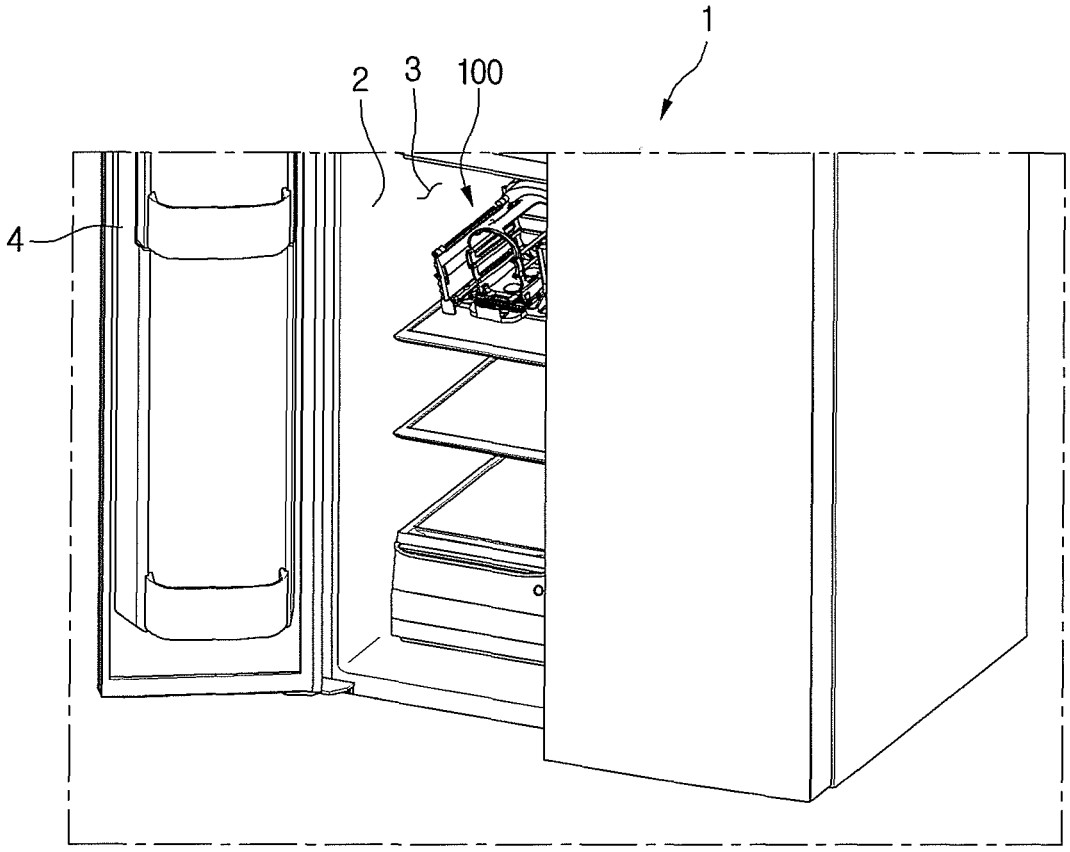

FIGS. 1 and 2 are views illustrating a state in which a cooling apparatus is mounted in a refrigerator according to an embodiment. Referring to FIG. 1, a cooling apparatus 100 according to an embodiment may be mounted on a door 4 of a refrigerator 1.

In detail, the refrigerator 1 may include a cabinet 2 having a storage compartment therein, and the door 4 rotatably mounted on a front surface of the cabinet 2 to open and close the storage compartment. The door 4 may be a rotatable door or a door mounted on a front surface of a drawer-type receiving device inserted into the storage compartment. The storage compartment may include a freezer compartment 3.

In more detail, when the cooling apparatus 100 is mounted on a back surface of the door 4, a cool air passage may be defined in each of the door 4 and a sidewall of the cabinet 2. Also, an inlet end of the cool air passage defined in the sidewall of the cabinet 2 may communicate with an evaporation chamber (not shown). When the door 4 is closed, an outlet end of the cool air passage defined in the sidewall of the cabinet 2 may communicate with the inlet end of the cool air passage defined in the door 4. The outlet end of the cool air passage defined in the door 4 may communicate with a suction hole defined in a suction duct, which will be described hereinbelow, of the cooling apparatus 100.

When the door 4 is a drawer-type door, the cooling apparatus 100 may be configured to suction air from within the freezer compartment 3, thereby spraying the air at a high speed toward a beverage container for quick freezing or cooling.

As illustrated in FIG. 1, the cooling apparatus 100 may be fixed and mounted on a back surface of the door 4. Referring to FIG. 2, alternatively, the cooling apparatus 100 according to an embodiment may be fixed and mounted on a side at an inside of the freezer compartment 3. In detail, the cooling apparatus 100 may be fixed to a sidewall of the freezer compartment 3. In a case of a top mount-type refrigerator, the cooling apparatus 100 may be fixed and mounted on an edge at which a bottom and a sidewall of the freezer compartment 3 meet each other. In a case of a bottom freezer-type refrigerator, the cooling apparatus 100 may be fixed and mounted at an edge at which a ceiling and a sidewall of the freezer compartment 3 meet each other.

The cool air suction hole of the cooling apparatus 100 may contact a back surface of the freezer compartment 3 to communicate with the evaporation chamber defined in the back surface of the freezer compartment 3. Thus, low-temperature cool air within the evaporation chamber may be directly sprayed onto the beverage container to quickly cool the beverage container in a short period of time.

Figure 3:
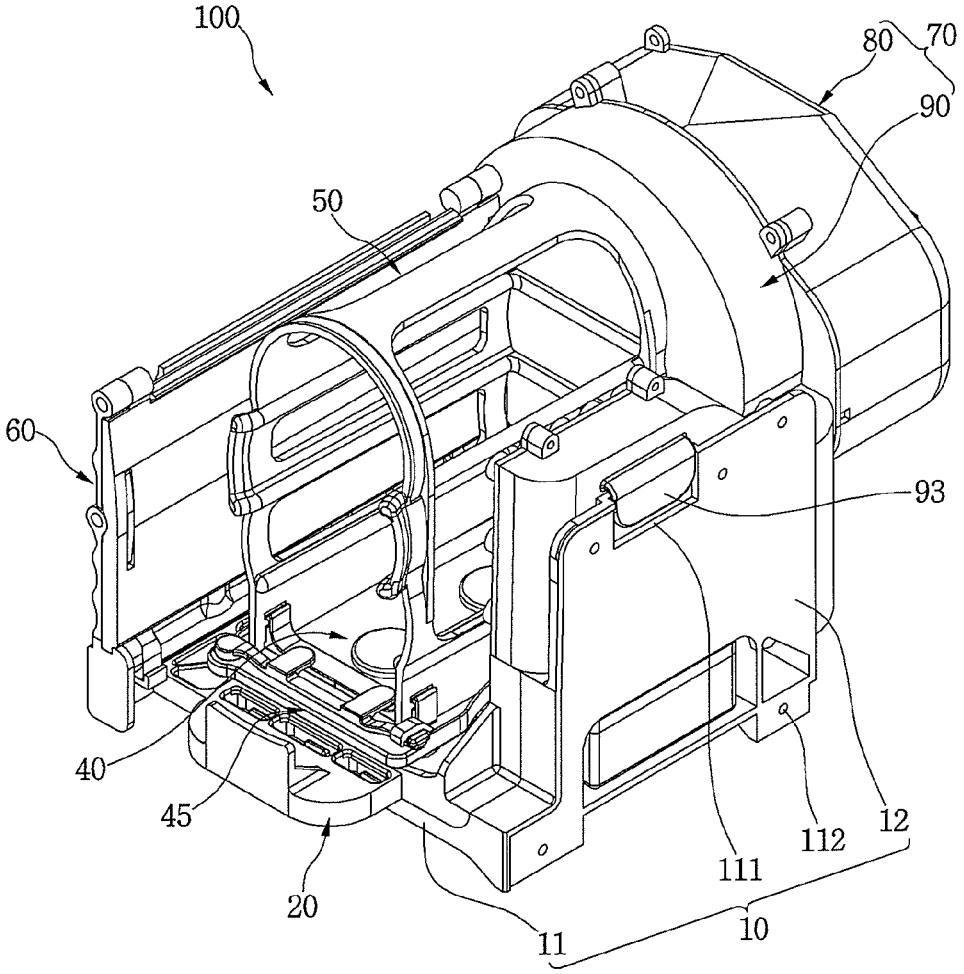
FIG. 3 is a front perspective view of the cooling apparatus of FIGS. 1-2.
Figure 4:
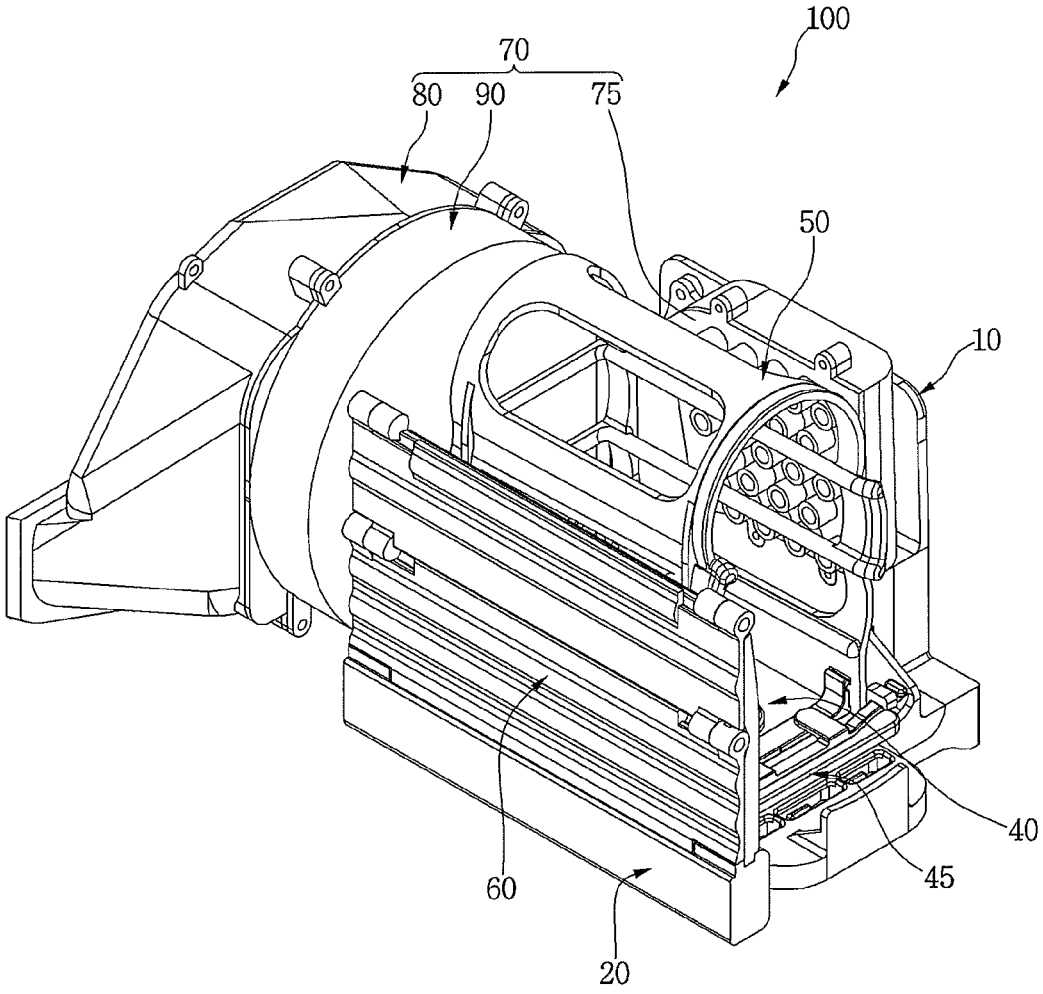
FIG. 4 is a another front perspective view of the cooling apparatus of FIGS. 1-2.

FIG. 3 is a front perspective view of the cooling apparatus of FIG. 1-2. FIG. 4 is a another front perspective view of the cooling apparatus of FIG. 1-2.

Figure 5:
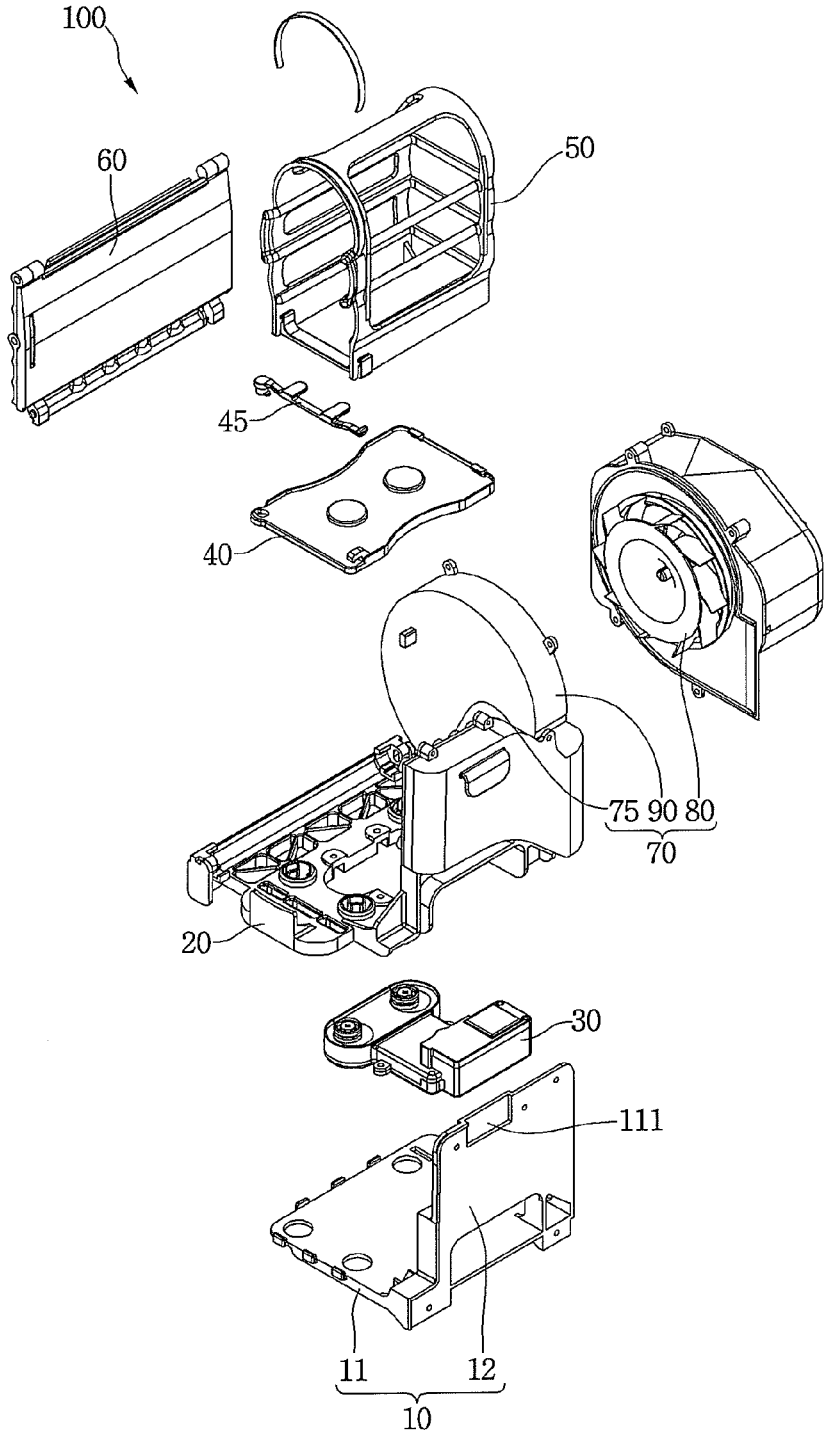
FIG. 5 is an exploded perspective view of the cooling apparatus of FIGS. 1-2.

Referring to FIGS. 3 to 5, the cooling apparatus 100 may include a bracket 10 to be fixed to a storage compartment or door, a base 20 separably mounted on the bracket 10, an agitation drive 30 fixed to an inside of the base 20 to provide an agitation drive force, an agitation tray 40 disposed on a top surface of the base 20 to receive the drive force from the agitation drive 30, thereby perform an agitating motion, a container holder 50 separably mounted on the agitation tray 40, a fixing mechanism 45 to fix the container holder 50 to the agitation tray 40 or release the container holder 50 from the agitation tray 40, a partition wall 60 disposed on or at an edge of a side of the base 20, and a blower 70 to supply cool air onto a beverage container received into the container holder 50. The blower 70 may include a fan 80 and a duct 90.

The base 20 may be integrated with the duct 90 and be manufactured as a separate component with respect to the base 20. Also, the base 20 may be coupled to the bracket 10 using a coupling member. In this embodiment, the base 20 may be integrated with the duct 90. A hook 93 may extend and be bent from a side of the duct 90, and a hook groove 111, on which the hook 93 may be seated or hooked, may be defined in the bracket 11.

In detail, the bracket 10 may include a bottom 11, on which a bottom surface of the base 20 may be disposed, and a side 12 that extends upward from an edge of the bottom 11. The hook groove 111 may be defined in or at an upper end of the side 12. Also, a plurality of coupling holes 112 may be defined in or at an edge of the side 12, so that the bracket 10 may be fixed to a wall of a storage compartment or a back surface of a door. When the base 20 is lifted, the hook 93 may be separated from the hook groove 111 to separate the cooling apparatus 100 from the bracket 10.

The cooling apparatus 100 according to an embodiment may have a feature in which the cool air is sprayed at a high speed onto a side surface of a beverage container. The container holder 50 may be exposed inside of the freezer compartment 3. Thus, the cool air sprayed onto the beverage container along the duct 90 from the evaporation chamber may be mixed with the cool air within the freezer compartment 3.

The agitation tray 40 may be rotated along a circular agitation trace with respect to a vertical line by the agitation drive 30 to agitate a beverage contained within the beverage container. When the agitation tray 40 is rotated along the agitation trace, lines passing through side surfaces of the agitation tray 40 may be maintained in a state of always being substantially parallel to each other. That is, when the agitation tray 40 performs the agitating motion, front and rear ends of the agitation tray 40 are not changed in direction to rotate along the circular agitation trace, but rather, rotate along the agitation trace in a state in which the front and rear ends of the agitation tray 40, respectively, always face front and rear sides. Also, a center of the agitation trace, that is, a rotational center of the agitation tray 40 may be defined inside the agitation tray 40.

Hereinafter, components of the cooling apparatus 100 will be described in detail with reference to the accompanying drawings.

Figure 6:
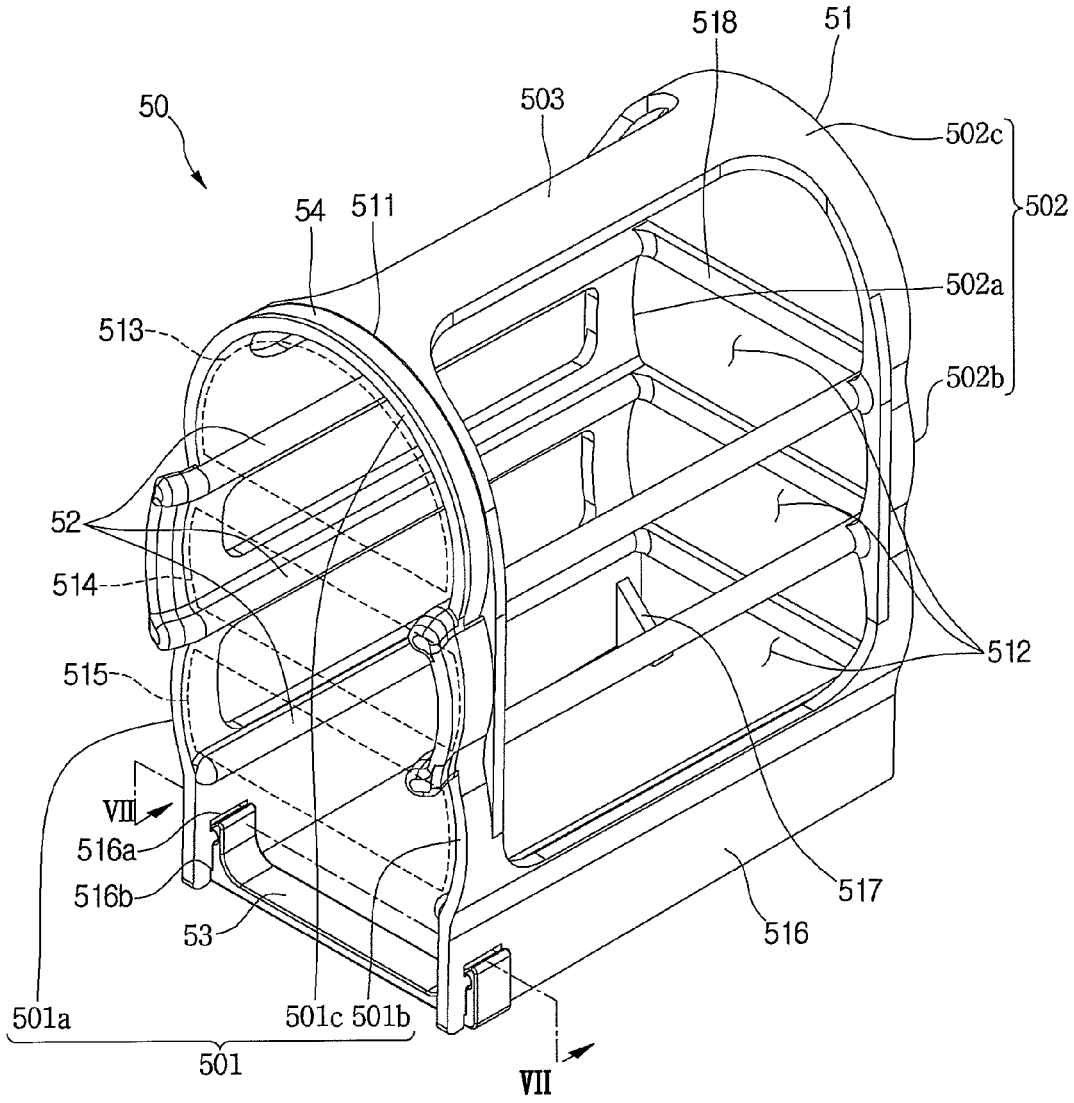
FIG. 6 is a front perspective view of a container holder of the cooling apparatus of FIGS. 1-2.
Figure 7:
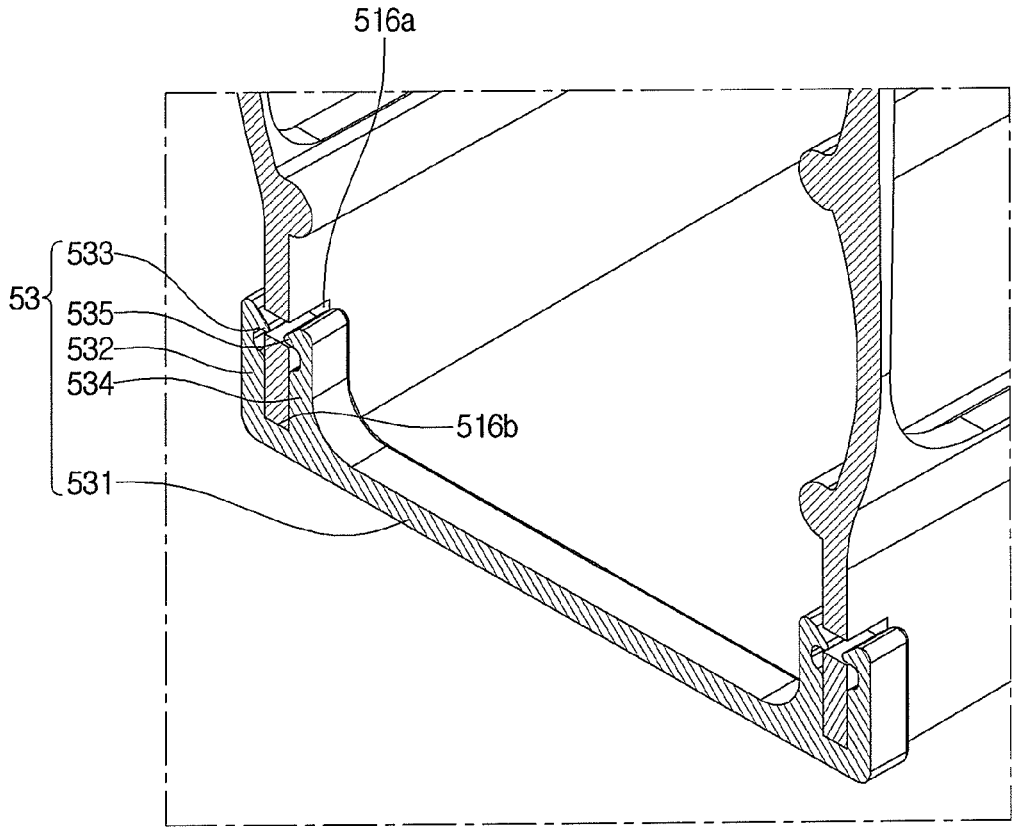
FIG. 7 is a cross-sectional view, taken along line VII-VII of FIG. 6.

FIG. 6 is a front perspective view of a container holder of the cooling apparatus of FIG. 1-2. FIG. 7 is a cross-sectional view, taken along line VII-VIII' of FIG. 6.

Referring to FIGS. 6 and 7, the container holder 50 according to an embodiment may have a tunnel shape, as illustrated in FIG. 6. In detail, the container holder 50 may include a tunnel-shaped housing having an upside-down U shape and extending in a forward to backward direction a predetermined length, a holder 53 that holds each of first and second lower ends of a front end of the housing 51, and a clamp 54 mounted on a top surface of a front end of the housing 51, which may be rounded in an arch shape.

The housing 51 may include a front frame 501, a rear frame 502, and a connection frame 503 that connects the front frame 501 to the rear frame 502. Each of the front frame 501 and the rear frame 502 may have an upside-down U shape. An inside of the front frame 501 may be fully open to receive the beverage container. An inside of the rear frame 502 may be closed by a plurality of support ribs 518 to prevent the beverage container from sliding backward. The plurality of support ribs 518 may be vertically spaced a predetermined distance from each other.

In more detail, the front frame 501 may include a first support 501*a* that extends in a vertical direction, a second support 501*b* that is spaced a predetermined distance from the first support 501*a* and extends in a vertical direction, and an upper support 501*c* that connects an upper end of the first support 501*a* to an upper end of the second support 501*b* and having an arch shape. The supports 501*a*, 501*b*, and 501*c* may be a single body, and the upper support 501*c* may be rounded at a predetermined curvature to surround a circumferential surface (or an outer circumferential surface) of the received beverage container.

Like the front frame 501, the rear frame 502 may include a first support 502*a*, a second support 502*b*, and an upper support 502*c*. Both ends of each of the plurality of support ribs 518 may be connected to the first support 502*a* and the second support 502*b*, respectively. The rear frame 502 and the plurality of support ribs 518 may be provided as one body.

Each of the upper supports 501*c* and 502*c* may have an arc shape. That is, the upper supports 501*c* and 502*c* may receive the beverage container and surround an outer circumferential surface of the received beverage container. A lower end of each of the upper supports 501*c* and 502*c* may have a length sufficient to surround a half or more of the outer circumferential surface of at least the received beverage. That is, the lower end of each of the upper supports 501*c* and 502*c* may be disposed under a horizontal line that passes through a center of the outer circumferential surface of the received beverage container. Due to the above-described structure, a lower portion of the received beverage container may be supported by the lower end of each of the upper supports 501*c* and 502*c* to prevent the beverage container from dropping down. In addition, as the half or more of the outer circumferential surface of the beverage container may be surrounded by the upper supports 501*c* and 502*c*, a phenomenon in which the beverage container is shaken during agitation causing noise may be minimized.

A distance between the first support 501*a* and the second support 501*b*, which form the front frame 501, may be less than a distance between the first support 502*a* and the second support 502*b*, which form the rear frame 502, to prevent the received beverage container from dropping down during agitation. This will be described in detail with reference to the accompanying drawings.

A connection frame 503 may connect the upper support 501*c* of the front frame 501 to the upper support 502*c* of the rear frame 502. The front frame 501, the rear frame 502, and the connection frame 503 may be provided as one body.

A clamp seat groove 511, on which the clamp 54 may be seated, may be defined in an outer circumferential surface of the upper support 501*c* of the front frame 501. The clamp 54 may include a plate spring having a predetermined elastic force. When the housing 51 has the up-side down U shape, the lower ends of the first and second supports 501*a* and 501*b* may not be connected to each other. Thus, when the beverage container is received, the lower ends of the first and second supports 501*a* and 501*b* may be spread by a weight of the beverage container. As a result, the beverage container may drop down. To resolve this issue, the clamp 54 may be mounted on the outer circumferential surface of the upper support 501*c*, and the holder 53 may be mounted on the lower end of the upper support 501*c* to minimize spreading of the lower end of the hosing 51.

A plurality of container supports 52 having a bar shape may be provided at side surfaces of the housing 51. The plurality of container support 52 may be provided on first and second sides of the housing 51. The plurality of container supports 52 may be vertically spaced a predetermined distance from each other. Both ends of the plurality of container supports 52 may be connected to the front frame 501 and the rear frame 502 to support the received beverage container, respectively. The plurality of container supports 52 may be integrated with the front and rear frames 501 and 502 as one body.

The plurality of container supports 52 may line-contact or surface-contact the outer circumferential surface of the received beverage container to support the whole beverage container. Thus, dropping of the received beverage container during agitation may be prevented.

Although the plurality of container support 52 may extend in a lengthwise direction to connect the front frame 501 to the rear frame 502, embodiments are not limited thereto. For example, the plurality of container supports 52 may be provided in a protrusion shape that protrudes from only an inside of each of the front and rear frames 501 and 502. That is, the plurality of container supports 52 may have a structure in which a protrusion protrudes from only the inside of each of the front and rear frames 501 and 502 by a length corresponding to a frontward to rearward width of each of the front and rear frames 501 and 502.

The lower end of the front frame 501 and the lower end of the rear frame 502 may be integrally connected to each other by a mounting platform 516. A space defined by side surfaces of the housing 51, that is, the front and rear frames 501 and 502, the connection frame 503, and the mounting platform 516 may form at least one cool air through hole 512, and the at least one cool air through hole 512 may be divided into a plurality of cool air through holes 512 by the plurality of container supports 52. The cool air supplied from the duct 90 through the at least one cool air through hole 512 may be sprayed onto a surface of the beverage container. The plurality of container supports 52 may prevent the received beverage container from dropping down and maintain a shape of the housing 51.

A receiving portion may be defined within the housing 51. The receiving portion may have a shape curved at a predetermined curvature to surround the outer circumferential surface of the cylindrical beverage container. In particular, the receiving portion may include a first receiving portion 513 defined by the upper supports 501*c* and 502*c*, a second receiving portion 514 defined under the first receiving portion 513, and a third receiving portion 515 defined under the second receiving portion 514. The first to third receiving portions 513, 514, and 515 may be partitioned by the plurality of container supports 52 which are vertically disposed.

A number of receiving portions may be determined by a number of beverage container receivable into the housing 51. In this embodiment, the container holder 50 may be designed to receive a maximum of two beverage containers. The receiving method of the beverage container will be described below with reference to the accompanying drawings. To receive more beverage containers, each of the front and rear frames 501 and 502 may be increased in length, and the number of container holders 50 which are vertically disposed may increase.

The plurality of container supports 52 may protrude from an inner circumferential surface of each of the front and rear frames 501 and 502 to support lower and upper portions of the beverage container. Alternatively, a protrusion may be disposed on the inner circumferential surface of each of the front and rear frames 501 and 502, and the plurality of container supports 52 may not be provided.

The holder 53 may be coupled to a front end of the mounting platform 516, and a hook 517 may protrude from a rear end of the mounting platform 516. As illustrated in FIG. 7, a hook hole 516*a* and hook groove 516*b* may be defined in a front end of the mounting platform 516. The hook hole 516*a* may be defined at a position spaced a predetermined distance upward from a bottom surface of the front end of the mounting platform 516. The hook groove

516*b* may be recessed by a predetermined depth upward from the bottom surface of the front end of the mounting platform 516. The hook hole 516*a* and the hook groove 516*b* may be defined in or at first and second sides of the mounting platform 516, respectively.

A width of a front end of the second receiving portion 514 may be greater than a diameter of the beverage container. Also, the second receiving portion 514 may have a width that gradually decrease in a rearward direction. In detail, front ends of the plurality of container supports 52 that support the upper and lower portions of the beverage container received into the second receiving portion 514 may be gradually spread and curved forward to guide smooth reception of the beverage container. As described above, a portion to guide reception of the beverage container may be defined as a reception guide. The reception guide may be disposed on the front end of the plurality of container supports 52 that support the lower portion of the beverage container received into the third receiving portion 515. That is, the reception guide may be disposed on each of the front ends of all receiving portions.

The holder 53 may include a holder body 531 that extends by a length corresponding to a width of a bottom of the housing 51 and a hanging portion bent to extend from each of both ends of the holder body 531. The hanging portion may include a first hanging portion 532 bent to extend upward from an end of the holder body 531, and a second hanging portion 534 that extends upward from a position spaced a predetermined distance from the first hanging portion 532 in a central direction of the holder body 531. Also, a first hook 533 and a second hook 535 may be disposed on ends of the first and second hanging portions 532 and 534, respectively. The first and second hooks 533 and 535 may have hook shapes that protrude to face each other.

Two hanging portions may be provided on each of both ends of the holder body 531. Alternatively, only the first hanging portion 532 may be provided. As the holder 53 prevents the lower ends of the housing 51 from being spread, only the first hanging portion 532 may extend along an outer circumferential surface of each of the lower ends of the housing 51, and then, may be hooked in the hook hole 516*a*. Also, a portion of the holder body 531 may be fitted into the hook groove 516*b*. Thus, in a state in which the holder 53 is coupled to the lower ends of the housing 51, the hook groove 516*b* may be recessed so that a bottom of the holder 53 and the lower ends of the housing 51 are flush with each other. Thus, the hook groove 516*b* may be recessed by a depth corresponding to a thickness of the holder body 531.

One or more of the support ribs 518 may be disposed on each of both side surfaces of the front and rear ends of the housing 51 to additionally prevent the housing 51 from being spread.

Figure 8A:
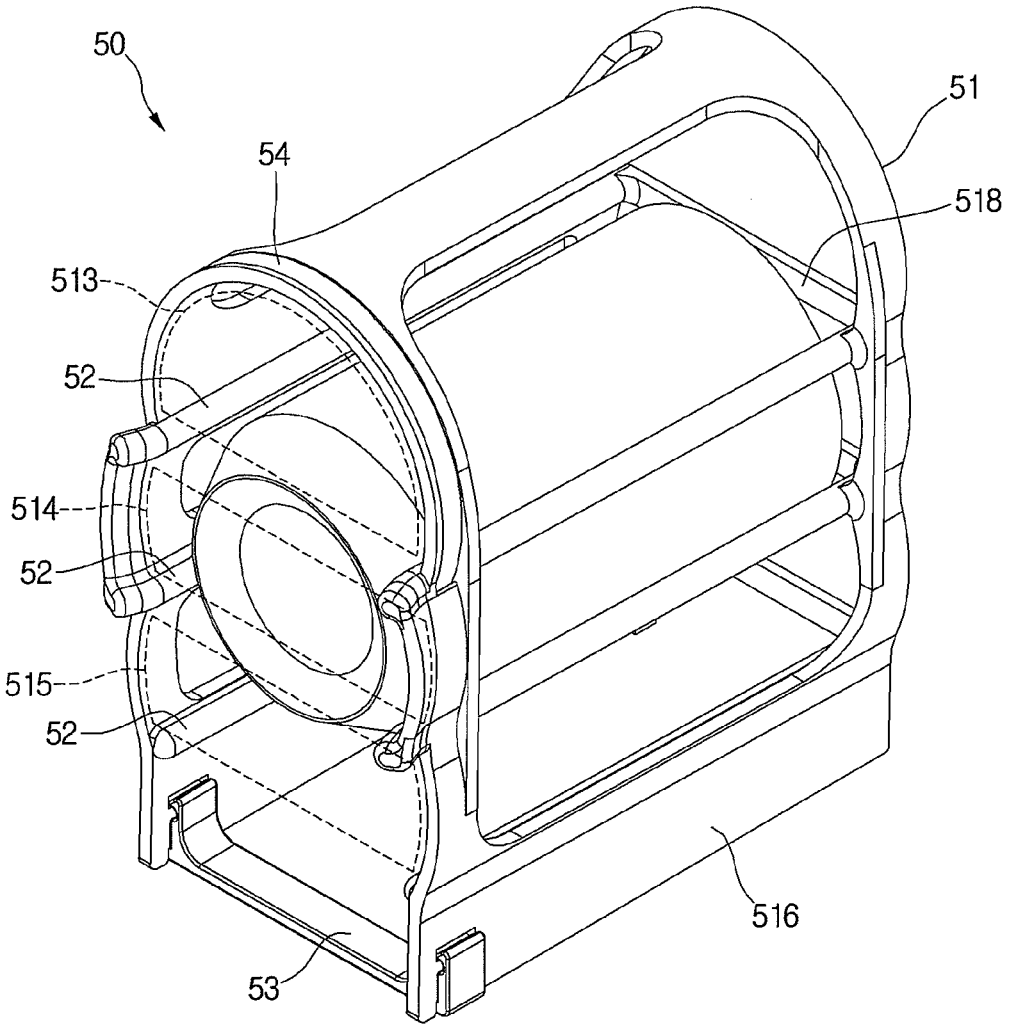
FIGS. 8A-8B and 9A-9B are views illustrating a state in which a beverage container is received in the container holder of FIG. 6.
Figure 8B:
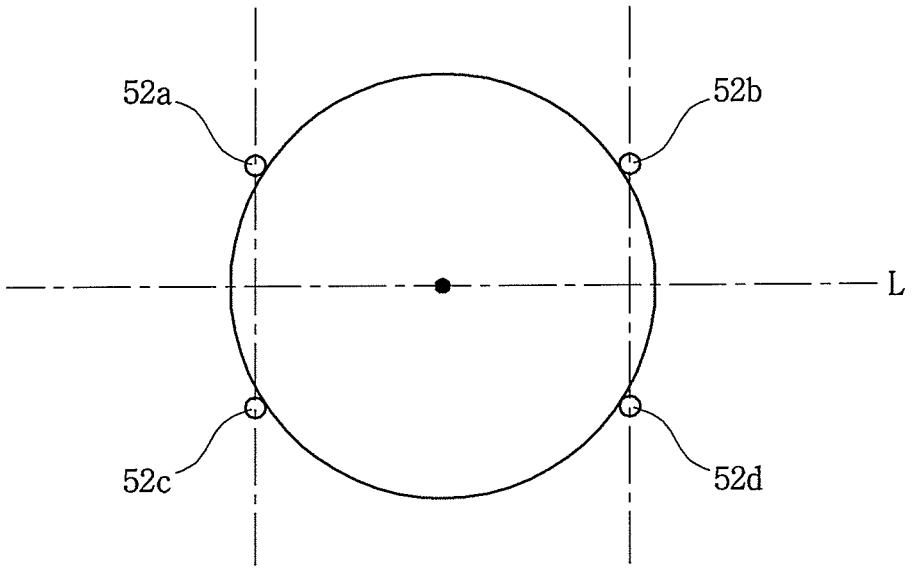

FIGS. 8A-8B and 9A-9B are views illustrating a state in which the beverage container is received in the container holder of FIG. 6. Referring to FIGS. 8A and 8B, one beverage container may be received into the container holder 50. When one beverage container is received, the beverage container may be received into the second receiving portion 514.

In detail, the beverage container may be received into the housing 51 in a state in which the beverage container is laid out or laid on its side. Top and bottom surfaces of the beverage container may face front and rear surfaces of the container holder 50, respectively. In addition, the cylindrical circumferential surface connecting the top and bottom surfaces of the beverage container to each other may contact the plurality of container supports 52. Upper and lower portions of the beverage container with respect to a horizontal line L that passes through a center of the beverage container may be supported by the plurality of container support 552. The plurality of container supports 52, respectively, disposed on first and second sides of the housing 51 may support first and second sides of the beverage container, respectively.

In detail, to stably support one beverage container, it may be needed to provide a first container support 52*a* that supports an upper first side of the beverage container, a second container support 52*b* that supports an upper second side of the beverage container, a third container support 52*c* that supports a lower first side of the beverage container, and a fourth container support 52*d* that supports a lower second side of the beverage container. The plurality of container supports 52 that faces each other may be disposed at a same height. If one of the first and second container supports is lower than the other, a phenomenon in which the beverage container is separated from the higher container support and then seated again against the higher container support during agitation of the beverage container may occur. Thus, the beverage container may collide with the container supports due to vibration of the beverage container, causing noise.

Also, as a distance between the plurality of container supports 52 that face each other may be less than a diameter of the beverage container, the beverage container may be stably supported without dropping down.

The pair of container supports 52 that face each other at the first and second sides of the housing 51 may be defined as one set. A plurality of the container support sets may be vertically provided. A distance between the container supports forming one container support set may be different for each set.

That is, a distance between the first and second container supports 52*a* and 52*b* may be different from a distance between the third and fourth container supports 52*c* and 52*d*. However, the distance between the container supports may be set within a range which is less than the diameter of the beverage container. Only when distances between the container supports that face each other are the same, may the container supports vertically adjacent to each other be disposed on a same line.

Figure 9A:
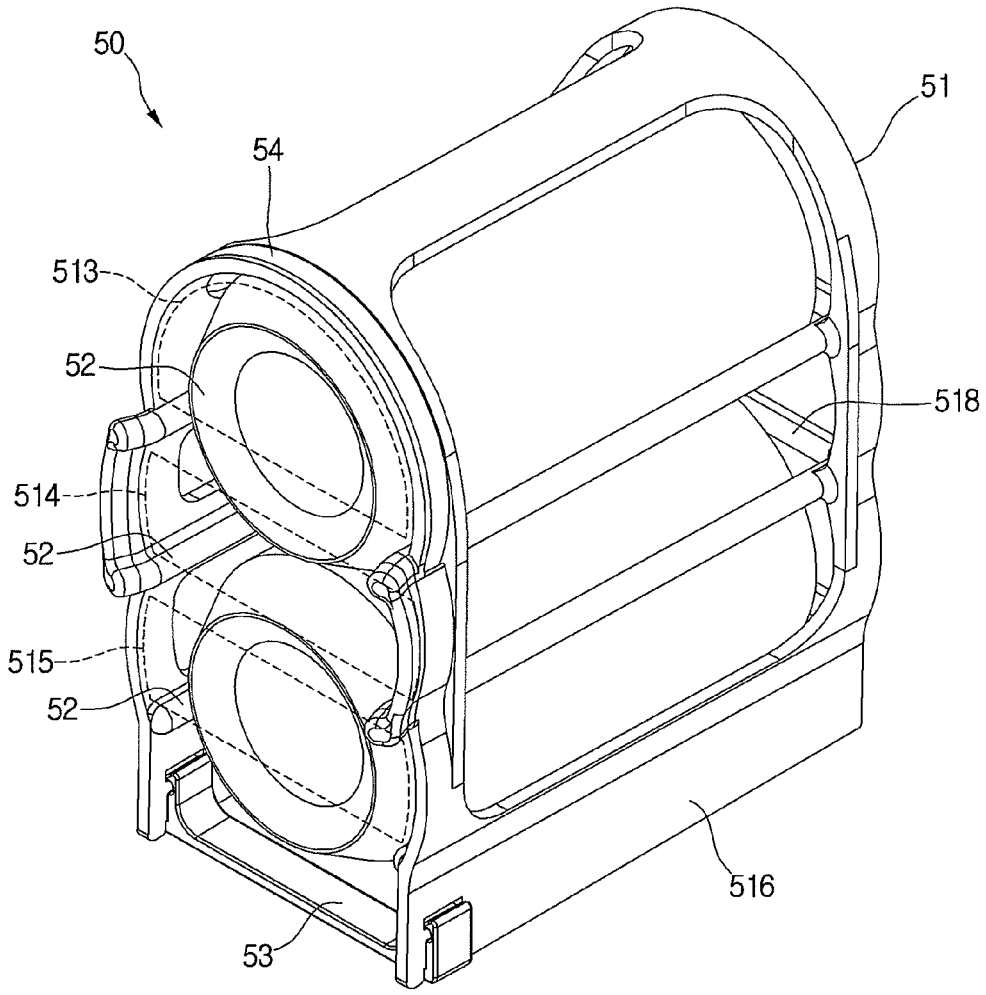
Figure 9B:
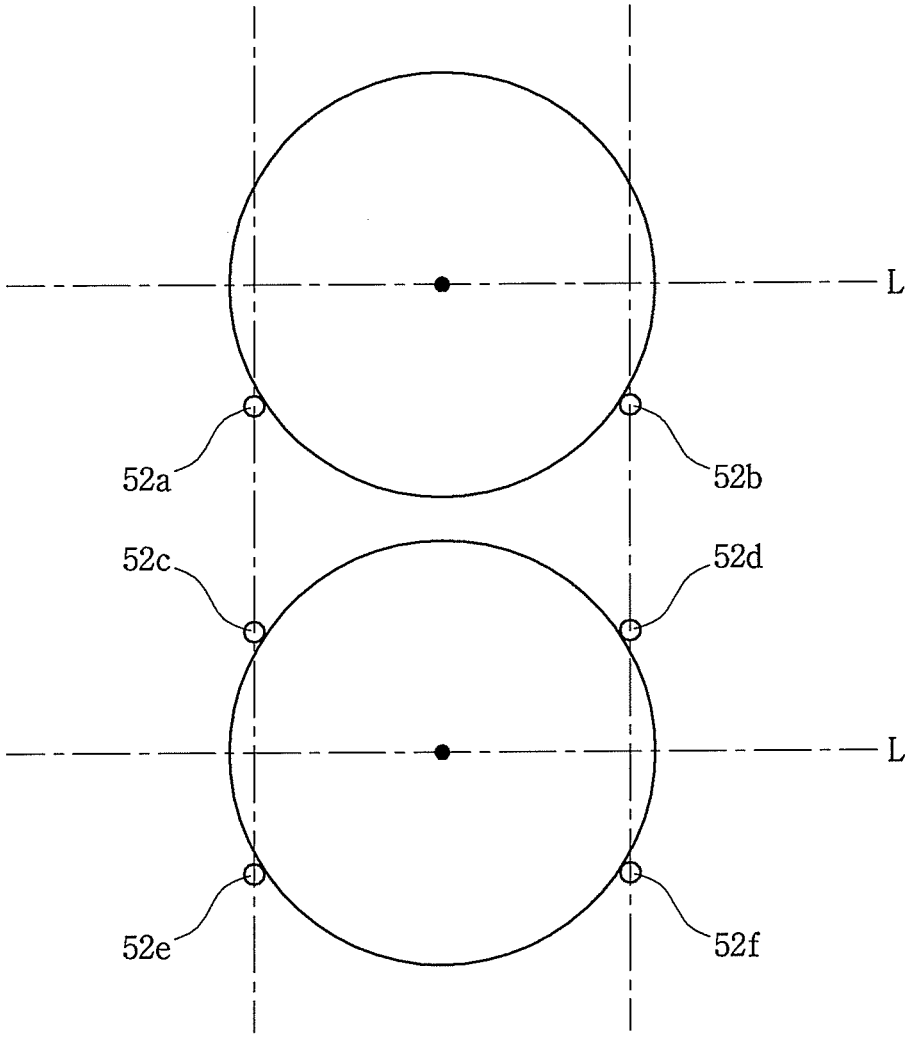

Referring to FIGS. 9A and 9B, when two beverage containers are received, the beverage containers may be received into the first and third receiving portions 513 and 515, respectively. In detail, as the received beverage containers each has a cylindrical shape, if the beverage containers are received into the two receiving portions adjacent to each other, the circumferential surfaces of the two beverage containers may interfere with each other, preventing the beverage containers from being received.

In more detail, a lower portion of the beverage container received into the first receiving portion 513 may be supported by the first and second container supports 52*a* and 52*b*, and an upper portion of the beverage container may be supported to be surrounded by the upper support 501*c*. An upper portion of the beverage container received into the third receiving portion 515 may be supported by the third and fourth container supports 52*c* and 52*d*, and a lower portion of the beverage container may be supported by fifth and sixth container supports 52*e* and 52*f* to prevent the beverage container from being shaken.

Also, as illustrated in the drawings, the container supports that support the beverage container may be disposed at positions vertically spaced apart from a horizontal line L that passes through a center of the corresponding beverage container, and the distance between the container supports that face each other may be less than a diameter of the beverage container.

As described above, when the beverage container is received into the container holder 50, the lower end of the container holder 50 may be spread by the weight of the beverage container. As a result, the beverage container may drop down. To prevent this, the clamp 54 may clamp the upper end of the container holder 50 to primarily prevent the container holder 50 from being spread, and the holder 53 may hold the lower end of the container holder 50 to secondarily prevent the container holder 50 from being spread. Also, the plurality of container supports 52 may support the first and second sides of the beverage container to prevent the beverage container from dropping down. A distance between the plurality of container supports 52 that face each other may be less than the outer diameter of the beverage container to prevent the beverage container from dropping down. That is, the beverage container may be placed on the container supports 52, and thus, may not drop down.

Also, as the container holder 50 may be gradually inclined downward toward a rear side, and the one or more support ribs 518 may be disposed on a rear surface of the container support 50, the beverage container may be prevented from slipping out of the controller holder. The structure in which the container holder 50 is gradually inclined downward toward the rear side will be described below in detail with reference to the accompanying drawings.

Figure 10:
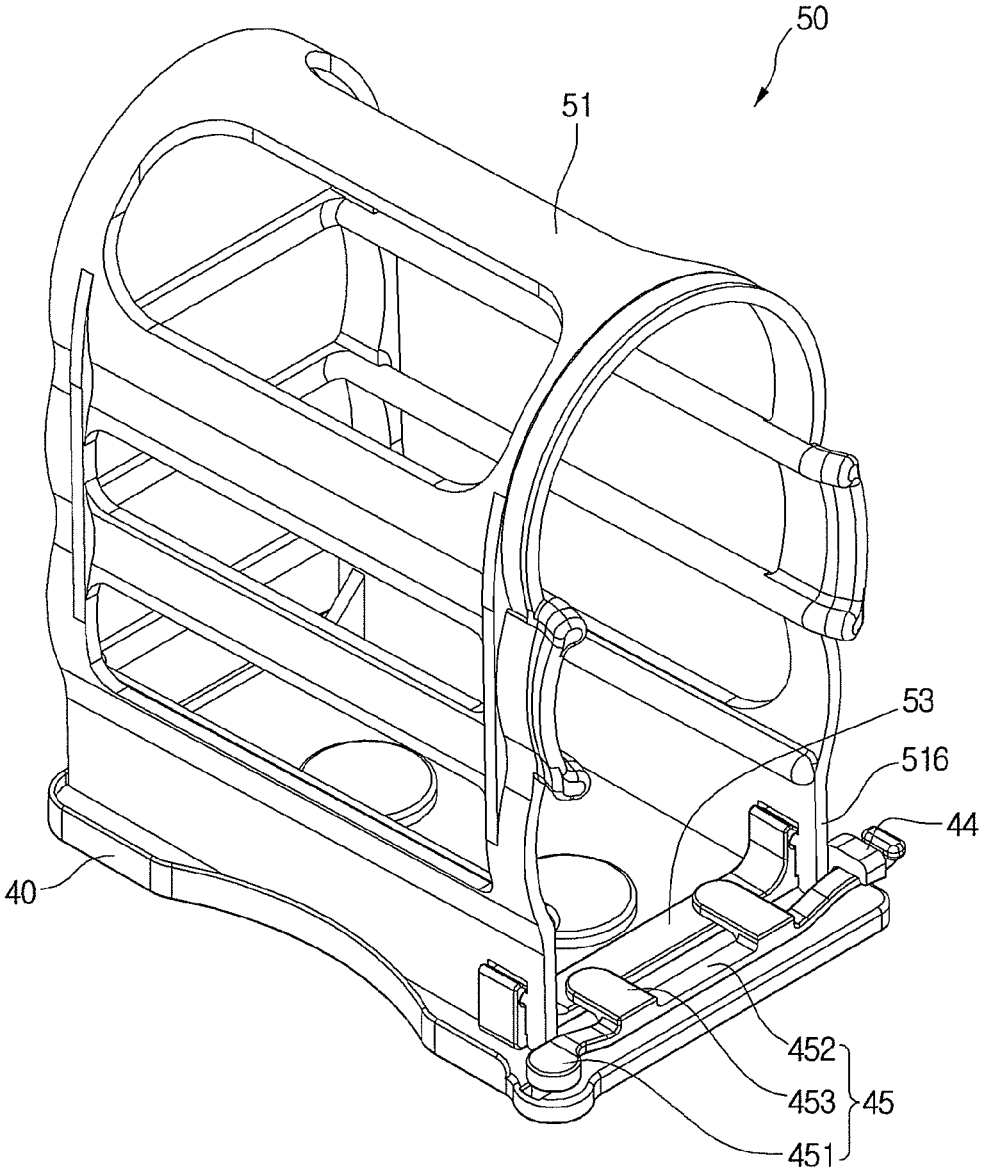
FIG. 10 is a front perspective view illustrating a state in which the container holder of FIG. 6 is mounted on an agitation tray according to an embodiment.
Figure 11:
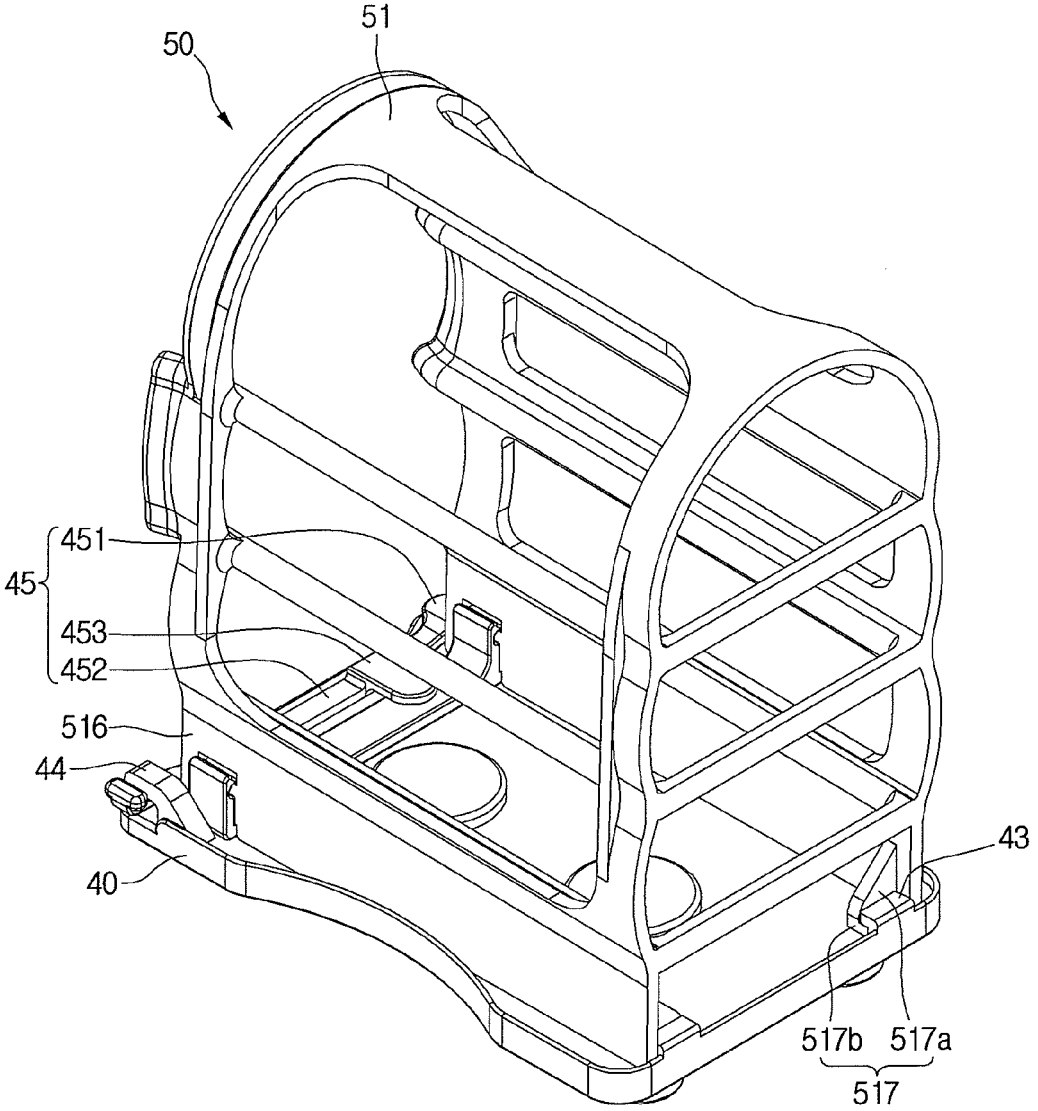
FIG. 11 is a rear perspective view illustrating a state in which the container holder of FIG. 6 is mounted on the agitation tray according to an embodiment.

FIG. 10 is a front perspective view illustrating a state in which the container holder of FIG. 6 is mounted on the agitation tray according to an embodiment. FIG. 11 is a rear perspective view illustrating a state in which the container holder of FIG. 6 is mounted on the agitation tray.

Referring to FIGS. 10 and 11, the container holder 50 according to an embodiment may be mounted on a top surface of the agitation tray 40 and separable from the agitation tray 40. For the separation and coupling of the container holder 50, the fixing mechanism 45 may be disposed on the agitation tray 40. The fixing mechanism fix globally 45 may be rotatably mounted on an edge of a top surface of the agitation tray 40. For this, a hinge hole (see reference numeral 48 of FIG. 18) may be defined in an edge of the agitation tray 40.

The fixing mechanism 45 may include a hinge 451 inserted into the hinge hole 48, a lever 452 that extends from the hinge 451, and at least one push button 453 that protrudes and extends from the lever 452 in a direction crossing an extension direction of the lever 452. The at least one push button 453 may include a plurality of push button 453.

A lever hanging portion 44 that protrudes from an edge of an opposite side of the agitation tray 40, that is, an edge of a side surface opposite to a side surface in which the hinge hole 48 is defined. When an end of the lever 452 is hung on the lever hanging portion 44, the push button 453 may push a top surface of the holder 53 to prevent the container holder 50 from being shaken during agitation.

A hook rib 43 may be bent in a "⌉" shape to extend from a rear end of the agitation tray 40. The hook rib 43 may extend in a central direction of the agitation tray 40. A hook 517 may protrude from an inner side surface of a rear end of a rear surface of the housing 51. The hook 517 may protrude from an inner side surface of the mounting platform 516 forming the housing 51, that is, from an inner side surface of each of the first and second sides of the mounting platform 516 to face each other. The hook 517 may include a vertical portion 517*a* that extends from the mounting platform 516, and a horizontal portion 517*b* that horizontally extends from a bottom surface of the vertical portion 517*a*. The hook 517 may be bent in a "⌊" shape. When the housing 51 is coupled to the agitation tray 40, the horizontal portion 517*b* of the hook 517 may be hooked on the hook rib 43, as illustrated in the drawings. Embodiments are not limited to the shown configurations of the hook rib 43 and the hook 517. For example, hooks having various shapes may be provided.

Hereinafter, a process of mounting the container holder 50 on the agitation tray 40 will be described in detail with reference to the accompanying drawings.

Figure 12:
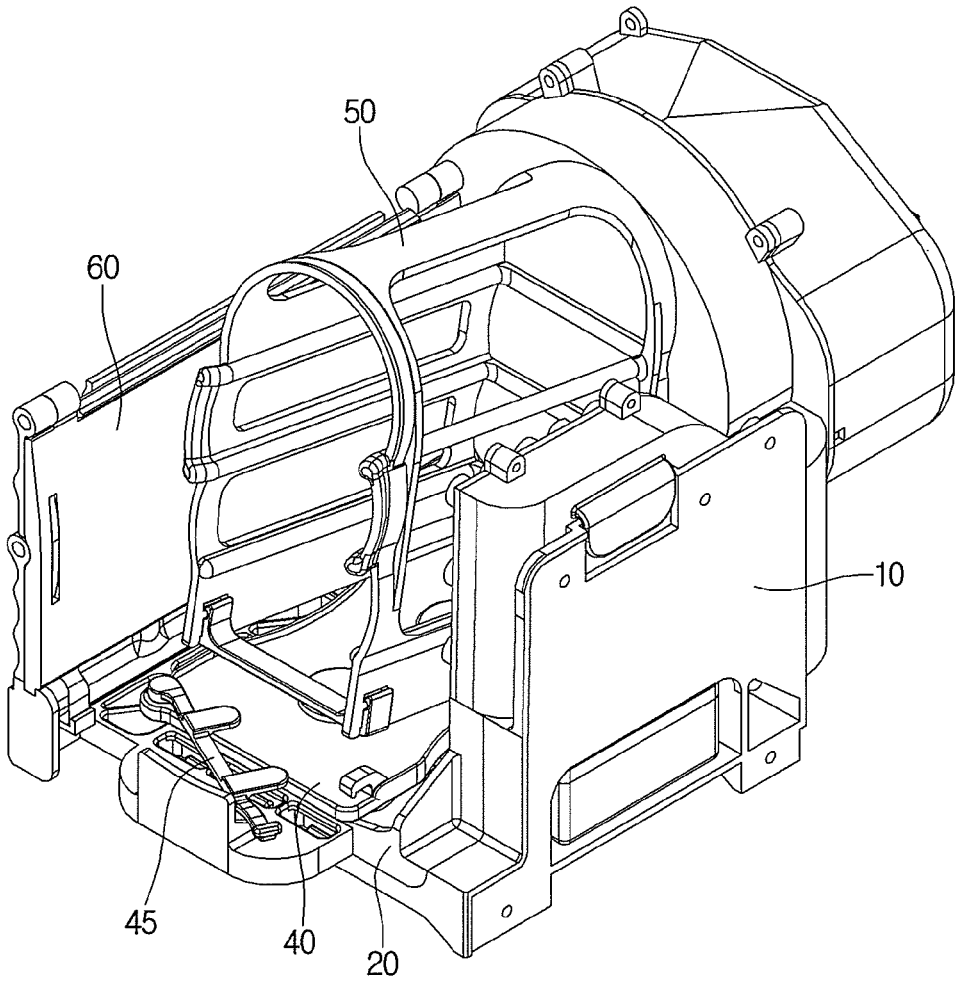
FIGS. 12 to 14 are views illustrating a process by which the container holder of the cooling apparatus may be mounted on the agitation tray according to an embodiment.
Figure 13:
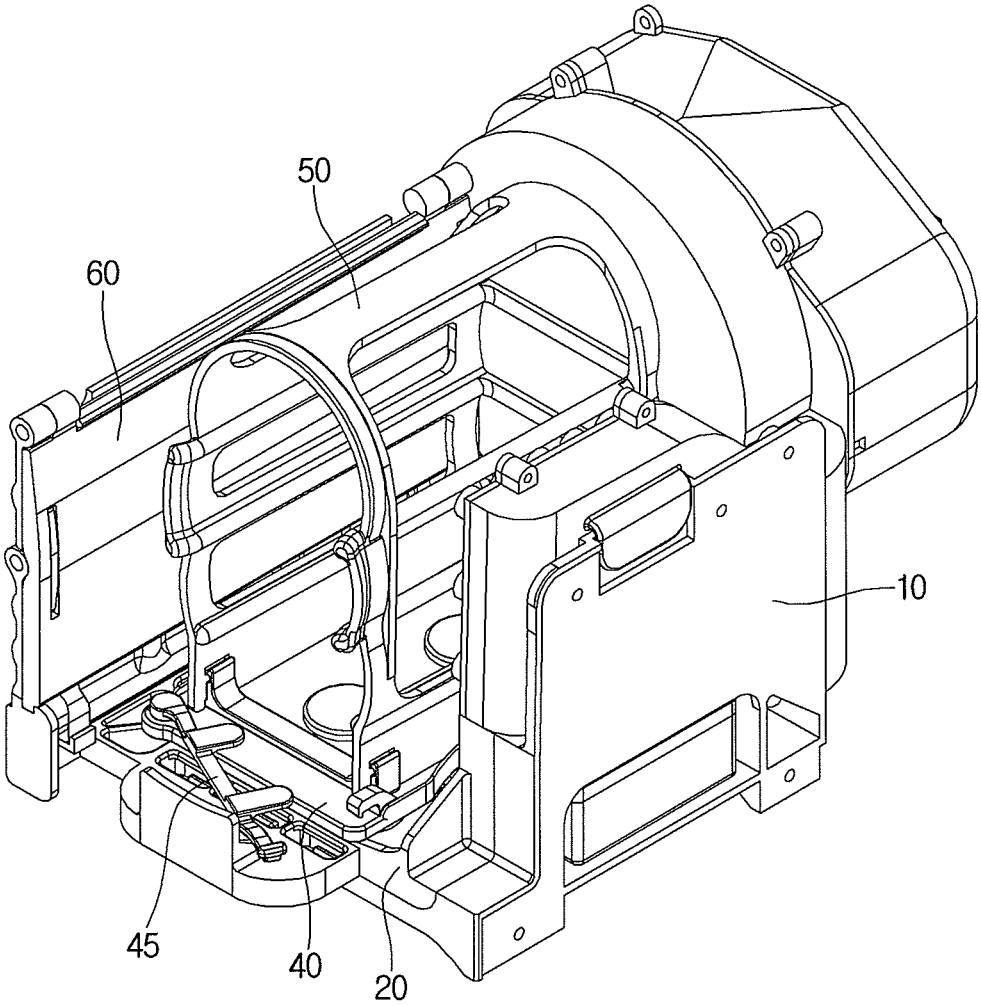
Figure 14:
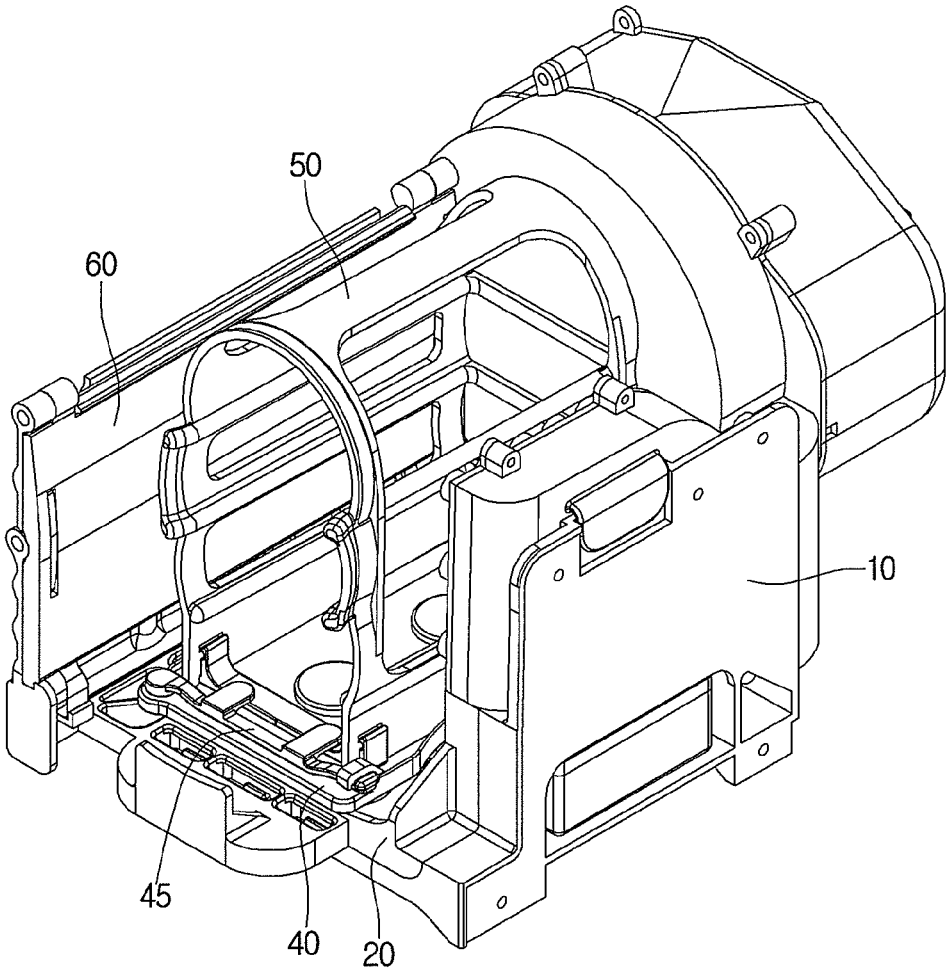

FIGS. 12 to 14 are views illustrating a process by which the container holder of the cooling apparatus may be mounted on the agitation tray according to an embodiment. Referring to FIG. 12, to mount the container holder 50 on the agitation tray 40, the hook 517 that protrudes from the lower end of the rear surface of the container holder 50 may be fitted into the hook rib 43 that protrudes from the rear end of the agitation tray 40. For this, in a state in which the container holder 50 is inclined backward, the lower end of the rear surface of the container holder 50 may contact the top surface of the agitation tray 40. The horizontal portion 517*b* of the hook 517 may be inserted into a lower side of the hook rib 43 and hooked on the hook rib 43 while the container holder 50 is pushed backward. The container holder 50 may be pushed backward in the state in which the container holder 50 is seated on the agitation tray 40 to allow the hook 517 to be hooked on the hook rib 43.

When the horizontal portion 517*b* is hooked on the hook rib 43, the front end of the container holder 50 may descend to allow the container holder 50 to be seated on the agitation tray 40. When the container holder 50 is further pushed in a state in which the container holder 50 is completely seated on the agitation tray 40, the hook 517 may be completely hooked on the hook rib 43. In this state, as illustrated in FIGS. 13 and 14, the lever 452 of the fixing mechanism 45 may rotate to allow the end of the lever 452 to be hung on the lever hanging portion 44. Thus, the push button 453 of the fixing mechanism 45 may be slide along a top surface of the holder 53 to push the top surface of the holder 53.

To separate the container holder 50 from the agitation tray 40, the above-described mounting processes may be performed in reverse order. That is, the lever 452 of the fixing device 45 may reversely rotate to separate the push button 453 from the holder 53. Also, the container holder 50 may be pulled forward to allow the hook 517 to be withdrawn from the hook rib 43. Then, the container holder 50 may be lifted and separated.

Figure 15:
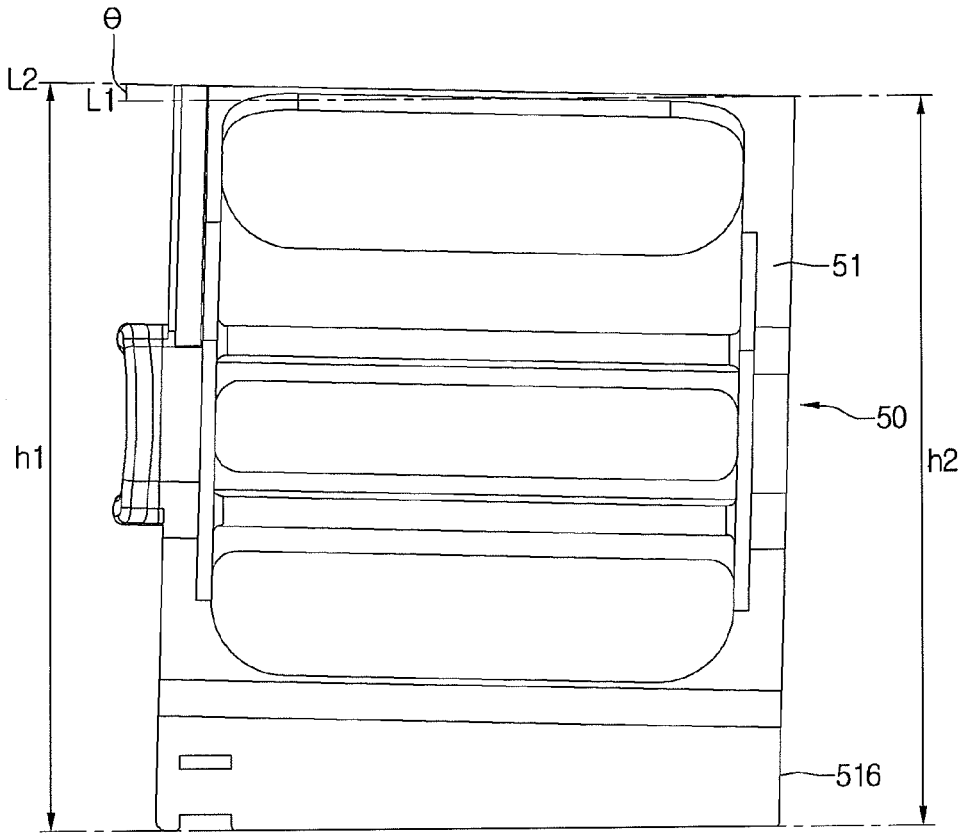
FIG. 15 is a side view of the container holder according to an embodiment.

FIG. 15 is a side view of the container holder according to an embodiment. Referring to FIG. 15, the container holder 50 according to an embodiment may be mounted in a state in which the container holder 50 is slightly inclined backward.

In detail, when the beverage container performs the agitating motion in the state in which the beverage container is mounted on the container holder 50, the beverage container may be shaken during agitation, and thus, be separated from the container holder 50. In particular, as the front surface of the container holder 50 is completely open to receive and withdraw the beverage container, the beverage container may be separated in a forward direction from the container holder 50 during agitation. To prevent this, the container holder 50 may be gradually inclined downward toward the rear side with respect to a center of gravity of the beverage container.

For this, a front surface of the mounting platform 516 may be higher than a rear surface thereof. That is, the front surface of the container holder 50 may have a height h1 greater than a height h2 of the rear surface thereof. Thus, when the container holder 50 is seated on the agitation tray 40, the container holder 50 may be inclined backward, and also, the beverage container may slide backward in the container holder 50.

In the state in which the container holder 50 is seated on the agitation tray 40, an angle θ between a line L2 that passes through a top surface of the container holder 50 and a horizontal line L1 may be about 5° to about 7°.

Figure 16:
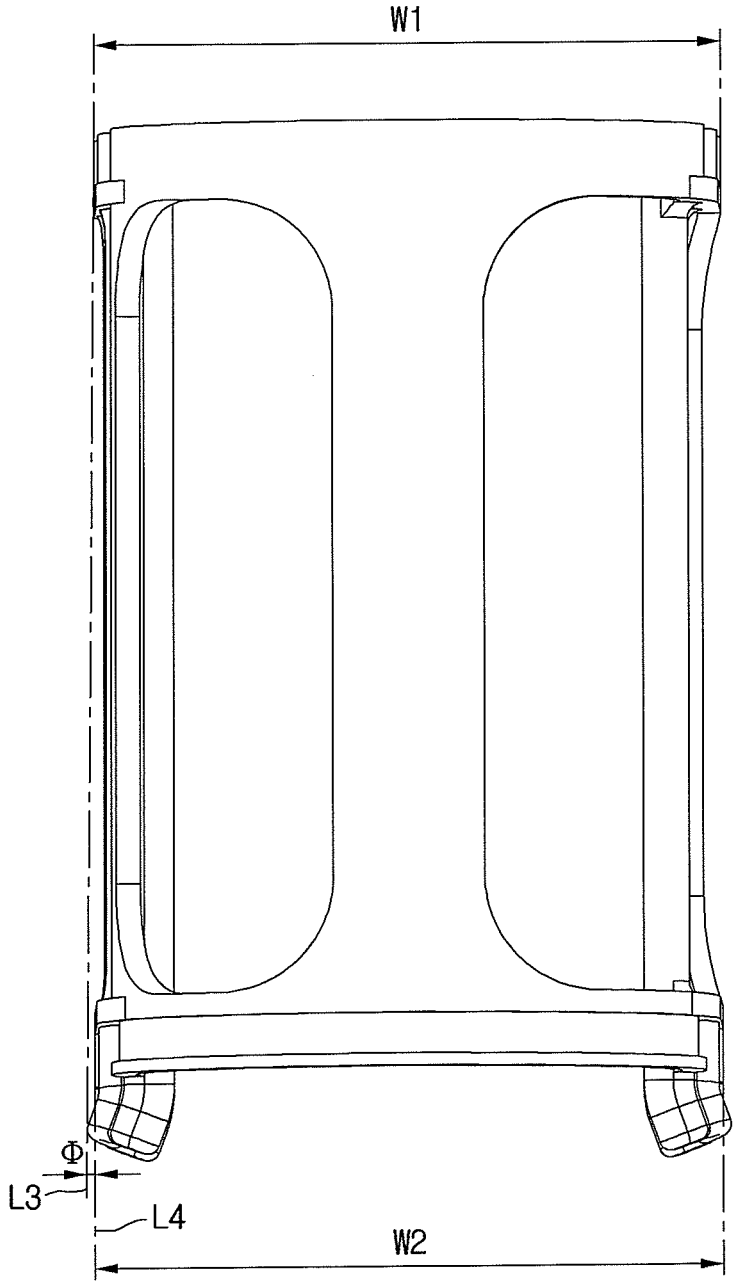
FIG. 16 is a plan view of the container holder according to an embodiment.

FIG. 16 is a plan view of the container support according to an embodiment. Referring to FIG. 16, the front surface of the container holder 50 according to an embodiment may have a width less than a width of the rear surface thereof. That is, as illustrated in FIG. 5, a distance between the first support 501*a* and the second support 501*b*, which form the front frame 501, may be less than a distance between the first support 502*a* and the second support 502*b*, which form the rear frame 502.

In detail, when beverage containers are received through an upper portion of a container holder to vertically stack the beverage containers, it may be very difficult to receive and withdraw the beverage containers. More particularly, when it is intended to withdraw a lowermost beverage container, there is inconvenience in that all upper beverage containers have to be withdrawn. Thus, in a case of a container holder in which beverage containers are received and vertically stacked in a state in which the beverage containers are laid out, when a beverage containers are received through a front side of the container holder, user convenience may be optimized.

A method for effectively agitating beverage containers vertically stacked on each other may involve an agitation mechanism that performs a rotation motion and a linear reciprocation motion on or in a horizontal plane. In this case, as the received beverage container may be separated from the container, holder through the open front surface of the container holder during agitation, it is necessary to consider a method to prevent this.

According to one embodiment, the front frame 501 may have a width less than a width of the rear frame 502 to prevent the beverage container from being separated during agitation. Also, the plurality of support ribs 518 that connects the first support 502*a* to the second support 502*b* may be disposed on the rear frame 502 to prevent the beverage container from being separated toward the rear side of the container holder 50. The plurality of support ribs 518 may be disposed at a same height as the plurality of container supports 52 to connect rear ends of the plurality of container supports 52 to each other, thereby preventing the beverage container from being separated toward the rear side of the container holder 50.

As the front surface of the container holder 50 is completely open, when the beverage container is received, the front surface of the container holder 50 may be spread by the weight of the beverage container. To prevent this, the clamp 54 and the holder 53 may be coupled to each other, and also, the front end of the container holder 50 may have a width W2 less than a width W1 of the rear end thereof.

Due to this structure, an angle between a line L4 that passes through side surfaces of the front and rear ends of the container holder 50, and a line L3 perpendicular to the rear surface of the container holder 50 that extends in the frontward to rearward direction of the container holder 50 may be about 5° to about 7°.

Figure 17:
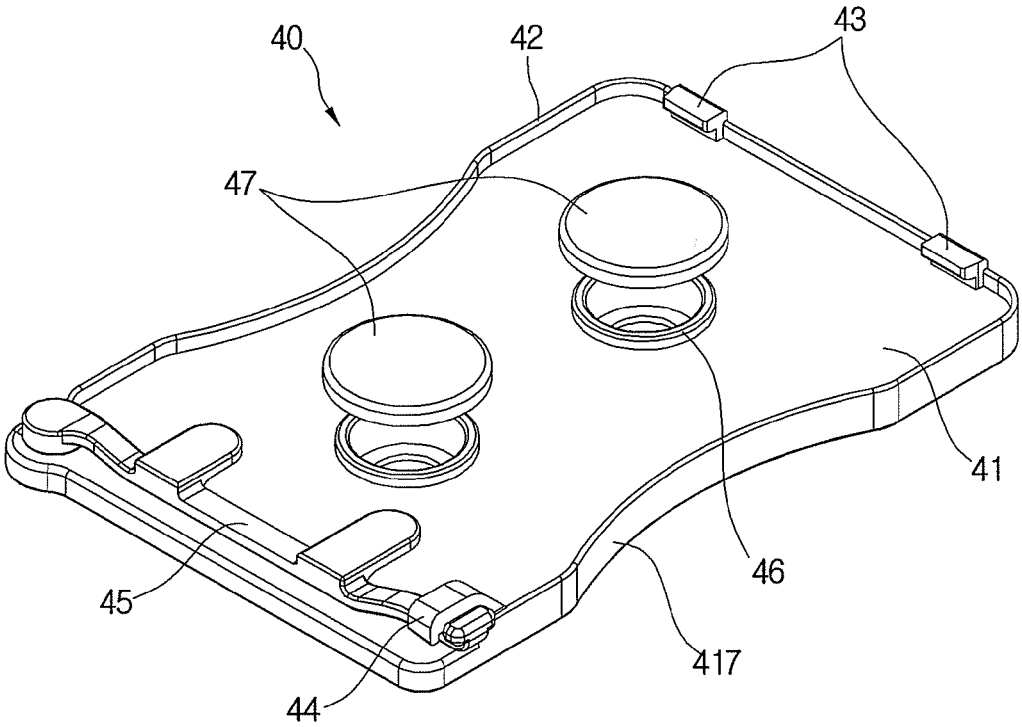
FIG. 17 is a perspective view of a top surface of an agitation tray according to an embodiment.
Figure 18:
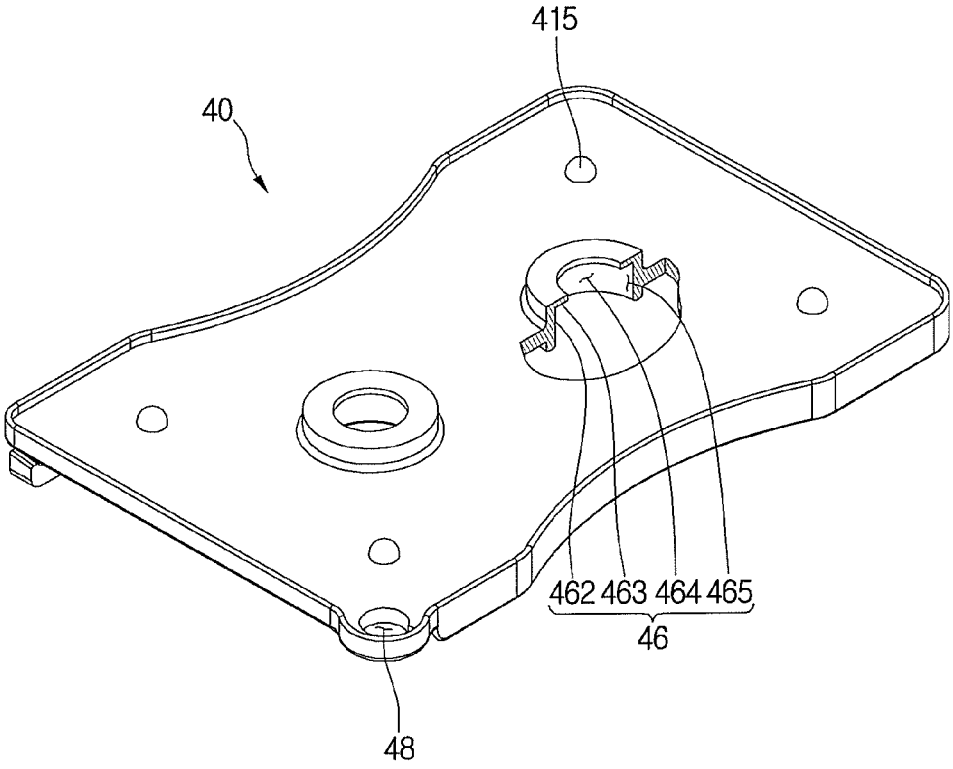
FIG. 18 is a bottom perspective view of the agitation tray of FIG. 17.

FIG. 17 is a perspective view of a top surface of an agitation tray according to an embodiment. FIG. 18 is a bottom perspective view of the agitation tray of FIG. 17.

Referring to FIGS. 17 and 18, the agitation tray 40 according to an embodiment may include a tray body 41, which may have an approximately rectangular plate shape, a water overflow prevention rib 42 disposed along an edge of both side surfaces and an edge of a rear surface of the tray body 41 to protrude in an upward direction, the hook rib(s) 43 which protrudes from the edge of the rear surface of the tray body 41, a cylindrical guide boss 46 having a predetermined diameter at a position spaced apart from a central portion of the tray body 41 in a frontward to rearward direction, four guide protrusions 415, respectively, that protrude from a bottom surface of the tray body 41 and that corresponds to four corners of the tray body 41, and a hinge hole 48, in which the hinge 451 of the fixing mechanism 45 may be inserted. An interference prevention groove 417, which may be curved at a predetermined curvature to be recessed, may be defined in one side surface or each side surface of the tray body 41. The interference prevention grooves 417 may prevent components around the agitation tray 40 from interfering with each other when the agitation tray 40 circularly moves using the vertical line as a rotational center.

As a cover that covers a motor of the agitation drive 30 protrudes upward around the agitation trace of the agitation tray 40, the interference prevention groove 417 may be recessed by a predetermined depth to prevent interference with the cover. Of course, if no components interfere with the agitation trace, the interference prevention groove 417 may be omitted.

A cap 47 may cover a top surface of the guide boss 46 to prevent water formed on the surface of the beverage container from flowing down and being introduced into the guide boss 46. Also, as the water overflow prevention rib 42 is not disposed on a front surface of the agitation tray 40, water dropping onto the agitation tray 40 may flow toward a front side of the agitation tray 40 and drop down toward a base 20.

The guide boss 46 may include a vertical portion 462 that vertically extends from each of top and bottom surfaces of the agitation tray 40 to protrude from each of the top and bottom surfaces of the agitation tray 40, and a horizontal portion 463 that horizontally extends from a lower end of the vertical portion 462. An eccentric shaft insertion hole 464 may be defined inside the horizontal portion 463, and a bush chamber 465 may be defined inside the guide boss 46.

As the horizontal portion 463 extends from the lower end of the vertical portion 462, the eccentric shaft insertion hole 464 may have a diameter less than an inner diameter of an upper end of the guide boss 46. Thus, a bush, which will be described hereinbelow, may be inserted into the bush chamber 465 and seated on the horizontal portion 463. An eccentric shaft, which will be described hereinbelow, of the agitation disk may be inserted into the eccentric shaft insertion hole 464.

Figure 19:
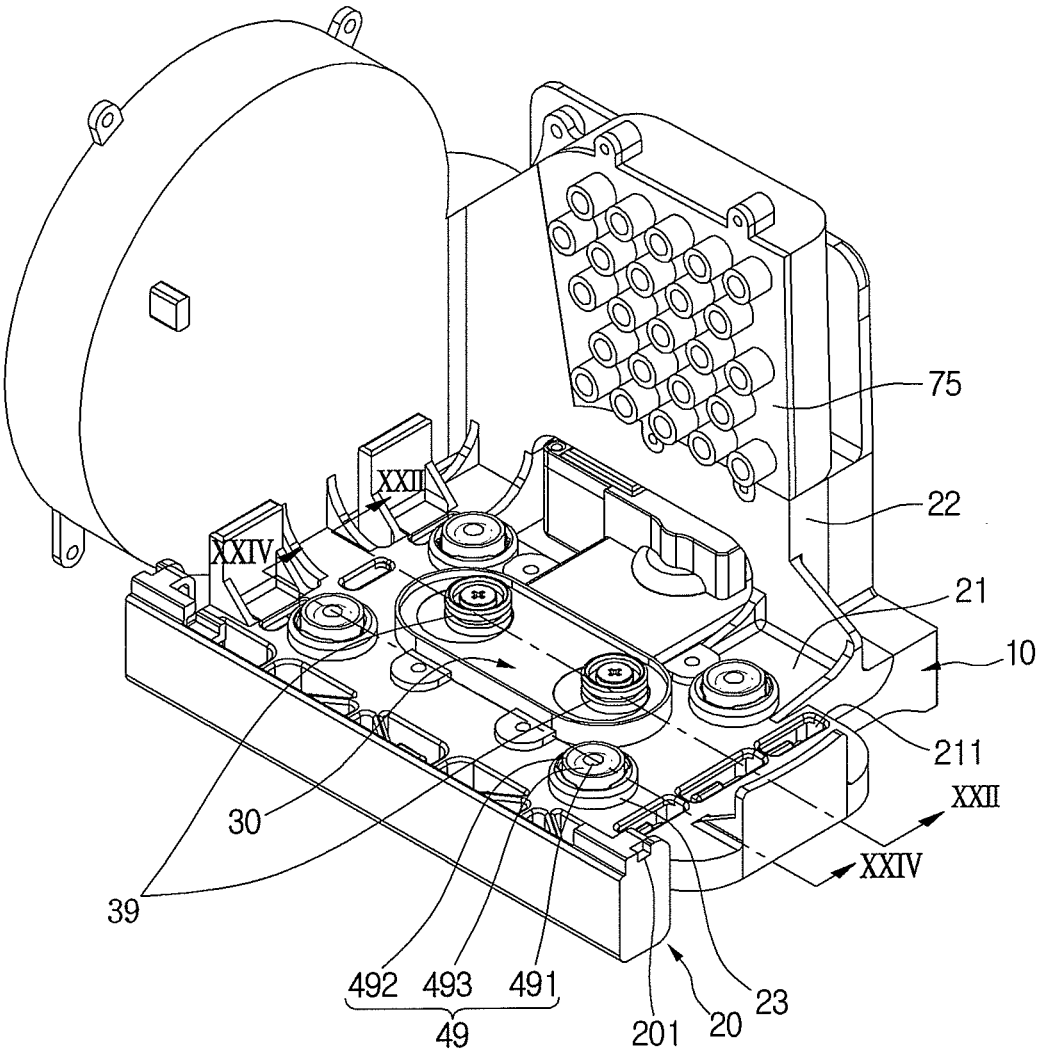
FIG. 19 is a view illustrating a state in which an agitation drive is mounted on a base according to an embodiment.

FIG. 19 is a view illustrating a state in which an agitation drive is mounted on a base according to an embodiment. Referring to FIG. 19, the agitation drive 30 may provide agitating power to the agitation tray 40 and be inserted into a mounting groove defined in the base 20.

In detail, the bracket 10 may be mounted on the base 20. The base 20 may include a bottom 21, on which the agitation drive 30 and the agitation tray 40 may be disposed, and a side 22 that vertically extends from a side surface of the bottom 21. The bottom 21 may be seated on the bottom 11 of the bracket 10, and the side 22 may be closely attached to the side 12 of the bracket 10. A discharge duct, which will be described hereinbelow, of duct 90 to discharge cool air may be disposed on an upper end of the side 22 to spray the cool air toward the side surface of the beverage container.

A drain hole 211 may be defined in the bottom 21 adjacent to the front end of the agitation tray 40. Thus, water flowing down from the front end of the agitation tray 40 may be drained onto a bottom of the freezer compartment 3 through the drain hole 211. The water may include condensate water formed on the surface of the beverage container or condensate water formed on the surface of the container holder 50.

Four sleeves may be defined in four edges of a top surface of the bottom 21, and a tray support 49 may be fitted into each of the sleeves 23. The tray support 49 may have an empty cylindrical shape having a short length. The tray support 49 may have an open bottom surface.

A guide groove 493 may be recessed by a predetermined depth between a central portion 491 and an edge 492 of a top surface of each tray support 49. The guide protrusion 415, which protrudes from the bottom surface of the agitation tray 40, may be seated on the guide groove 493. When the agitation tray 40 is circularly moved along the agitation trace by the agitation drive 30, the guide protrusion 415 may circularly move along the guide groove 493.

The agitating motion mechanism of the agitation tray 40 as described above may be defined as a motion in which the guide protrusion 415 of the agitation tray 40 performs a circular movement or revolution motion along the guide groove 493 with respect to a vertical line or axis that passes through the center of the tray support 49. Each of the sleeves 23 may have an inner diameter slightly greater than an outer diameter of the tray support 49. Thus, when the guide protrusion 415 circularly moves along the guide groove 493, the tray support 49 may more freely move within the sleeve 23. As a result, the agitating motion of the agitation tray 40 may be more smoothly performed.

In detail, when the agitation tray 40 is seated on the tray supports 49, a friction force may occur at a portion at which the guide protrusion 415 and the guide groove 493 contact each other, due to a weight of the container holder 50 and the beverage container. Due to this friction force, the guide protrusion 415 and the tray support 49 may integrally rotate with respect to each other.

When the tray support 49 is press-fitted into the sleeve 23, the guide protrusion 415 and the tray support 49 may not integrally rotate with respect to each other. Thus, the agitation tray 40 may not smoothly rotate. To prevent this, the tray support 49 may have an outer diameter slightly less than an inner diameter of the sleeve 23. Thus, the tray support 49 may smoothly rotate during agitation.

Figure 20:
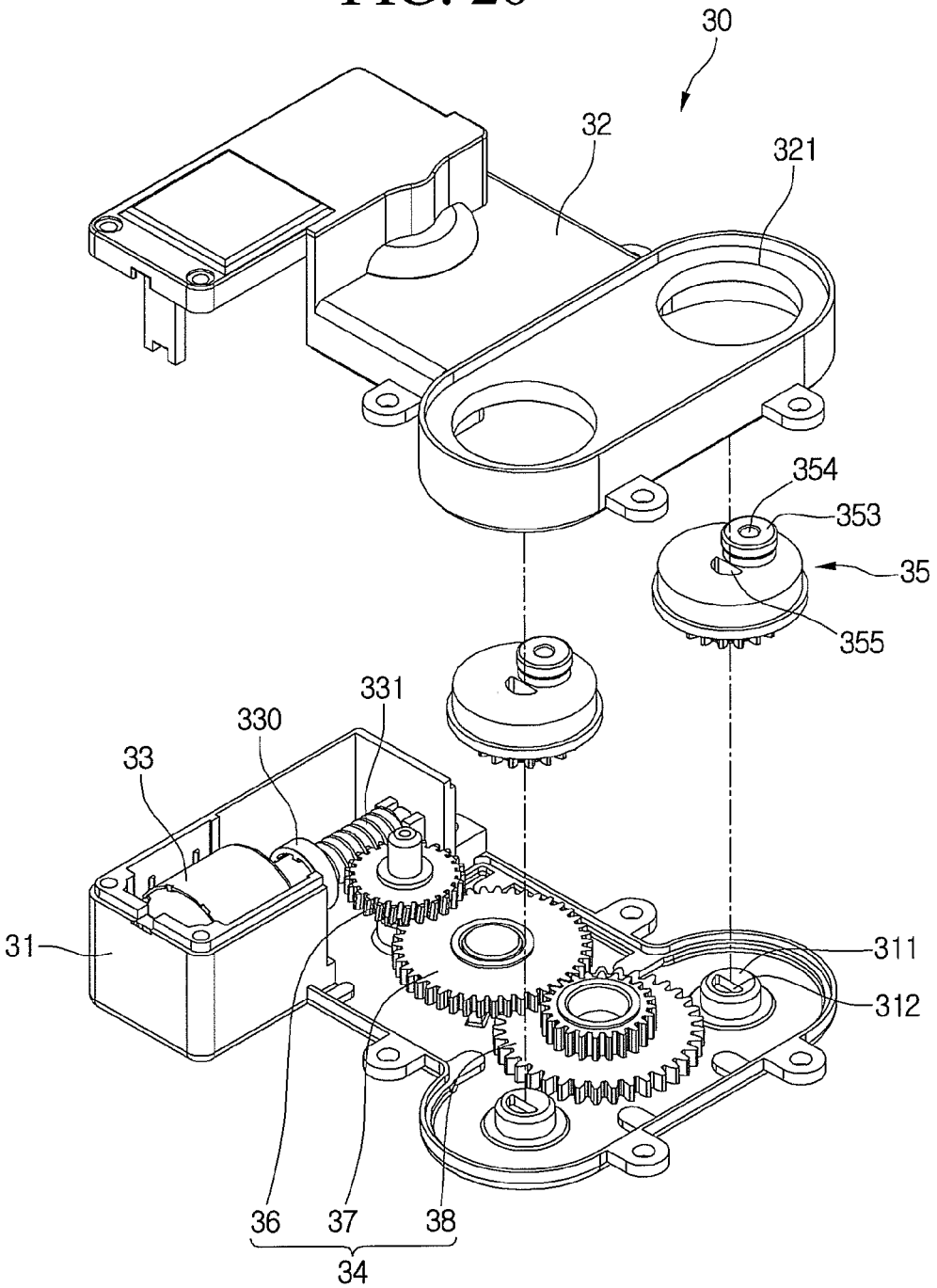
FIGS. 20 and 21 are exploded perspective views illustrating a structure of the agitation drive of FIG. 19.
Figure 21:
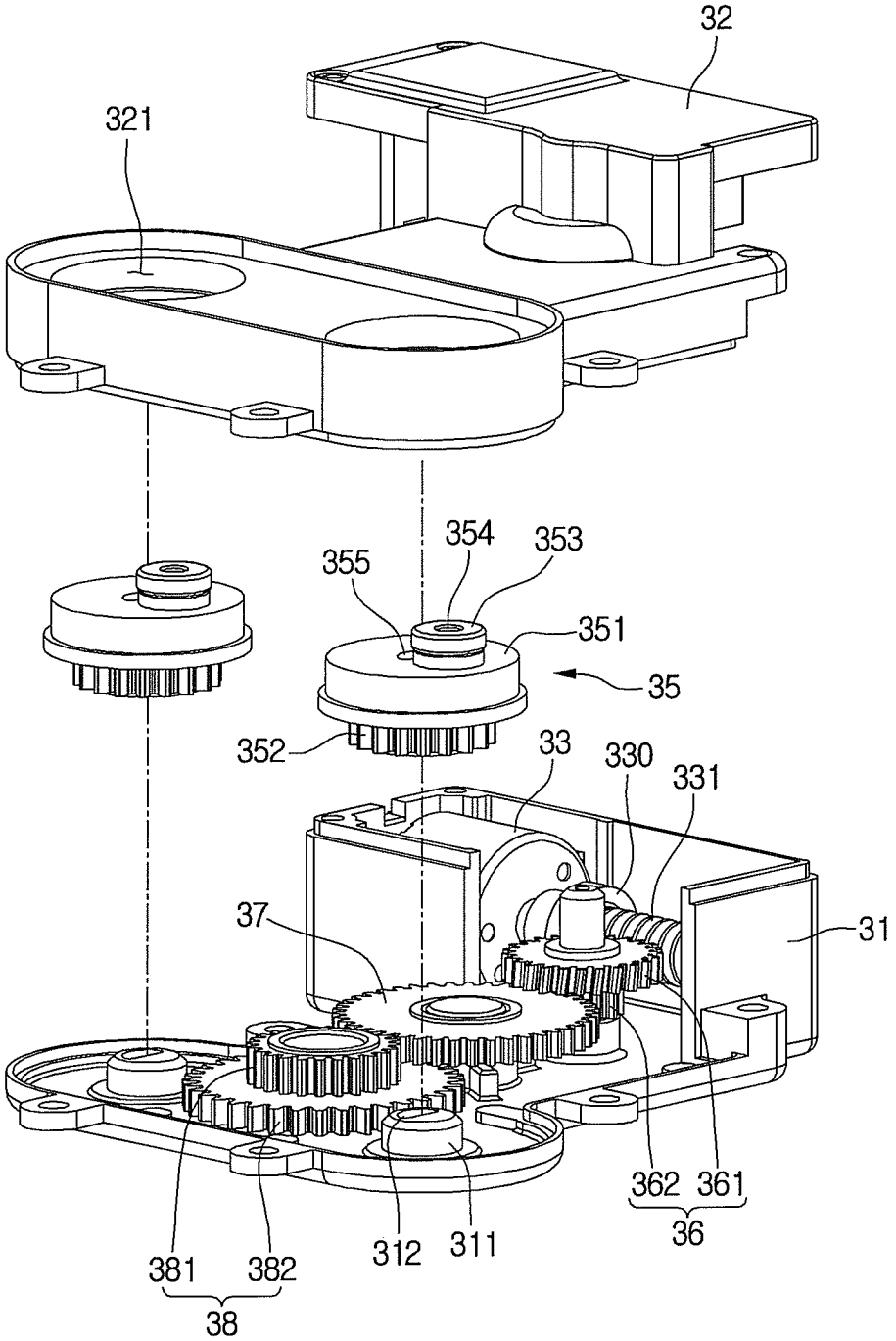

FIGS. 20 and 21 are exploded perspective views illustrating a structure of the agitation drive of FIG. 19. Referring to FIGS. 20 and 21, the agitation drive 30 according to an embodiment may include a case 31 having an open top surface, a cover 32 that covers the open top surface of the case 31, an agitation motor 33 seated on or at an inside of the case 31 to generate an agitation drive force, a gear assembly 34 rotated by the drive force transmitted from the agitation motor 33, and a pair of agitation disks 35 rotated by the rotational force transmitted through the gear assembly 34. The case 31 may be divided into a first area, on which the agitation motor 33 may be mounted, and a second area, on which the gear assembly 34 may be mounted. A pair of support bosses 311 that protrude from a bottom of the case 31, and the pair of agitation disks 35 may be, respectively, fitted into the pair of support bosses 311. A jig hole 312 having a semicircular shape may be defined in each of the pair of support bosses 311.

A jig hole 355 having a semicircular shape may be defined in each agitation disk 35. Thus, the pair of agitation disks 35 may be aligned by a jig pillar, which will be described hereinbelow, that passes through the jig holes 312 and 355. This will be described in detail with reference to the accompanying drawings.

A pair of agitation disk insertion holes 321, into which the agitation disks 35 may be inserted, may be defined in the cover 32. When the cover 32 is coupled to the case 31, the pair of agitation disks 35 may be inserted into the agitation disk insertion holes 321, respectively.

A driveshaft 330 may extend from the agitation motor 33, and a worm gear 331 may be disposed on an outer circumferential surface of the driveshaft 330 to transmit the rotational force of the agitation motor 33 to the gear assembly 34. The gear assembly 34 may include a first gear 36 having gear tooth engaged with the worm gear 33, a second gear 37 engaged with the first gear 36, and a third gear 38 engaged with the second gear 37. The third gear 38 may be gear-coupled to the pair of agitation disks 35. Thus, when the agitation motor 33 operates, the pair of agitation disks 35 may rotate.

The first gear 36 may include an upper gear 361 engaged with the worm gear 331, and a lower gear 362 disposed under the upper gear 361 and engaged with the second gear 37. The third gear 36 may include an upper gear 381 engaged with the second gear 37, and a lower gear 382 disposed under the upper gear 381 and engaged with the pair of agitation disks 35. The second gear 37 may be gear-coupled to the lower gear 362 of the first gear 36 and the upper gear 381 of the third gear 38.

Each of the pair of agitation disks 35 may include a disk body 351 having a cylindrical shape, a pinion 352 disposed under the disk body 351 and engaged with the lower gear 382 of the third gear 38, and an eccentric shaft 353 that protrudes from a top surface of the disk body 351. The eccentric shaft 353 may be eccentric at a position spaced apart from a center of the disk body 351 in a radial direction. A coupling groove 354, in which a coupling member may be inserted, may be defined in the eccentric shaft 353, and a jig hole 355 having a semicircular shape may be defined in a central portion of the disk body 351. A boss insertion groove (see reference numeral 356 of FIG. 22) may be defined in the disk body 351. The boss insertion groove 356 may be recessed upward from a bottom of the disk body 351 by a predetermined depth.

As described above, the eccentric shaft 353 may be inserted into the eccentric shaft insertion hole 464 defined in a bottom surface of the guide boss 46 of the agitation tray 40. Thus, when the agitation disk 35 rotates, the eccentric shaft 353 may rotate with respect to a rotational axis of the agitation disk 35. Thus, the agitation tray 40 may also rotate along the rotational trace of the eccentric shaft 353 to agitate the beverage container received into the container holder 50.

Figure 22:
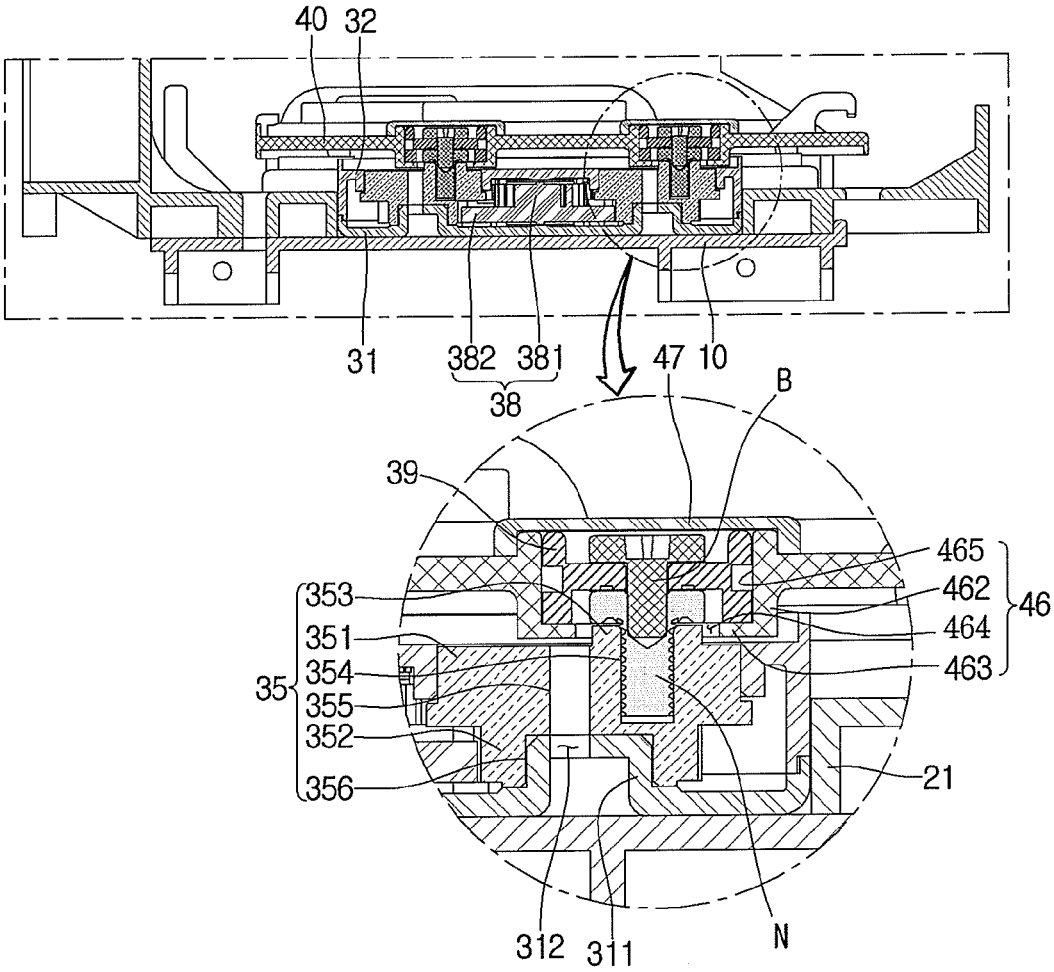
FIG. 22 is a longitudinal cross-sectional view, taken along line XXII-XXII of FIG. 19.

FIG. 22 is a longitudinal cross-sectional view, taken along line XXII-XXII of FIG. 19. Referring to FIG. 22, the bottom 21 of the base 20 may be disposed on the bottom 11 of the bracket 10, and the agitation drive 30 may be inserted into the seat groove defined in the base 20.

The support boss 311, which may protrude upward from a bottom of the case 31 of the agitation drive 30, may be inserted into the boss insertion groove 356 of the agitation disk 35. That is, the agitation disk 35 may be fitted into the support boss 311.

The agitation disk 35 may be inserted to pass through the agitation disk insertion hole 321 defined in the cover 32, and then, may be exposed to or at a top surface of the cover 32. When the agitation tray 40 is seated on a top surface of the base 20, the eccentric shaft 353 may be fitted into the eccentric shaft insertion hole 464 defined in a lower end of the guide boss 46. Also, a coupling member, such as a lock nut N, may be inserted into the coupling groove 354 of the eccentric shaft 353.

A circular bush 39 may be inserted into the bush chamber 465 defined in the guide boss 46 and seated on the horizontal portion 463 of the guide boss 46. In this state, a coupling member, such as a bolt B, may pass through the bush 39, and then, may be inserted into the lock nut N. Thus, the agitation tray 40 may integrally rotate with the eccentric shaft 353 of the agitation disk 35. After the bolt B is coupled, thereto, a top surface of the guide boss 46 may be covered by the cap 47.

Figure 23:
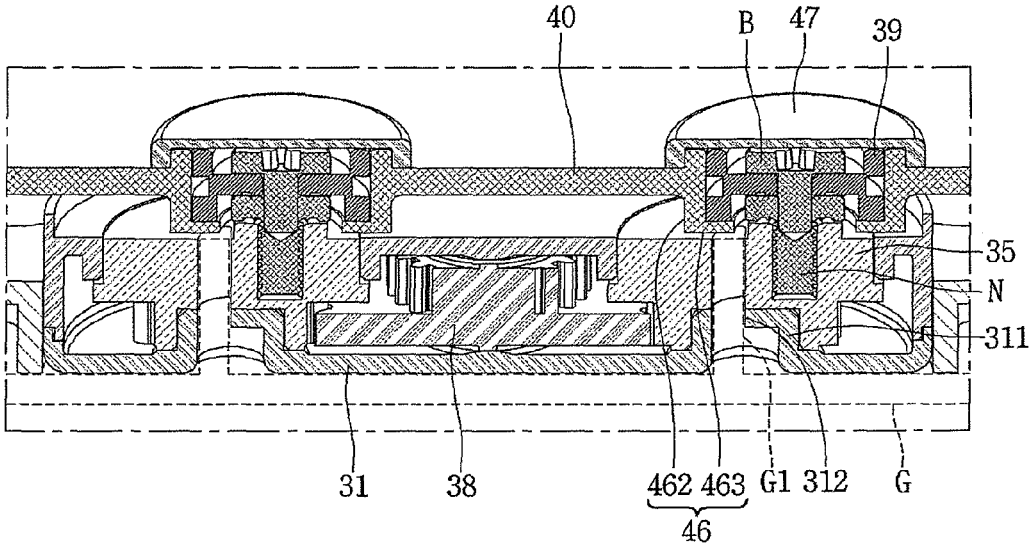
FIG. 23 is a cross-sectional view for explaining a process of assembling a pair of agitation disks.

FIG. 23 is a cross-sectional view for explaining a process of assembling a pair of agitation disks. Referring to FIG. 23, in the agitation drive 30 according to an embodiment, the pair of agitation disks 35 may be disposed on a same line at a position facing each other with respect to the third gear 38, and may be engaged with the third gear 38 to rotate at a same angular speed in a same direction. The pair of agitation disks 35 may include a first agitation disk and a second agitation disk. Thus, the guide bosses 46, in which the first and second agitation disks may be inserted, may include a first guide boss and a second guide boss.

As described above, as the pair of agitation disks 35 may be interlocked with each other to rotate, thereby allowing the agitation tray 40 to perform the agitating motion, when the pair of agitation disks 35 are inserted into the support, bosses 311, the insertion positions may be adjusted so that the jig holes 355 and 312 may be accurately aligned with each other on the same line. That is, when the eccentric shafts 353, respectively, which protrude from the pair of agitation disks 35, satisfy the following conditions, the agitating motion of the agitation tray 40 may be performed.

First, the pair of agitation disks 35 have to rotate in the same direction.

Second, a line that passes through a center of the eccentric shaft 353 of the first agitation disk and a center of the first agitation disk, and a line that passes through a center of the eccentric shaft 353 of the second agitation disk and a center of the second agitation disk have to coincide with each other, or be disposed substantially in parallel to each other. That is, the two lines have to disposed on the same line at an initial state (a point at which a rotational angle is about 0° or about 360°). Then, when rotation starts, the two lines may be maintained in an always substantially parallel state.

Third, centers of the eccentric shafts 353 have to be disposed on a same line at the initial state, but not disposed symmetrical to each other with respect to a vertical plane that passes between the pair of agitation disks 35.

If any one of the above-described three conditions is not satisfied, when the third gear 39 rotates, the agitation tray 40 may not rotate. Thus, a gear tooth of the third gear 38 and the pinion 352 of the agitation disk 35 may be damaged. For example, when the agitation disk 35 is assembled, if the eccentric shafts 353 are disposed symmetrical to each other even though the eccentric shafts 353 are disposed on the same line, the eccentric shafts 353 may be far away from each other in the initial state. In this state, when the agitation disks 35 rotate to an angle of about 90° in the same direction, the agitation tray 40 may be twisted, that is, not maintained in the substantially parallel state, like the initial state. Also, if the rotational degree exceeds an angle of about 90°, as the eccentric shafts 353 move to approach each other, the agitation tray 40 may not rotate. That is, the agitation tray 40 may be damaged, or a gear of the agitation drive 30 may be damaged. Thus, when assembled, it is very important to align the eccentric shafts 353 of the pair of agitation disks 35 with each other.

As described above, for alignment, in a state in which the gear assembly 34 is seated on the case 31, that is, the third gear 38 is ready to be engaged with the pinion 352 of the agitation disk 35, a jig member may be coupled to the bottom surface of the case 31. The jig member may include a jig body G disposed on a bottom surface of the case 31, and a jig pillar G1 that extends from a top surface of the jig body G. The jig pillar G1 may be a semicircular pillar having a same cross-section as each of the jig holes 312 and 355.

In a state in which the jig pillar G1 passes through the jig hole 312 defined in the support boss 311 to protrude upward, the pair of agitation disks 35 may be fitted therein. When the jig pillar G1 is inserted into the jig holes 355 of the pair of agitation disks 35, the pair of agitation disks 35 may be automatically aligned with each other. That is, the eccentric shafts 353 may satisfy the above-described conditions. Also, while the agitation disk 35 descends along the jig pillar G1, the pinion 352 may be engaged with the lower gear 382 of the third gear 38. When the pinion 352 of the agitation disk 35 is engaged with the lower gear 382 of the third gear 38, the jig member may be separated.

In this state, when the third gear 38 rotates, the pair of agitation disks 35 may rotate at the same time. Also, the eccentric shafts 353 may be disposed on the same line, or lines that pass through the center of the eccentric shaft 353 and the center of the agitation disk 35 may be maintained in the always substantially parallel state. Thus, while the lines that pass through the side surface of the agitation tray 40 are maintained in the always substantially parallel state, the agitation tray 40 may rotate.

Figure 24:
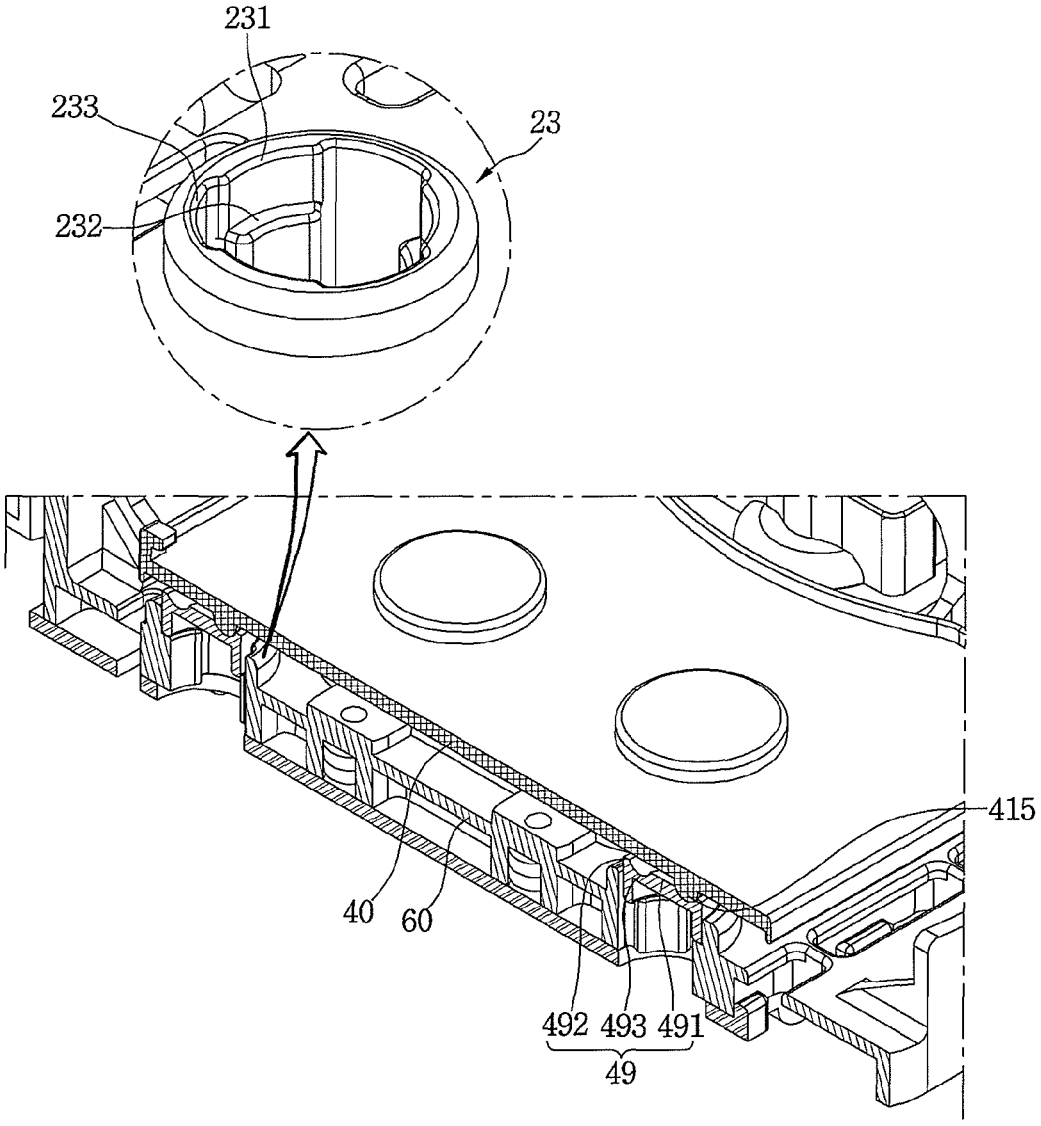
FIG. 24 is a longitudinal cross-sectional view, taken along line XXIV-XXIV of FIG. 19.

FIG. 24 is a cross-sectional view, taken along line XXIV-XXIV of FIG. 19. Referring to FIG. 24, for the stable agitating motion of the agitation tray 40, the four corners of the agitation tray 40 may be supported by the tray support 49. The sleeve 23 corresponding to each of the four corners of the agitation tray 40 may be defined the top surface of the bottom 21 of the base 20, and the tray support 49 may be inserted and seated inside the sleeve 23. A seat hole 231 may be defined inside the sleeve 23. The seat hole 231 may have an outer diameter slightly greater than a diameter of the tray support 49. A step 232 that supports the tray support 49 may be disposed at a position spaced downward from a top surface of the seat hole 231. A plurality of water drain holes 233 recessed or stepped by a predetermined depth in a radial direction may be defined in the seat hole 231. The plurality of water drain holes 233 may be spaced a predetermined distance from each other in a circumferential direction of the seat hole 231. As illustrated in the drawings, three seat holes may be provided; however, embodiments are not limited thereto.

Also, in a state in which the tray support 49 is fitted into the sleeve 23, the guide protrusion 415, which may protrude from the bottom surface of the agitation tray 40, may be seated on the guide groove 493 of the tray support 49. When the agitation tray 40 rotates by the driving of the agitation drive 30, the guide protrusion 415 may circularly move along the guide groove 493.

Figure 25:
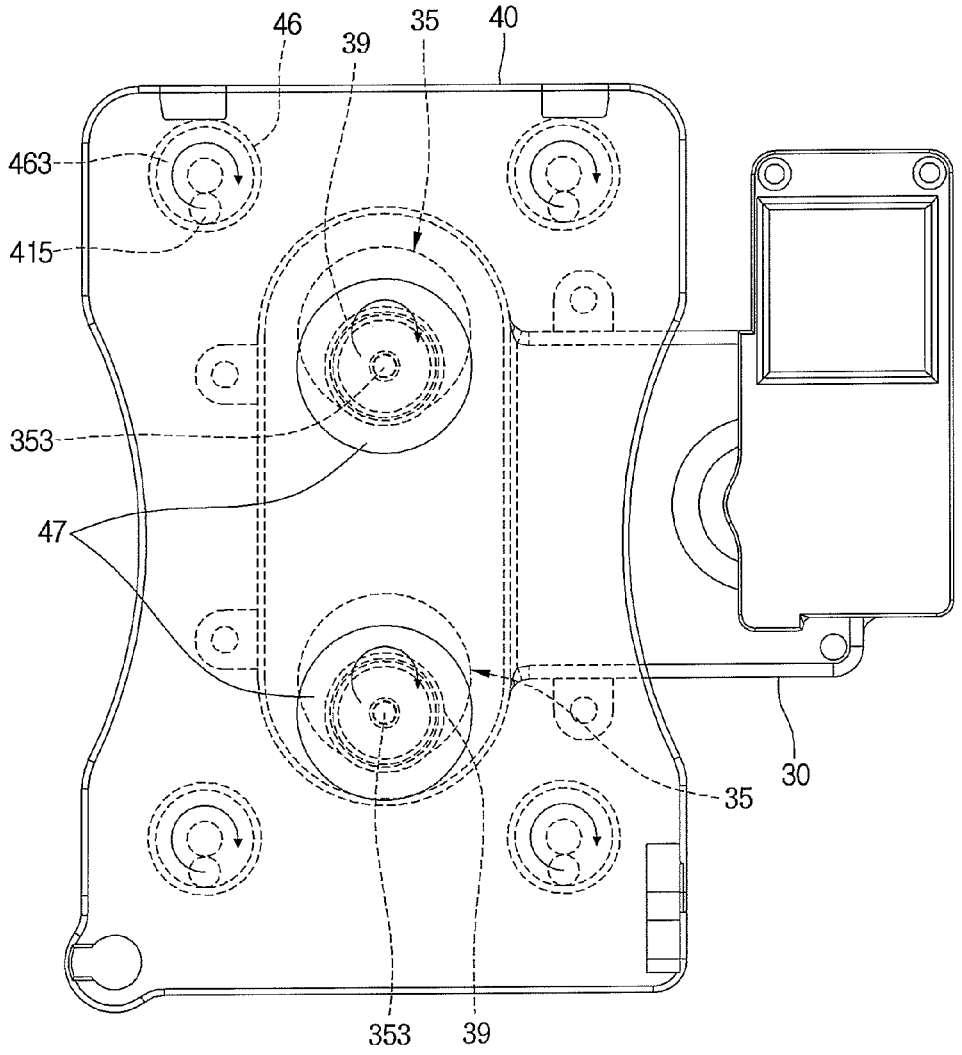
FIG. 25 is a view illustrating a moving trace of a guide protrusion when the agitation tray performs an agitating motion according to an embodiment.

FIG. 25 is a view illustrating a moving trace of a guide protrusion when the agitation tray performs an agitating motion according to an embodiment. Referring to FIG. 25, when the agitation disk 35 rotates, the eccentric shaft 353 circularly moves with respect to a center of the vertical line that passes through the center of the agitation disk 35. Thus, the agitation tray 40 may also circularly move along the same trace. In detail, as the agitation tray 40 circularly moves, the guide protrusion 415, which protrudes from the bottom surface of the agitation tray 40, may move along the guide groove 493 defined in the top surface of the tray support 49 to circularly move with respect to the central portion 491 of the tray support 49.

Figure 26A:
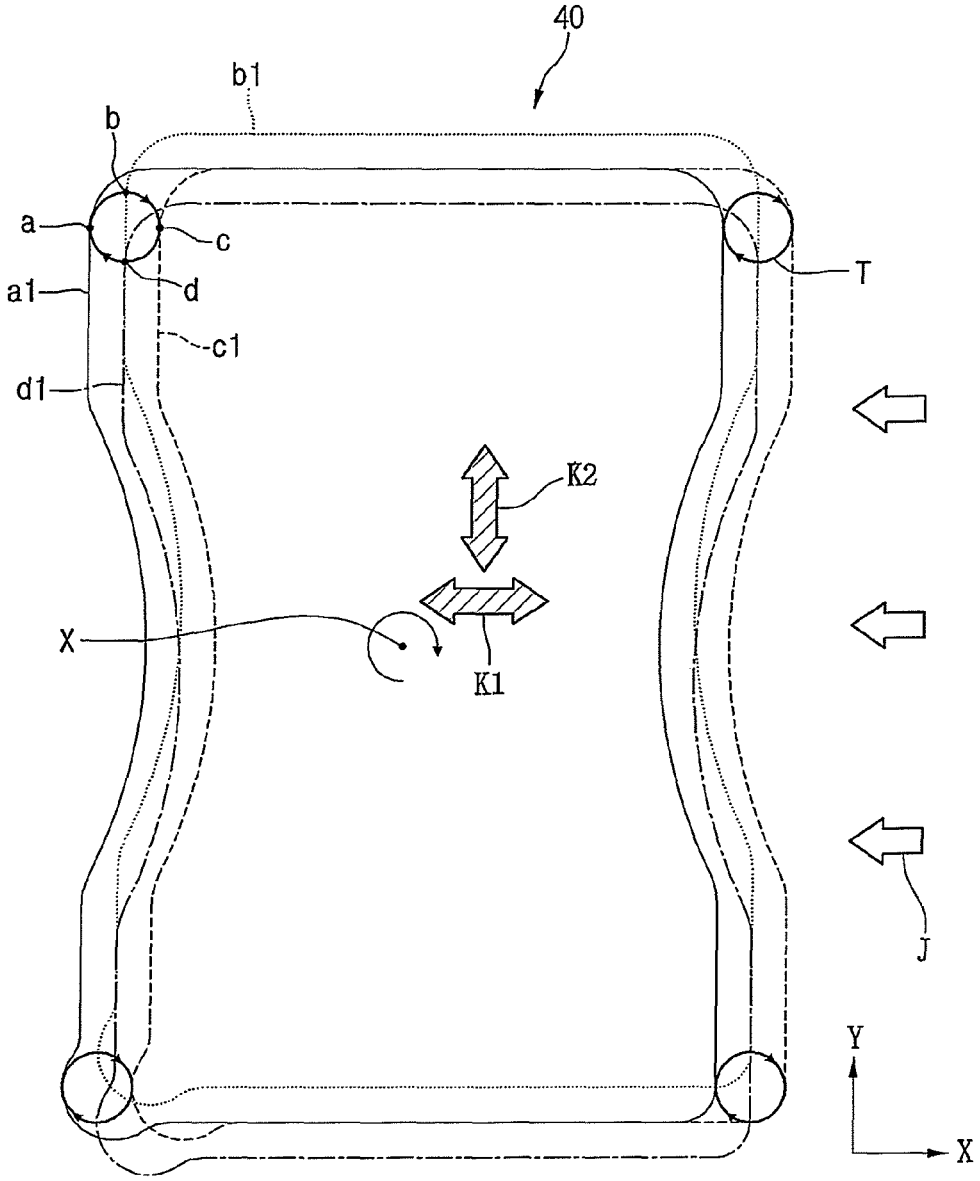
FIG. 26A is a view illustrating an agitation trace of the agitation tray according to an embodiment.

FIG. 26A is a view illustrating an agitation trace of the agitation tray according to an embodiment. Referring to FIG. 26A, the agitation tray 40 may circularly move with respect to the vertical axis by the rotation of the pair of agitation disks 35. While the agitation is performed, the lines that pass through the side surfaces of the agitation tray 40 may be maintained in the always substantially parallel state. That is, one corner of the agitation tray 40 may rotate along a circular trace of a→b→c→d from an angle of about 90° in the initial state. The agitation tray 40 at each point may rotate to form a trace of a1→b1→c1→d1.

When centers of the tray supports 49 adjacent to each other are connected to each other, a two-dimensional plane, that is, a rectangular shape may be formed. A vertical axis X that passes through a center of the rectangular shape may serve as a center of the agitating motion of the agitation tray 40. Thus, the agitation tray 40 may have an agitation mechanism or trace that circularly moves with respect to the vertical axis X. The tray support 49 may be disposed inside the trace of the agitation tray 40 to prevent condensate water from dropping onto the agitation tray 40 and flowing into the sleeve 23.

Alternatively, in the agitation mechanism according to embodiments, the agitation tray 40 may two-dimensionally move on a horizontal plane. That is, the agitation tray 40 may alternately perform a reciprocating motion K1 in a left/right or first lateral direction (an X-axis direction) and a reciprocating motion K2 in a front/rear or a second lateral direction (an Y-axis direction). The cool air may be supplied in the first lateral direction (the X-axis direction).

In detail, when the agitation tray 40 moves in the left/right direction (K1), the beverage container may be reciprocated between a point that is closer to discharge grille 75, and a point that is farther from the discharge grille 75. As the moving direction of the agitation tray 40 coincides with a supply direction of the cool air, the cool air supplied from the discharge grille 75 may always collide with the circumferential surface of the beverage container regardless of a position of the agitation tray 40. Thus, cool air leaking through the container holder without being heat-exchanged may not occur.

Figure 51:
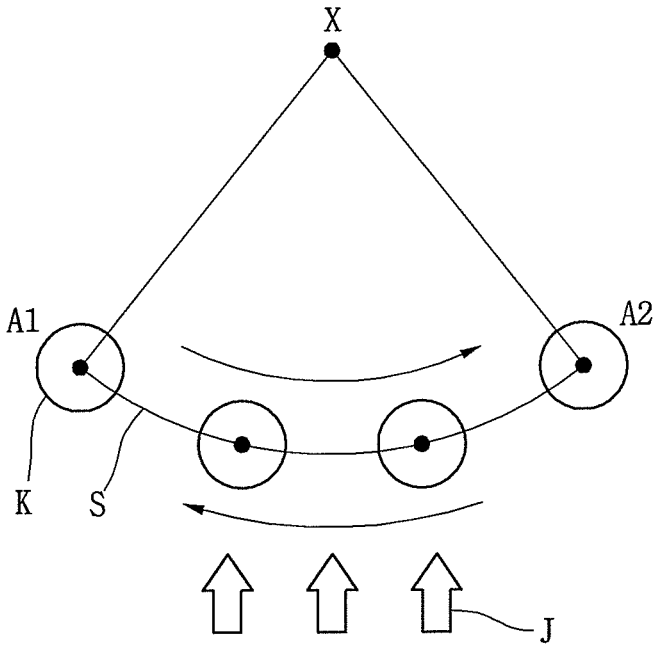
FIG. 51 Related Art
FIG. 51 is a schematic view of an agitation mechanism of a related art cooling apparatus.

On the other hand, in the agitation mechanism of the cooling apparatus according to the related art, as illustrated in FIG. 51, an amount of cool air colliding with the beverage container may vary according to the position of the beverage container. That is, in the case of the cooling apparatus performing the swing motion according to the related art, the cool air leaks through the cooling apparatus without colliding with the beverage container when the beverage container is disposed at end positions A1 and A2 of the agitation trace. More particularly, despite that agitation is actively performed at a moment at which the beverage container descends from the end point, an amount of cool air colliding with the circumferential surface of the beverage container is less at this point. Also, an amount of cool air colliding with the surface of the beverage container is maximized at a point at which agitation intensity is weakest, that is, the beverage container is disposed at the lowest point of the agitation trace. Thus, when compared to the cooling apparatus in which the swing motion occurs in the left/right direction, and the cool air is supplied upward, that is, the conventional cooling apparatus having the mechanism in which the agitation direction and the cool air supply direction cross each other, the cooling apparatus having the mechanism in which the agitation direction and the cool air supply direction are the same or substantially parallel to each other according to an embodiment may have superior cooling efficiency.

Thus, the mechanism in which the agitation tray has an agitation component that is linearly reciprocated on the horizontal plane, and the agitation direction of the beverage container and the cool air supply direction are the same or substantially parallel to each other, and the agitation direction is substantially perpendicular to a longitudinal direction of the beverage container may be included in embodiments to produce superior cooling efficiency.

Figure 26B:
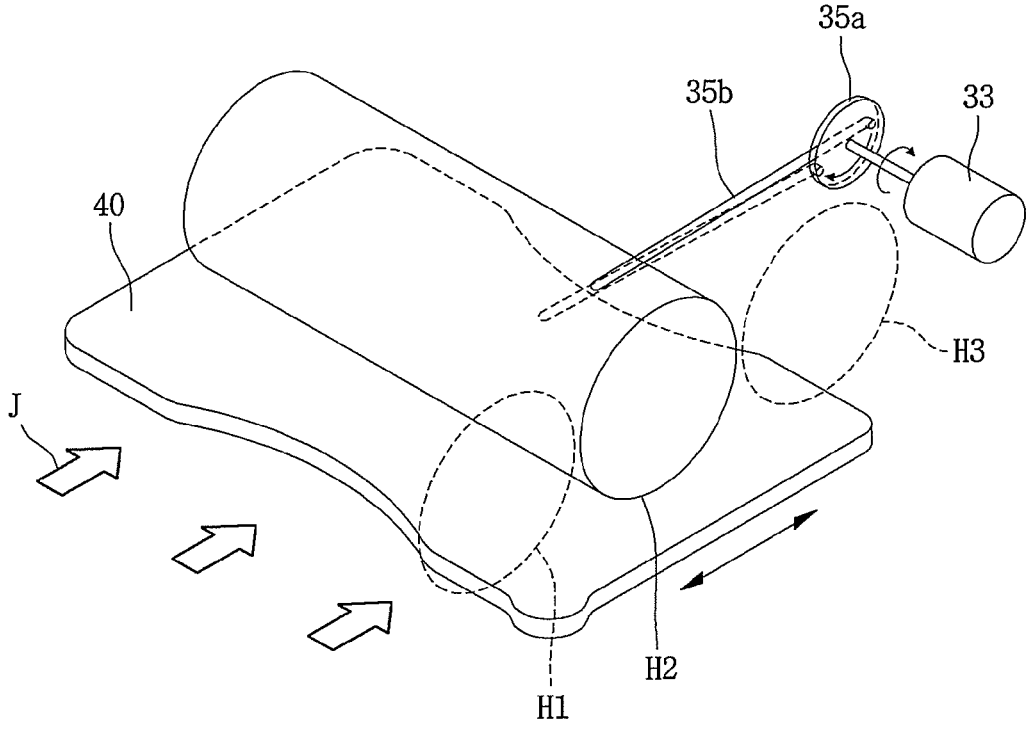
FIG. 26B is a view illustrating another example of a cooling apparatus having an agitation mechanism in which an agitation direction of a beverage container is the same as a cool air supply direction.

FIG. 26B is a view illustrating another example of a cooling apparatus having an agitation mechanism in which an agitation direction of the beverage container is the same as a cool air supply direction. Referring to FIG. 26B, the agitation tray 40 may perform agitating motion in a left/right or first lateral direction on the horizontal plane, and the beverage container may be disposed to extend in a front/rear or second lateral direction of the agitation tray 40, as shown in FIG. 26B. That is, a longitudinal direction of the beverage container and the agitation direction of the beverage container may be substantially perpendicular to each other. Also, cool air J may be supplied in a same direction or in a direction substantially parallel to the agitation direction of the beverage container.

In detail, a first end of an agitation link 35*b* may be connected to an edge of one side of the agitation tray 40, and an agitation disk 35*a* may be connected to a second lateral end of the agitation link 35*b*. Also, a rotational shaft of the agitation motor may be connected to a center of the agitation disk 35*a*. Further, the first lateral end of the agitation link 35*b* may be rotatably connected to the agitation tray 40, and the second lateral end may be eccentrically connected to the agitation disk 35*a*. That is, the second lateral end of the agitation link 35*b* may be connected to any position spaced apart from a center of the agitation disk 35*a*.

Due to the above-described structure, when the agitation motor 33 rotates, the agitation disk 35*a* may rotate. As the agitation disk 35*a* rotates, the second lateral end of the agitation link 35*b* may rotate together therewith. Also, as the second lateral end of the agitation link 35*b* is eccentrically connected to the agitation disk 35*a*, as the agitation link 35*b* operates, the agitation tray 40 may be reciprocated in the left/right or first lateral direction. That is, the agitation tray 40 may repeatedly move in the same direction as a flow direction of the supplied cool air and in a direction opposite to a flow direction of the cool air. That is, the beverage container may be reciprocated on the horizontal plane along a path of H1→H2→H3→H2→H1.

Due to the above-described agitation mechanism, the beverage container may repeat the linear reciprocating motion, that is, move in a direction away from the cool air supply corresponding to the discharge grille 75 and then move in a direction that approaches the cool air supply. Also, all of cool air supplied from the cool air supply may collide with the beverage container. Thus, cooling efficiency may be significantly improved when compared to that of the agitation mechanism according to the related art. The agitation mechanism described with reference to FIGS. 1 to 26A may include the agitation mechanism described with reference to FIG. 26B.

That is, the agitation mechanism applied to the cooling apparatus according to embodiments may be designed equal to the linear reciprocating motion mechanism of FIG. 26B. However, in the case of the agitation mechanism of FIG. 26A, the container holder may be shaken by the agitation tray 40, the beverage container, and inertia of the container holder 50, and also the agitation drive may be damaged. Thus, the cooling apparatus according to embodiments may be designed so that the agitating motion alternately occurs in the X-axis direction and Y-axis direction, as illustrated in FIGS. 1 to 26A, to minimize shaking of the container holder due to inertia and life-shortening of the agitation drive. That is, embodiments disclosed herein may include the cooling apparatus in which the agitation tray performs the agitating motion on or in at least the horizontal plane and has an agitation component that is linearly reciprocated in a direction substantially perpendicular to the longitudinal direction of the beverage container, and the cool air may be supplied in a direction substantially perpendicular to the longitudinal direction of the beverage container.

As the container holder 50 according to embodiments has a structure in which the beverage containers may be vertically stacked on each other, uniform agitation regardless of liquid reception position within the beverage container may be considered. That is, agitation intensities of a lower beverage container and an upper beverage container may be uniformly maintained.

In the case of the well-known swing motion, as the upper beverage container has a trace less than a trace of the lower beverage container, agitation intensities may be different from each other. That is, as liquid mixing in the upper beverage container is relatively less than liquid mixing in the lower beverage container, heat exchange efficiency may be relatively deteriorated.

However, according to embodiments disclosed herein, in the case of the agitation mechanism in which the agitation tray is linearly reciprocated in the X-axis or Y-axis direction on the horizontal plane, or the agitation mechanism in which the agitation tray has the agitation component that is linearly reciprocated in the X-axis or Y-axis direction and performs revolution motion with respect to the vertical axis, which may be defined as a Z-axis, agitation intensities of the beverage containers may be uniformly maintained regardless of a stacked height of the beverage containers. Herein, the revolution motion may be defined as a motion that rotates with respect to the vertical axis while being maintained in a state in which front and rear surfaces of the beverage container always face the front and rear sides in a state in which the beverage container is laid out.

Also, it is difficult to apply an agitation mechanism in which the beverage container rotates using an axis that passes through a center in a longitudinal direction of the beverage container as a rotational axis for a container holder structure in which beverage containers are vertically stacked. That is, as the driving mechanism to rotate each of the beverage containers vertically stacked on each other has to be designed, this structure may be unsuitable.

Also, in a case of the container holder structure in which the beverage container is received in a stand-up state or orientation, an agitation space of the liquid filled into the beverage container may be insufficient. Thus, when compared to the container holder structure in which the beverage container is received in a state in which it is laid on its side, agitation performance may be deteriorated. Also, if the container holder in which the beverage container is laid on its side is disposed on the agitation tray which is linearly reciprocated on the horizontal plane, mixing of liquid may significantly occur at a time point at which the agitation tray is changed in direction. That is, the agitation tray may have the component which is linearly reciprocated in a direction substantially perpendicular to the longitudinal direction of the beverage container.

Figure 27:
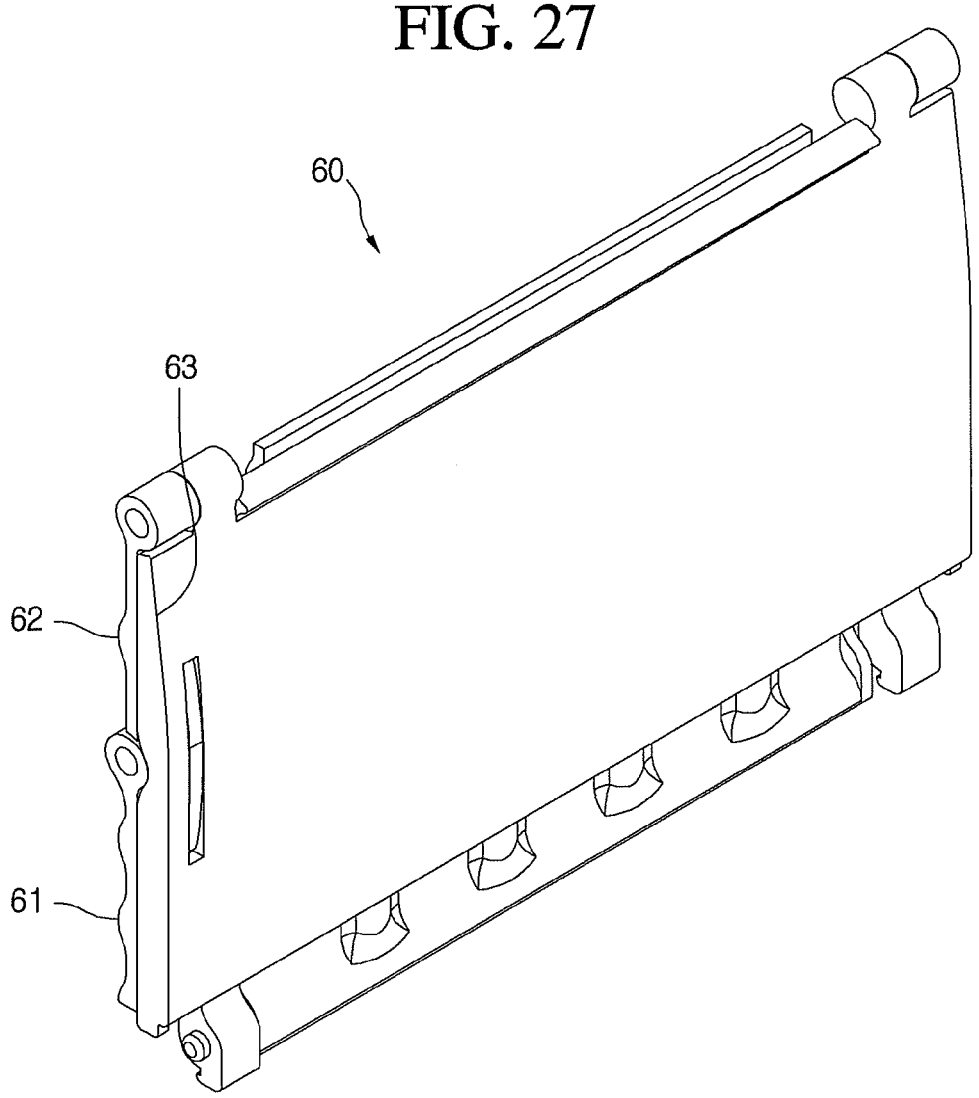
FIG. 27 is a perspective view illustrating a state in which a partition wall provided in the cooling apparatus is folded according to an embodiment.
Figure 28:
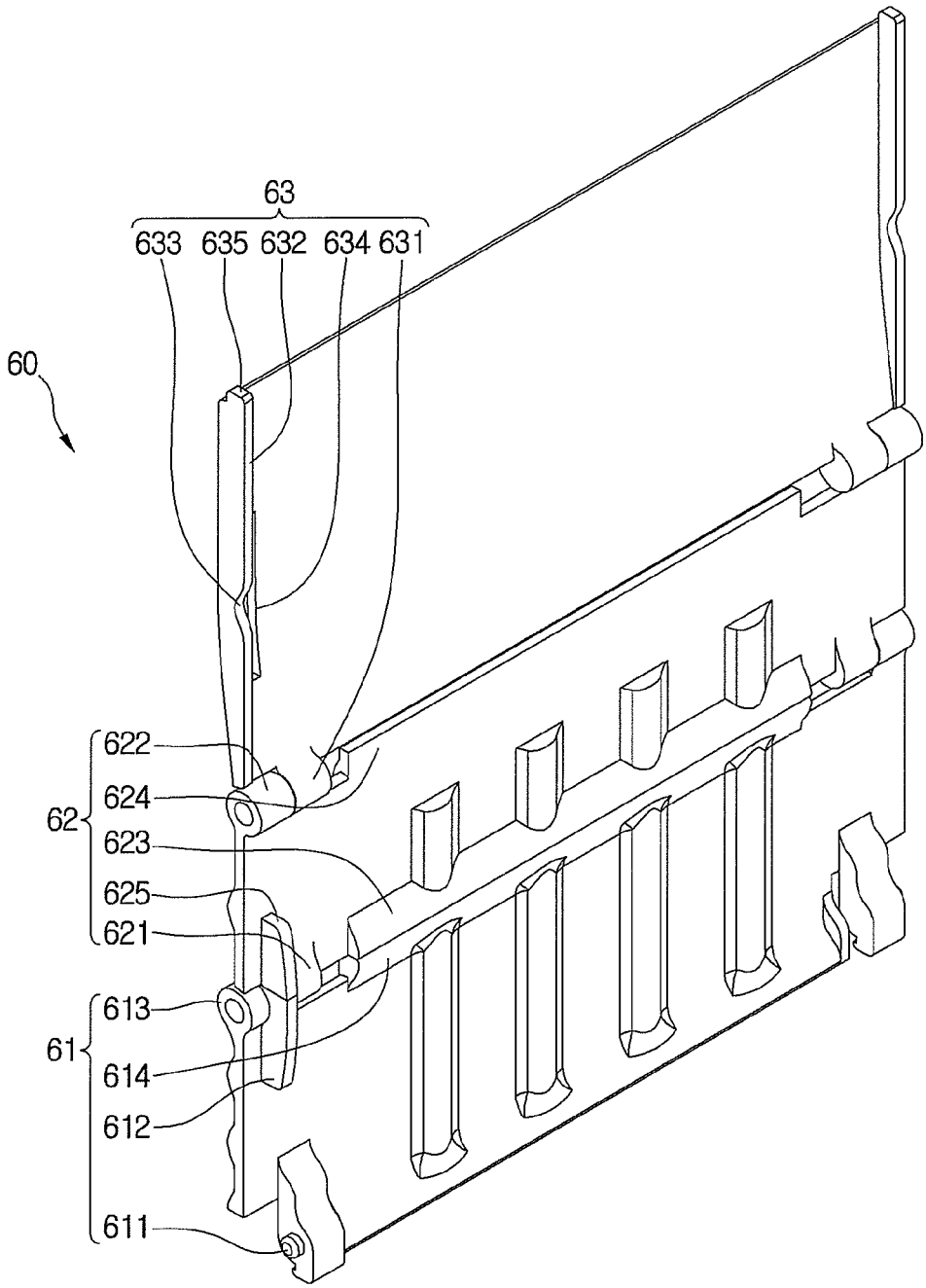
FIG. 28 is a side perspective view illustrating a state in which the partition wall of FIG. 27 is spread open.
Figure 29:
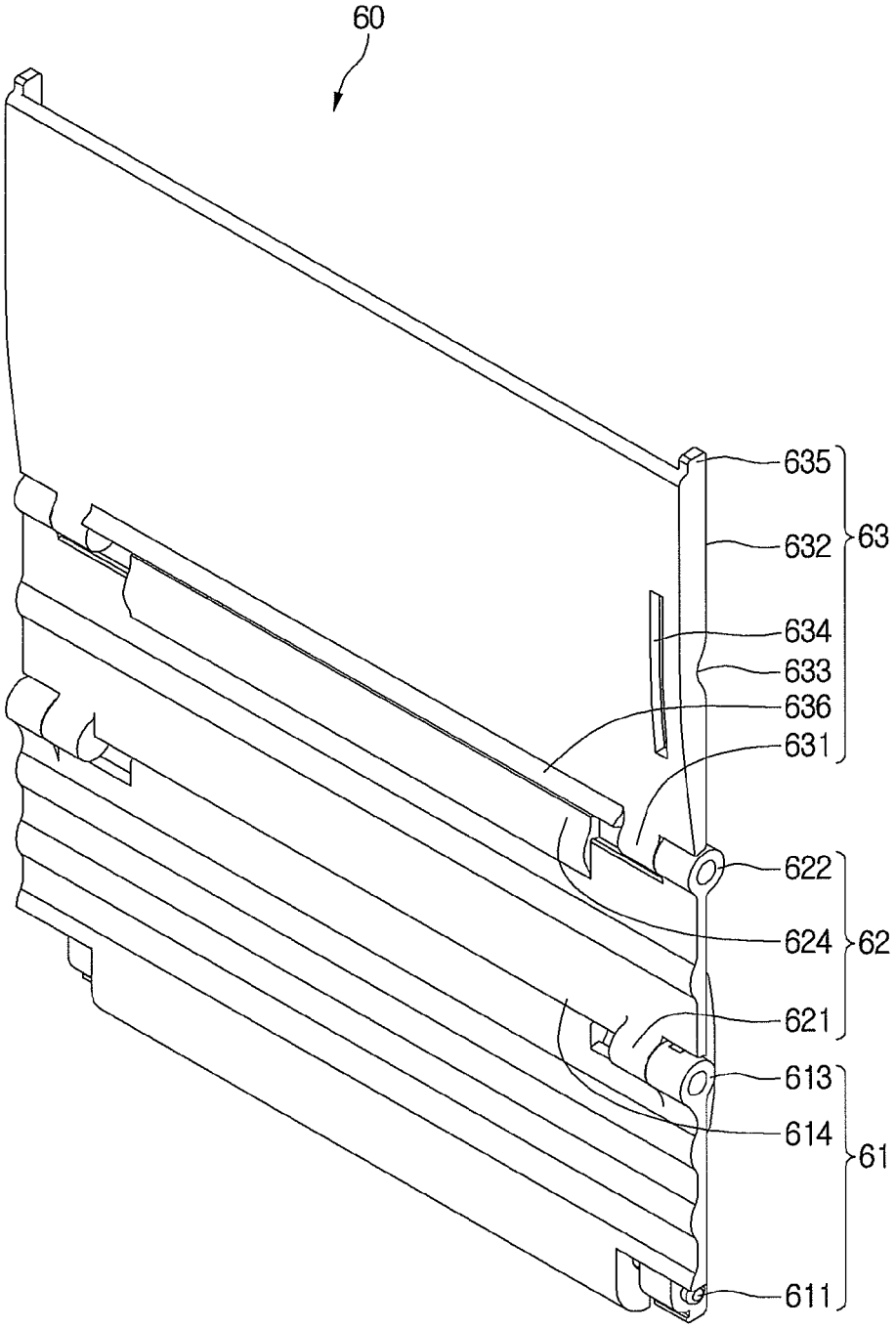
FIG. 29 is another side perspective view illustrating a state in which the partition wall of FIG. 27 is spread open.

FIG. 27 is a perspective view illustrating a state in which a partition wall provided in the cooling apparatus is folded according to an embodiment. FIG. 28 is a side perspective view illustrating a state in which the partition wall is spread open. FIG. 29 is another side perspective view illustrating a state in which the partition wall is spread open.

Referring to FIGS. 27 to 29, partition wall 60 may include a plurality of link-type plates rotatably coupled to each other. That is, partition wall 60 may include a lower partition wall 61 having a lower end rotatably coupled to an edge of the bottom 21 of the base 20, an intermediate partition wall 62 having a lower end rotatably coupled to an upper end of the lower partition wall 61, and an upper partition wall 63 having a lower end rotatably coupled to an upper end of the intermediate partition wall 62. The partition wall 60 may stand up at a side of the container holder 50, as shown in FIG. 27. Also, the partition wall 60 may serve as a protection wall to prevent items, such as food, received in the storage compartment from being introduced into the container holder 50.

The lower partition wall 61 may include a hinge shaft 611 that protrudes from each of front and rear ends of a lower end thereof, a shaking prevention rib 612 that protrudes from a side surface to prevent the intermediate partition wall 62 from being shaken, a connection end 613 disposed on each of front and rear ends of a top surface thereof, and a rotation prevention rib 614 disposed on a top surface of the connection end 613.

The intermediate partition wall 62 may include a lower connection end 621 disposed on each of front and rear ends of a bottom surface thereof, a shaking prevention rib 625 that protrudes to contact the shaking prevention rib 612, which protrudes from the lower partition wall 61, an upper connection end 622 disposed on each of front and rear ends of a top surface thereof, a first rotation prevention rib 623 disposed on the bottom surface, and a second rotation prevention rib 624 disposed on the top surface.

The upper partition wall 63 may include a connection end 631 disposed on each of front and rear ends of a bottom surface thereof, an interval maintenance rib 632 that protrudes from each of front and rear ends of a side surface thereof, an insertion slit 634, in which the shaking prevention ribs 612 and 625 may be inserted, and a fitting protrusion 635 that protrudes from an upper end of a front surface thereof. An interference prevention groove 633 to prevent interference with the connection end 613 that connects the lower partition wall 61 to the intermediate partition wall 62 when the upper partition wall 63 is folded may be defined in the interval maintenance rib 632.

The hinge shaft 611 may protrude from one connection end of the connection end 613 of the lower partition wall 61 and the lower connection end 621 of the intermediate partition wall 62. The intermediate partition wall 62 may be rotatably connected to the lower partition wall 61 in a manner in which the hinge shaft 611 is inserted into the other connection end of the connection ends 613 and 621. A connection structure between the upper partition wall 63 and the intermediate partition wall 62 may be equally provided as described above.

The hinge shaft 611 of the lower partition wall 61 may be inserted into a hinge groove defined in each of the front and rear ends of the top surface of the bottom 21 of the base 20, and then, maybe rotatably coupled thereto. Also, a side surface of the intermediate partition wall 62 may be connected, rotatable up to an angle of about 180°, in a state in which the side surface is closely attached to a side surface of the lower partition wall 61 (folded state). That is, as illustrated in the drawings, the intermediate partition wall 62 and the lower partition wall 61 may be rotatable up to a state in which the intermediate partition wall 62 and the lower partition wall 61 are disposed in a line (spread state). In the state in which the intermediate partition wall 62 is spread open, the intermediate partition wall 62 may not further rotate due to the shaking prevention ribs 625 and 621.

As the intermediate partition wall 62 does not further rotates in the state in which the shaking prevention rib 625 of the intermediate partition wall 62 contacts the shaking prevention rib 612 of the lower partition wall 61, when the intermediate partition wall 62 is spread open, the intermediate partition wall 62 may rotate in only a direction in which the intermediate partition wall 62 is closely attached to the side surface of the lower partition wall 61. Also, in the state in which the upper partition wall 63 and the intermediate partition wall 62 are disposed along the same line, that is, the intermediate partition wall 62 is fully spread open, the intermediate partition wall 62 may rotate up to an angle of 180° in a clockwise direction and rotate up to an angle of 90° in a counterclockwise direction.

That is, in the state in which the upper partition wall 63 stands up, when the upper partition wall 63 rotates to an angle of about 180° in the clockwise direction, the shaking prevention ribs 612 and 625 may be inserted into the insertion slit 634, as shown in FIG. 27. On the other hand, in the state in which the upper partition wall 63 stands up, when the upper partition wall 63 rotates to an angle of about 90° in the counterclockwise direction, the rotation prevention rib 636 disposed on the lower end of the upper partition wall 63 may be hung on the second rotation prevention rib 624 disposed on the upper end of the intermediate partition wall 63, and thus, does not further rotate (see FIG. 34).

Also, in the state in which the upper partition wall 63 is folded and closely attached to the intermediate partition wall 62 and the lower partition wall 61, the fitting protrusion 635 may be inserted into a fitting groove (see reference numeral 201 of FIG. 30) defined in the top surface of the bottom 21 of the base 20. Thus, horizontal shaking of the partition wall 60 may be prevented.

Also, a support protrusion (see reference numeral 901 of FIG. 30) may protrude from an outer circumferential surface of the duct 90. The support protrusion 901 may serve as a stopper to prevent the partition wall 60 from rotating. This is done to prevent food disposed on or at a side of the partition wall 60 from pushing the partition wall 60 to allow the partition wall 60 to be inclined toward the container holder 50.

According to the folding or spreading operation of the lower, upper, and intermediate partition walls 61, 62, and 63, the partition wall 60 may perform a function to protect the container holder 50 or perform a function as a support on which other items may be placed. This will be described in detail with reference to the accompanying drawings.

Figure 30:
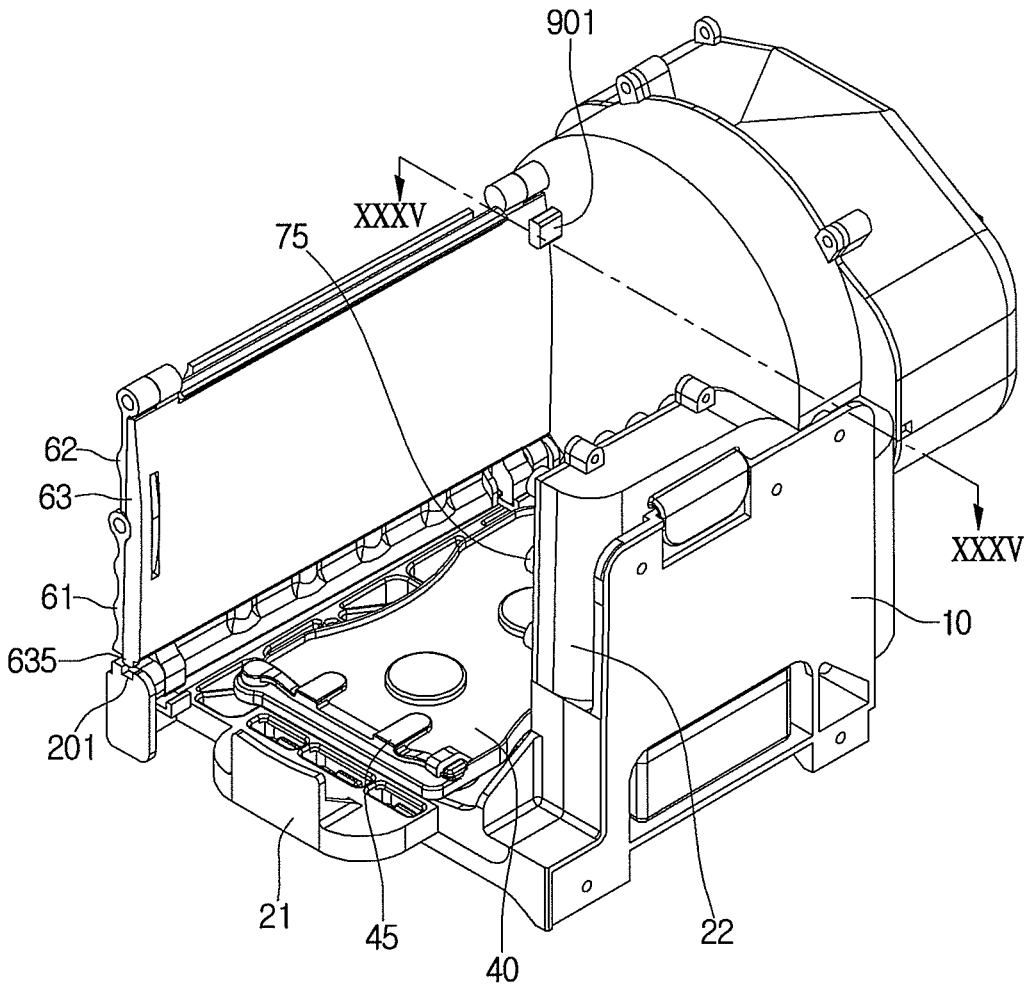
FIGS. 30 to 34 are views illustrating a manipulation process change the partition wall of FIG. 27 into a support to receive food or other items.

FIGS. 30 to 34 are views illustrating a manipulation process to change the partition wall into a support to receive food or other items. First, if quick cooling is not required, the container holder 50 may be separated, and the partition wall 60 may serve as a support to receive food or other items thereon. For this, as illustrated in FIG. 30, the partition wall 60 may be slightly lifted upward to separate the fitting protrusion 635, which may protrude from the upper partition wall 63, from the fitting groove 201. Thus, the partition wall 60 may be spread or rotatable.

Figure 31:
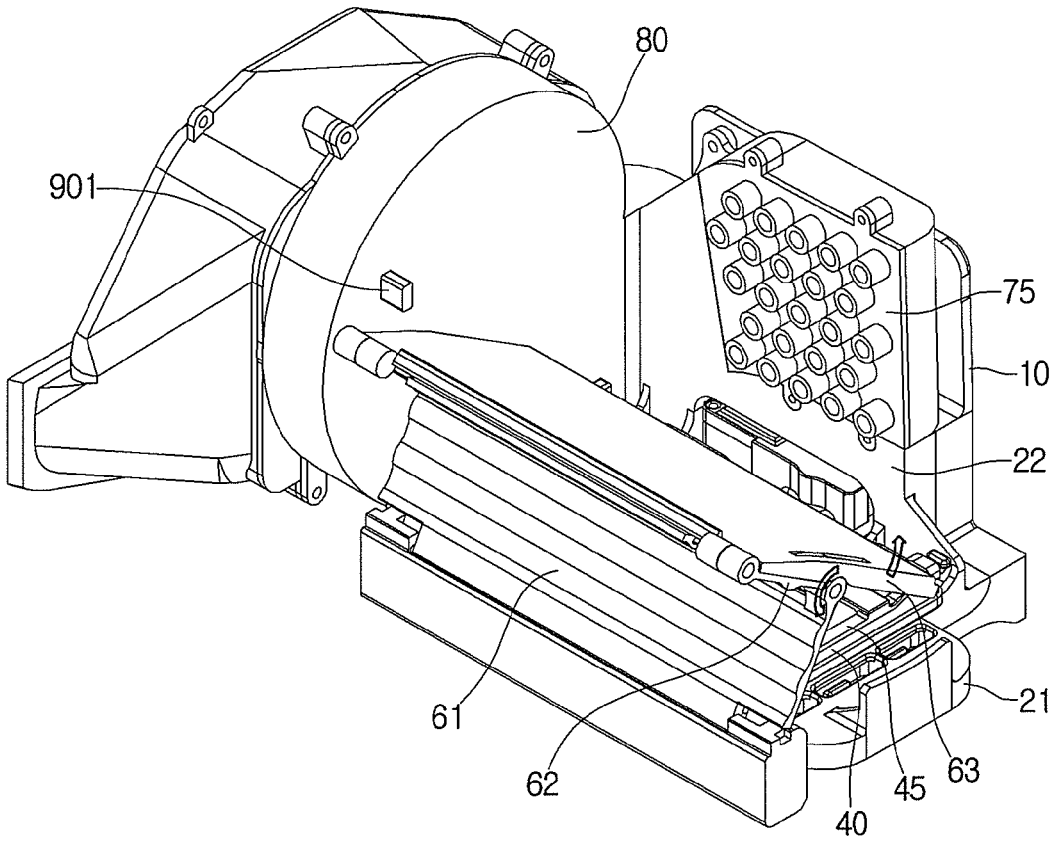
Figure 32:
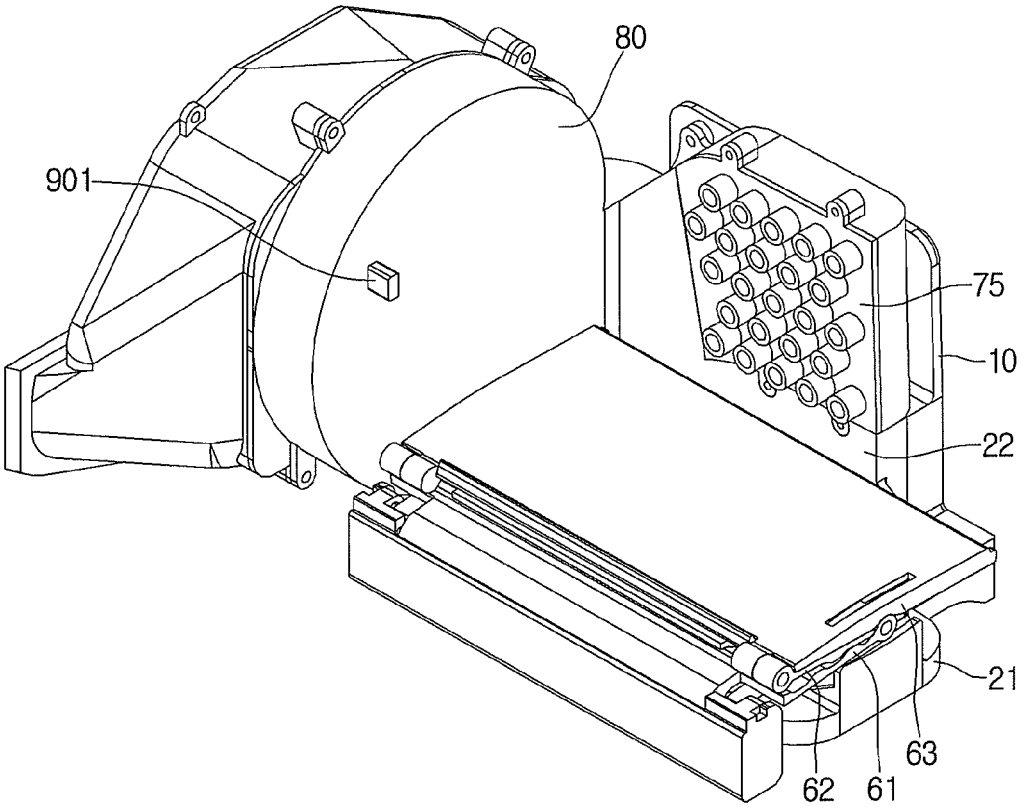

Then, as illustrated in FIG. 31, the intermediate partition wall 62 may rotate in the counterclockwise direction while the connection portion between the lower partition wall 61 and the intermediate partition wall 62 is pushed toward the agitation tray 40. When the connection portion is pushed to allow the intermediate partition wall 62 to rotate, the upper partition wall 63 may be manipulated so that the upper partition wall 63 does not interfere with the support protrusion 901. As described above, the intermediate partition wall 62 may rotate to fold the lower partition wall 61, the intermediate partition wall 62, and the upper partition wall 63 into a zigzag shape, as illustrated in FIG. 32, so as to be disposed on the agitation tray 40.

Figure 33:
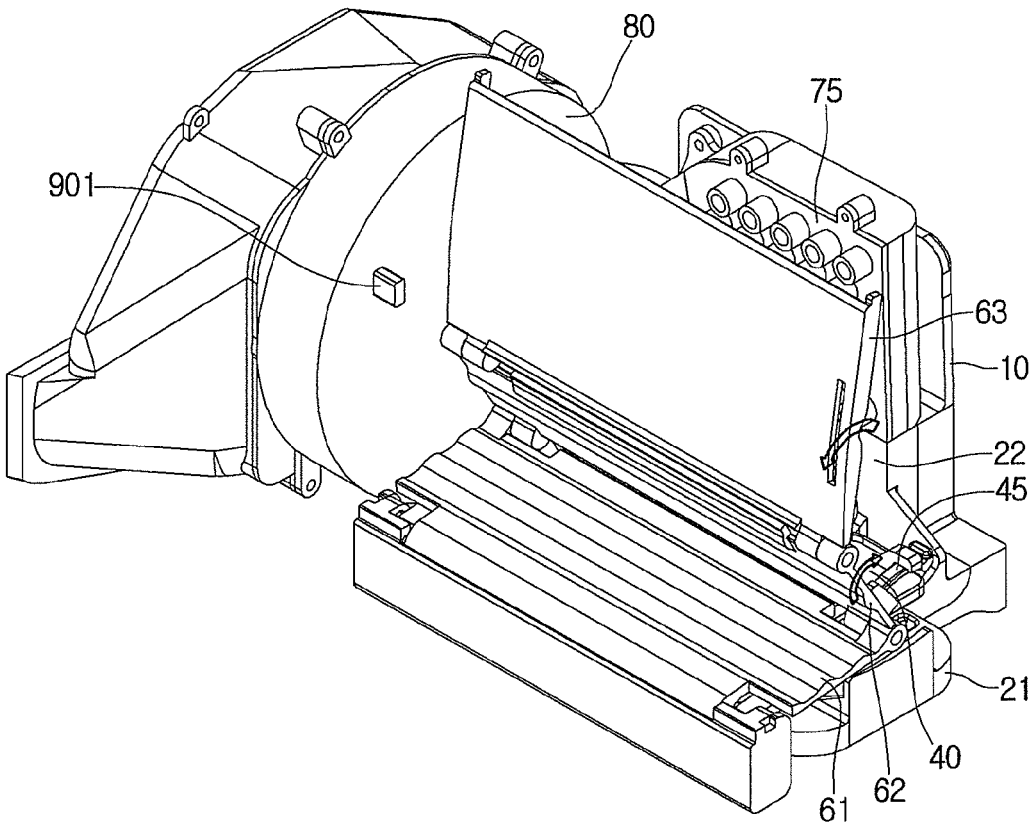

Then, as illustrated in FIG. 33, while a state in which the lower partition wall 61 is placed on the agitation tray 40 is maintained, the intermediate partition wall 62 may rotate in the clockwise direction and then be lifted. Meanwhile, the upper partition wall 63 may rotate in the counterclockwise direction, and then be lifted.

Figure 34:
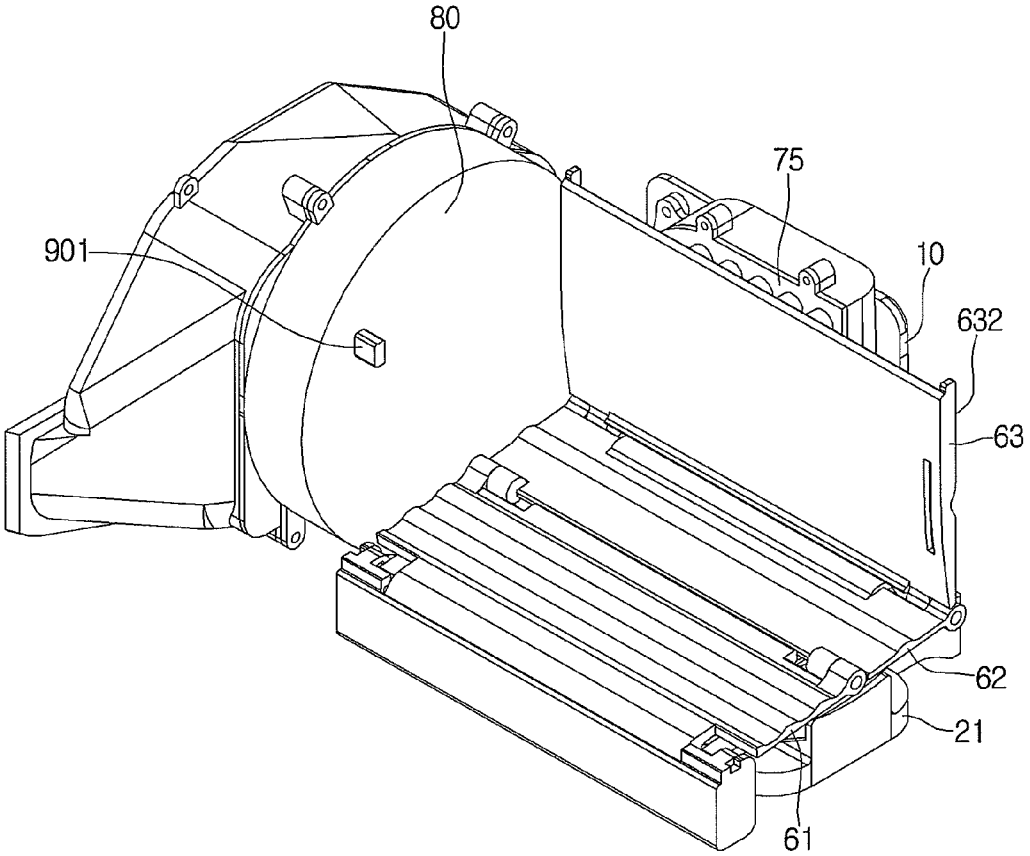

Also, as illustrated in FIG. 34, the intermediate partition wall 62 may rotate until the intermediate partition wall 62 is closely attached to the agitation tray 40 so that the lower partition wall 61 and the intermediate partition wall 62 are substantially parallel to each other. The upper partition wall 63 may be maintained in a standing-up state. Also, the upper partition wall 63 may be closely attached to the side surface 22 of the base 20. The upper partition wall 63 may be spaced a predetermined distance, for example, about 5 mm from the discharge grille 75. Thus, introduction of condensate water formed on a surface of the upper partition wall 63 into a discharge nozzle of the discharge grille 75 may be prevented to prevent the condensate water from being frozen between the upper partition wall 63 and the nozzle of the discharge grille 75.

Figure 35:
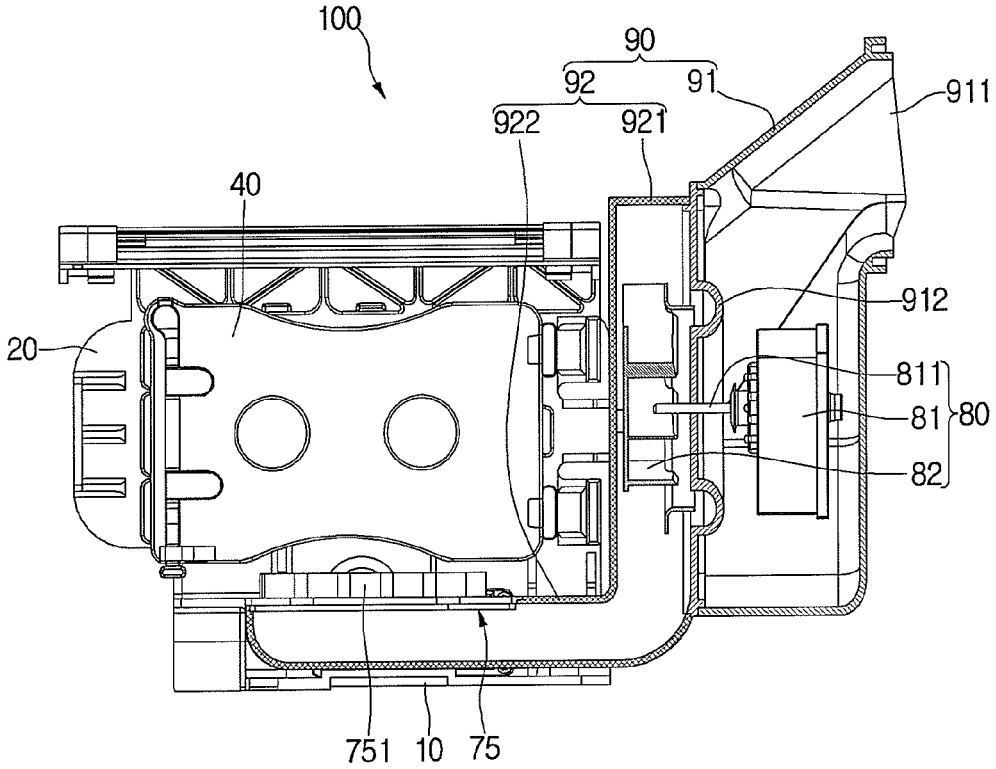
FIG. 35 is a cross-sectional view, taken along line XXXV-XXXV of FIG. 30.

FIG. 35 is a cross-sectional view, taken along line XXXV-XXXV of FIG. 30. Referring to FIG. 35, the blower 70 provided in the cooling apparatus 100 according to an embodiment may include fan 80 to suction in cool air within an evaporation chamber or the freezer compartment, duct 90 to guide the cool air provided by the fan 80 to the beverage container received in the container holder 50, and discharge grille 75 disposed on or at a discharge end of the duct 90.

The fan 80 may include a fan motor 81 including a motor shaft 811, and a blower fan 82 rotatably connected to the motor shaft 811. The blower fan 82 may include a centrifugal fan that suctions the cool air in a direction of a rotational axis thereof to discharge the cool air in a radial direction of the centrifugal fan.

The duct 90 may include a suction duct 91 to suction in the cool air within the evaporation chamber or the freezer compartment, and a discharge duct 92 connected to the suction duct 91 to guide the cool air toward the discharge grille 75. The fan motor 81 may be accommodated in the suction duct 91, and the blower fan 82 may be accommodated in an inlet of the discharge duct 92. A suction hole 911, through which the cool air may be suctioned in, may be defined in a lower portion of a back surface of the suction duct 91, and a shroud 912 to guide the cool air to the discharge duct 92 may disposed on a front portion of the suction duct 91.

The discharge duct 92 may be connected to a front surface of the suction duct 91. The discharge duct 92 may be bent in an L shape, as illustrated in the drawings, to guide the cool air toward the container holder 50. That is, the discharge duct 92 may be disposed at a rear side of the container holder 50. The discharge duct 92 may include a first portion 921 coupled to the front surface of the suction duct 91, and a second portion 922 bent from an end of the first portion 921 to extend toward the side surface of the container holder 50. A discharge hole may be defined in the second portion 922, and the discharge grille 75 may be mounted on the discharge hole. A plurality of discharge nozzles 751 may extend from the discharge grille 75. As the plurality of discharge nozzles 751 may be provided, the cool air flowing along the discharge duct 92 may be sprayed at a high speed to collide with the surface of the beverage container. The support protrusion 901 may protrude from an outer surface of the first portion 921.

The second portion 922 may be disposed on an upper end of the side surface 22 of the base 20. The suction duct 91 and the discharge duct 92 may be provided as separate members, and then, may be coupled to each other. Alternatively, the suction duct 91 and the discharge duct 92 may be injection-molded as a single body. The blower fan 82 may be accommodated in the first portion 921. Thus, the cool air discharged in the radial direction of the blower fan 82 may be guided to the second portion 922 along the first portion 921.

Figure 36:
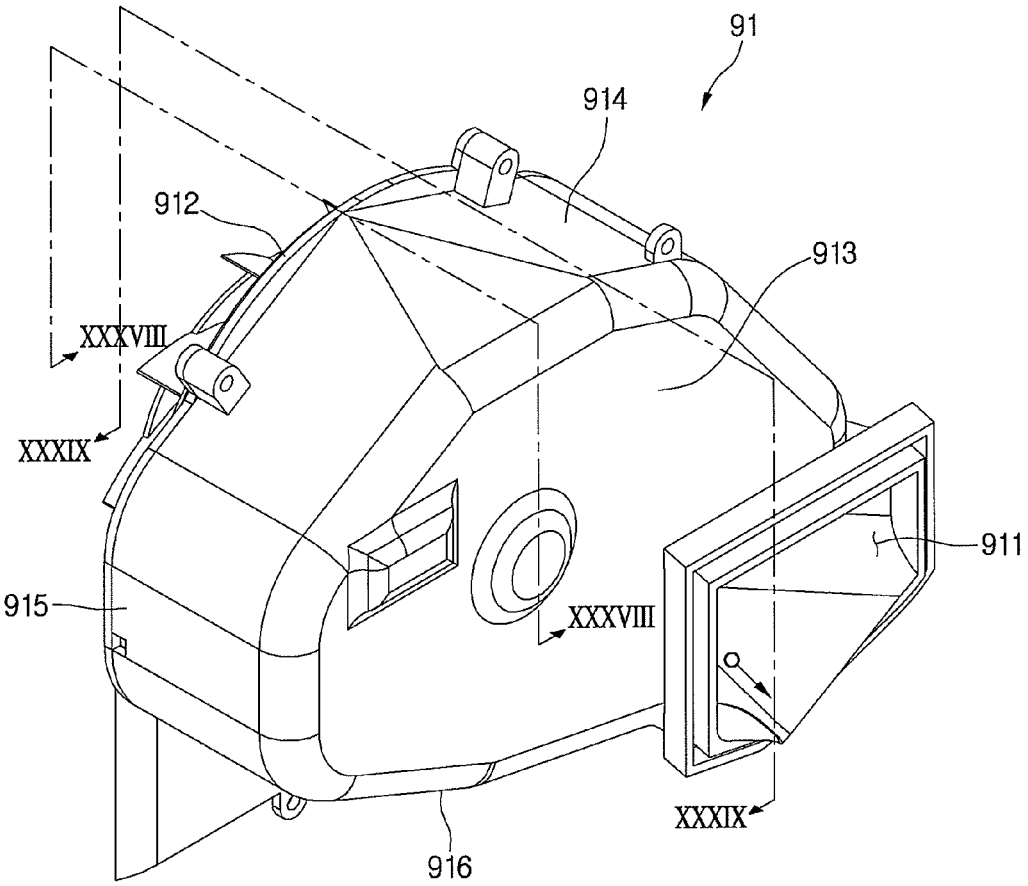
FIG. 36 is rear perspective view of a suction duct of a duct according to an embodiment.
Figure 37:
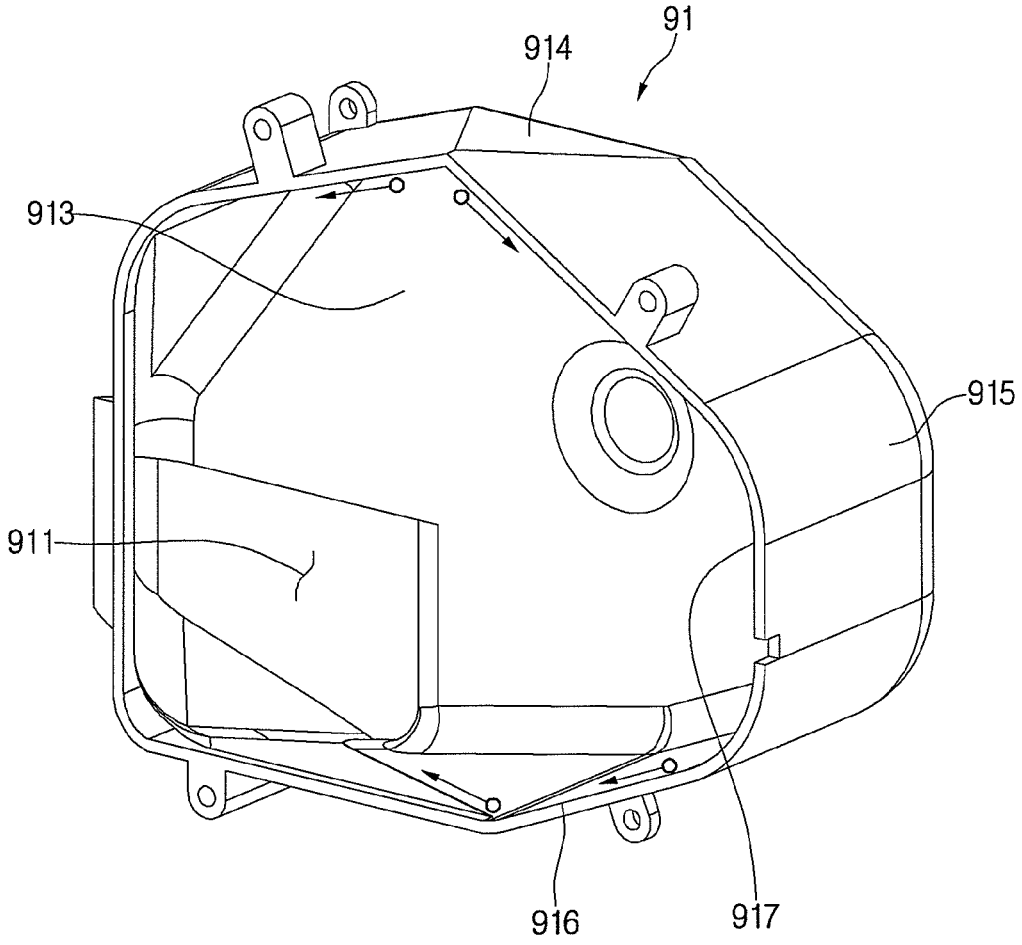
FIG. 37 is a front perspective view of the suction duct of FIG. 36, from which a shroud has been removed.

FIG. 36 is a rear perspective view of suction duct a duct according to an embodiment. FIG. 37 is a front perspective view of the suction duct of FIG. 36, from which a shroud has been removed.

Referring to FIGS. 36 and 37, the suction hole 911 to suction the cool air within the evaporation chamber may be defined in an edge of a lower end of a back surface of the suction duct 91. The suction duct 91 may include a front surface 917, on which the shroud 912 may be mounted, a back surface 913, in which the suction hole 911 may be defined, and a circumferential portion bent from an edge of the back surface 913 to extend toward the front surface 917. The circumferential portion may include a side surface 915, a top surface 914, and a bottom surface 916. A point at which the top surface 914, the side surface 915, and the bottom surface 916 meet each other may be smoothly curved at a predetermined curvature. The top surface 914 may be gradually inclined downward toward a rear side and an edge of a lateral side. Thus, condensate water formed on a surface of an inside of the top surface 914 may flow toward the side surface 915 and the back surface 913. In addition, as the top surface 914 and the side surface 915 are smoothly rounded, condensate water formed on a portion at which the top surface 914 and the side surface 915 meet each other may flow down along the side surface 915.

A cover (see reference numeral 911*a* of FIG. 39) may be rotatably mounted on the suction hole 911 to prevent hot air from being introduced into the suction hole 911 during a defrosting process. For example, the cover 911*a* may have a shape corresponding to a shape of the suction hole 911 and may be rotatably connected to an edge of an upper portion of the suction hole 911. A rotational shaft of the cover 911*a* may be automatically rotated by electrical control or mechanical control depending on a control signal.

Due to the above-described structure, when the defrosting process starts, the cover 911*a* may be rotated by a control signal to cover the suction hole 911. Then, when the defrosting process is finished, the cover 911*a* may be reversely rotated to open the suction hole 911. Alternatively, the cover 911*a* may be rotated by the cool air suctioned through the suction hole 911 to open the suction hole 911 without using a separate drive member. Also, when the cool air is not suctioned, the cover 911*a* may rotate due to self-weight thereof to cover the suction hole 911.

Figure 38:
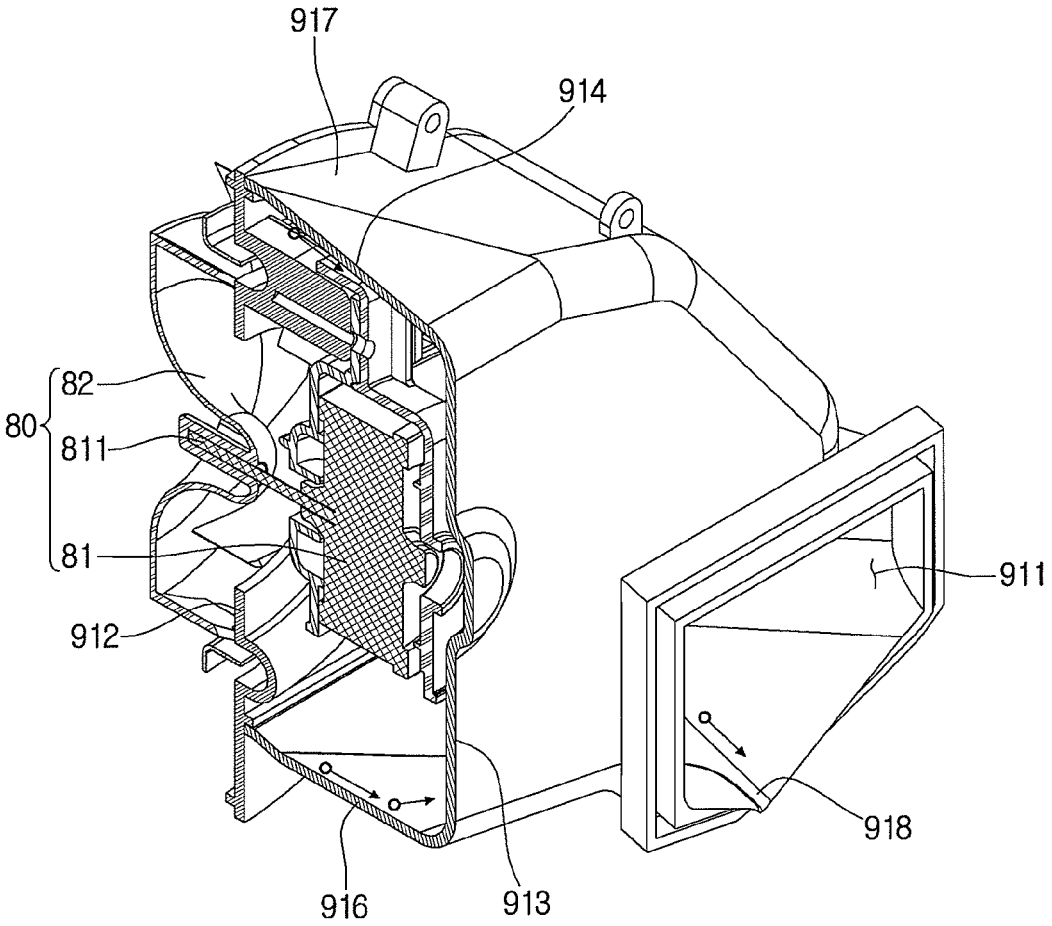
FIG. 38 is a longitudinal cross-sectional view, taken along line XXXVIII-XXXVIII of FIG. 36.
Figure 39:
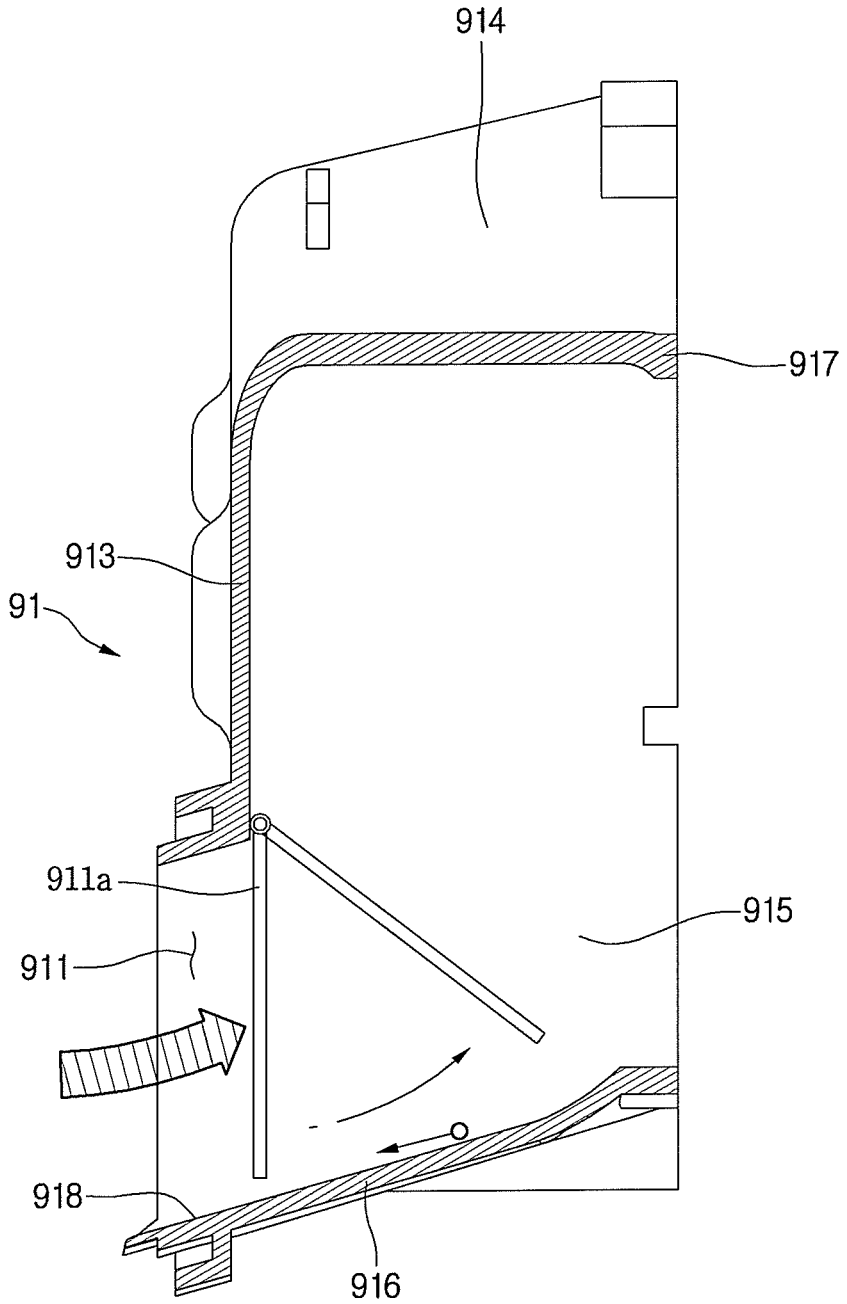
FIG. 39 is a longitudinal cross-sectional view, taken along line XXXIX-XXXIX of FIG. 36.

FIG. 38 is a longitudinal cross-sectional view, taken along line XXXVIII-XVIII of FIG. 36. FIG. 39 is a longitudinal cross-sectional view, taken along line XXXIX-XXXIX of FIG. 36.

Referring to FIG. 38, the top surface 914 may be gradually inclined downward toward the back surface 913, and a boundary portion between the top surface 914 and the back surface 913 may be smoothly curved at a predetermined curvature. Thus, condensate water formed on a surface of the top surface 914 may flow toward the back surface 913, and then, may continuously flow up to the bottom surface 916 along a surface of the back surface 913. Also, the bottom surface 916 may be designed so that the bottom surface 916 is gradually inclined downward toward the suction hole 911, and condensate water dropping onto the bottom surface 916 may flow toward the suction hole 911.

A bottom of the suction hole 911 may be gradually inclined downward from edges of both side surfaces thereof toward a central portion to form a drain 918. Thus, condensate water formed on an inside of the suction duct 91 may flow toward the evaporation chamber along the drain 918. The condensate water flowing toward the evaporation chamber may be collected into a drain pan (not shown), and then, may be disposed of.

Referring to FIG. 39, the bottom surface 916 may be gradually inclined from the front surface 917 toward the back surface 913. That is, the bottom surface 916 may be gradually inclined downward from a portion at which the shroud 912 is mounted toward the suction hole 911 to allow all condensate water to flow toward the suction hole 911.

As described above, to allow condensate water formed on the inside of the suction duct 91 to flow toward the suction hole 911, the suction duct 91 may be designed so that a horizontally extending portion thereof is gradually inclined downward toward lateral edges and a rear side.

Figure 40:
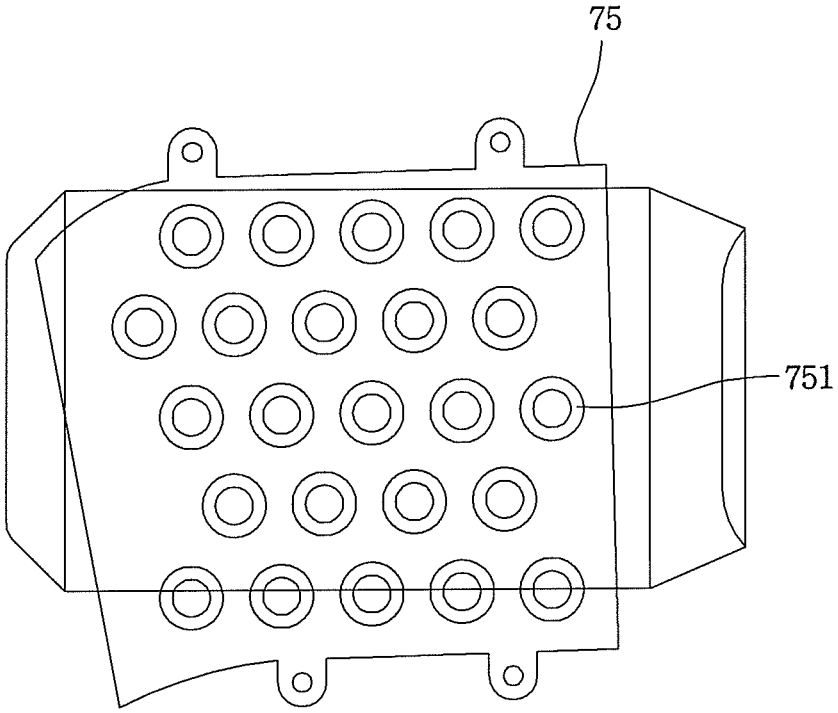
FIGS. 40 and 41 are views illustrating a positional relationship between a mounted beverage container(s) and a discharge grille according to an embodiment.
Figure 41:
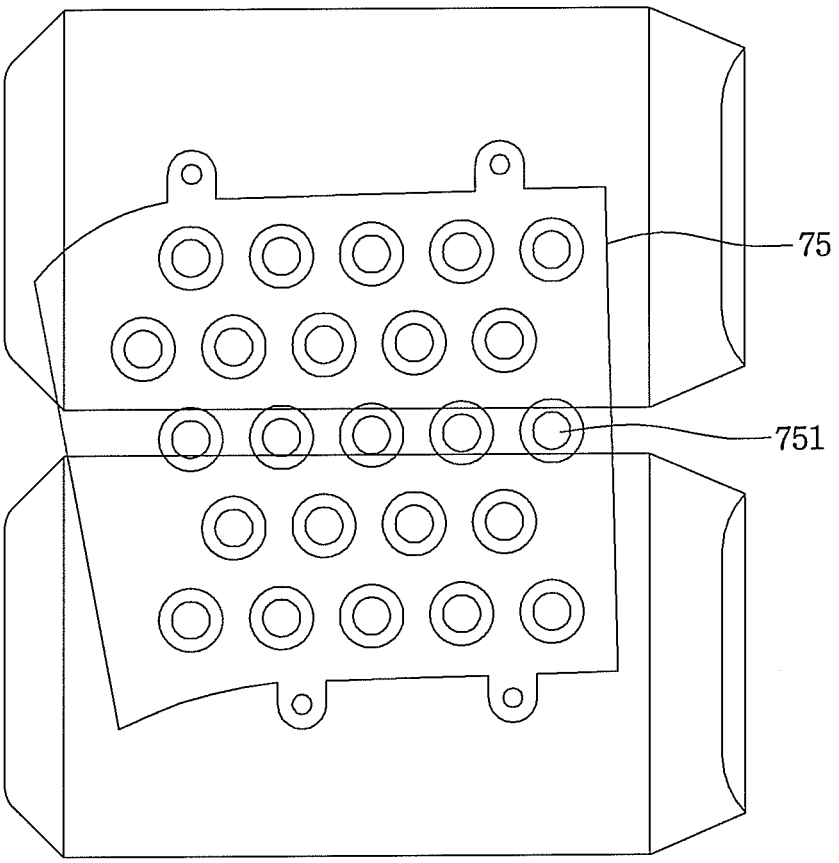

FIGS. 40 and 41 are views illustrating a positional relationship between a mounted beverage container(s) and a discharge grille according to an embodiment. Referring to FIGS. 40 and 41, the plurality of discharge nozzles 751 may be arranged in a matrix shape on the discharge grille 75. A plurality of discharge nozzle sets may be vertically disposed on the discharge grille 75. Each of the plurality of discharge nozzle sets may include the plurality of nozzles 751 arranged to be spaced a predetermined distance from each other in a horizontal direction.

That is, the plurality of discharge nozzles 751 may be arranged in the longitudinal direction of the beverage container and a stacked direction of the beverage containers to uniformly spray cool air onto the beverage containers. For example, one discharge nozzle set may include about four to five discharge nozzles 751, and the discharge grille 75 may include about four to five discharge nozzle sets. However, embodiments are not limited to the number of discharge nozzle sets and the number of discharge nozzles provided in each discharge nozzle set.

Also, the plurality of discharge nozzles 751 may be dislocated with respect to each other in a vertical direction. That is, the discharge nozzles 751 may be vertically disposed in a zigzag shape. For example, the discharge nozzles provided in a lower discharge nozzle set may be disposed to correspond to a space between the discharge nozzles provided in an upper discharge nozzle set. A distance between the discharge nozzles provided in each row of the discharge nozzles may be the same.

As illustrated in FIG. 40, in a state in which one beverage container is received into the second receiving portion 514 of the container holder 50, all of the plurality of discharge nozzles 751 may spray the cool air toward the beverage container. As illustrated in FIG. 41, in a state in which two beverage containers are respectively received into the first and third receiving portions 513 and 515 of the container holder 50, the number of discharge nozzles 751 spraying the cool air onto the beverage container received in the first receiving portion 513 and the number of discharge nozzles 751 spraying the cool air onto the beverage container received in the third receiving portion 515 may be equal or similar to each other. That is, when two beverage containers are received, the cool air may be uniformly sprayed onto the two beverage containers.

According to embodiments, discharge nozzle sets may be correspondingly provided with a same number as the plurality of received beverage containers. In this embodiment, two rows of discharge nozzle sets may be disposed to correspond to each of the beverage containers received in the first and second receiving portions 513 and 515.

Figure 42:
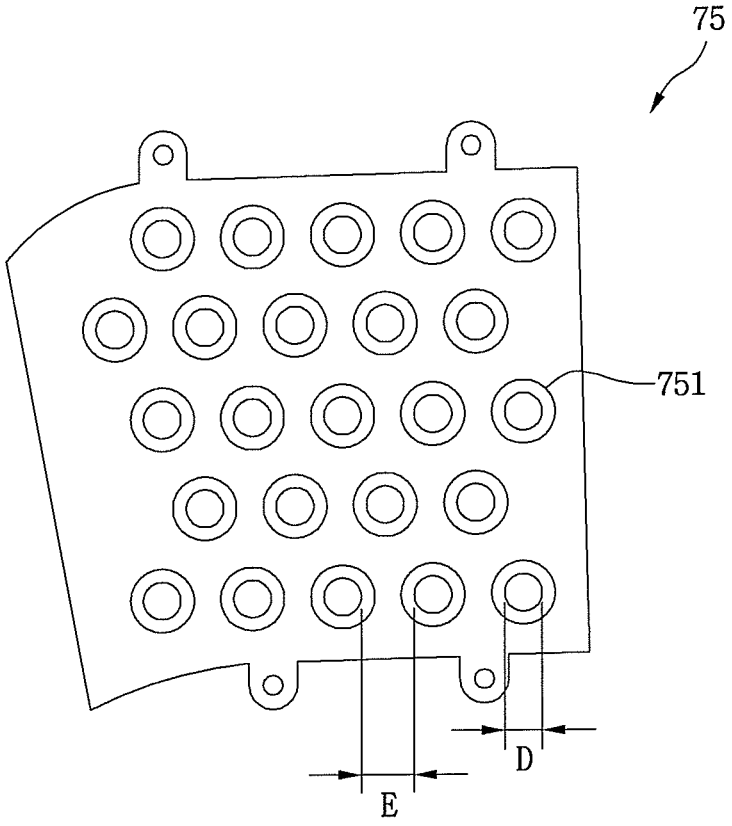
FIG. 42 is a front view of the discharge grille of FIGS. 40-41.

FIG. 42 is a front view of the discharge grille of FIGS. 40-41. Referring to FIG. 42, the discharge grille 75 according to an embodiment may include a plurality of discharge nozzle sets disposed to be spaced a predetermined distance from each other in a vertical direction. Each of the discharge nozzle sets may include a plurality of discharge nozzles 751 disposed to be spaced a predetermined distance from each other in a horizontal direction.

As described above, the plurality of discharge nozzles 751 vertically adjacent to each other may be dislocated with respect to each other in a zigzag shape. However, embodiments are not limited thereto. For example, the plurality of discharge nozzles 751 may be vertically disposed on a same line.

A distance E between the discharge nozzles 751 adjacent to each other may be about one or two times a diameter D of each of the discharge nozzles 751. In detail, the larger the number of discharge nozzles 751, the more the cool air may be uniformly sprayed onto a surface to be cooled, and thus, uniform heat transfer efficiency may be obtained. However, if too many discharge nozzles are provided in a fixed area with a decreased distance between discharge nozzles, the cool air sprayed from the nozzles adjacent to each other may interfere with each other reducing cooling efficiency. With the distance E between discharge nozzles adjacent to each other corresponding to about one or two times the diameter D of each of the discharge nozzles, it is seen through a test that interference between the cool air sprayed from the discharge nozzles may be minimized. That is, the distance E between the discharge nozzles may be about one and a half times the diameter D of the discharge nozzles.

Figure 43:
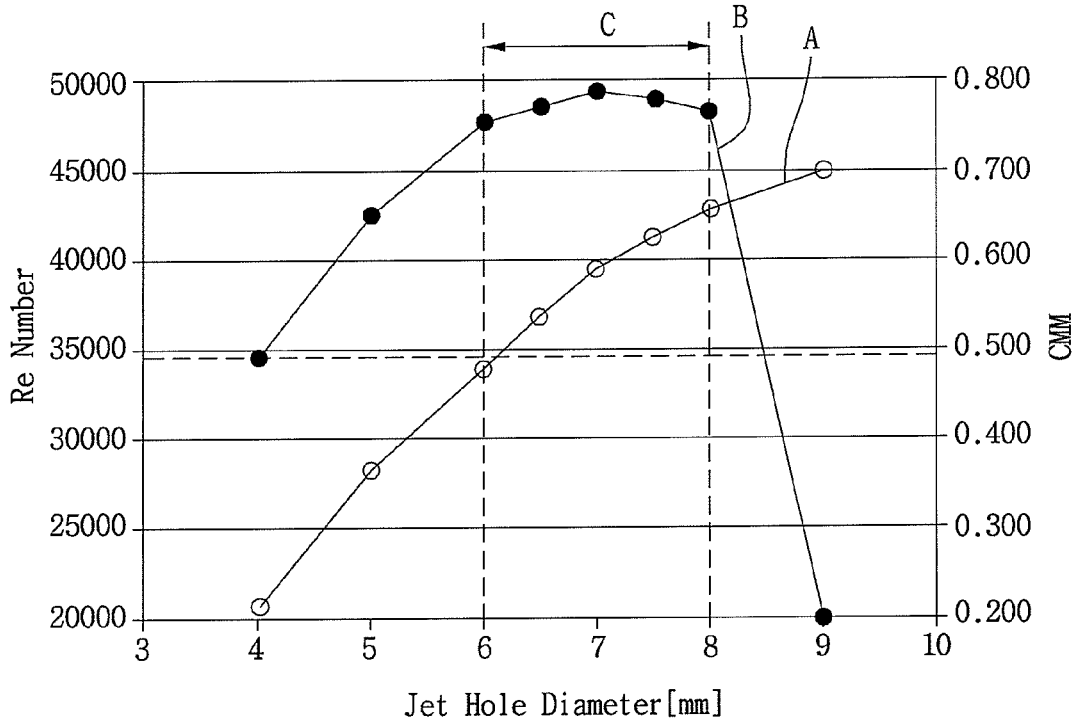
FIG. 43 is a graph illustrating a relationship between a diameter of a discharge nozzle provided in the discharge grille of FIGS. 40-41 and a flow amount of cool air sprayed through the discharge nozzle according to an embodiment.

FIG. 43 is a graph illustrating a relationship between a diameter of the discharge nozzle provided in the discharge grille of FIGS. 40-41 and a flow amount of cool air sprayed through the discharge nozzle according to an embodiment. Referring to FIG. 43, a horizontal axis may represent a diameter D of a discharge nozzle 751, and a first vertical axis may represent discharge intensity. Also, a second vertical axis may represent a flow rate or wind amount of cool air sprayed through the discharge nozzle 751. Also, graph A may represent a cool air flow rate graph according to the diameter of the nozzle, and graph B may represent a discharge intensity graph according to the diameter of the nozzle.

In detail, the discharge intensity may be expressed as a Reynold's number (Re). The working fluid may be air. The discharge intensity of the cool air under the above-described conditions may be expressed as the following equation:

$$Re = \frac{\rho V D}{\mu}$$

ρ: Density of air,

μ: Viscosity of air,

D: Diameter of discharge nozzle,

V: Rate of cool air sprayed from discharge nozzle.

A spraying velocity V of the cool air may be determined according to the diameter and number of discharge nozzle 751 under constant blowing performance of the fan.

As illustrated in FIG. 43, when the discharge intensity of the cool air and the cool air flow rate are integrated, it is seen that, when the diameter of the discharge nozzle 751 is within a range of a section C, cooling efficiency is best. Thus, the diameter D of the discharge nozzle 751 may range from about 6 mm to about 8 mm, more particularly, about 6.5 mm to about 7.5 mm, and more particularly, about 7 mm.

The greater the diameter of the discharge nozzle 751, the more an amount of discharged cool air increases. However, if there are too many discharge nozzles 751, or the diameter is too large, the cool air discharge intensity which represents cool air spraying pressure may be reduced deteriorating heat-exchange efficiency.

Figure 44:
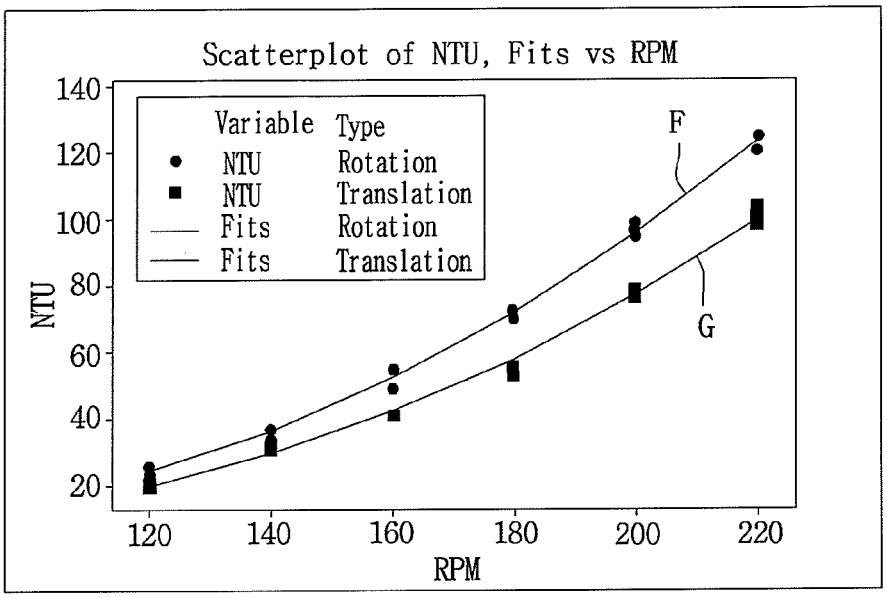
FIG. 44 is a comparison graph illustrating agitation performance depending on an agitating motion configuration.

FIG. 44 is a comparison graph illustrating agitation performance depending on an agitating motion configuration. Referring to FIG. 44, a horizontal axis of this graph may represent an agitation cycle, and a vertical axis may represent agitation intensity. Graph F shows results obtained when an agitation tray 40 performs an agitating motion which is a type of reciprocating motion in a lateral direction, and graph G shows results obtained when the agitation tray 40 performs an agitating motion which is a type of rotating motion, as described above.

The agitation cycle may be defined as a RPM of an agitation motor, and the agitation intensity may be defined as anepthelometric turbidity unit (NTU). In limited conditions, agitation-available amplitude may range from about 5 mm to about 10 mm, and a maximum cycle of the agitation motor may be about 220 RPM. An agitation performance evaluation test was performed in a state in which two beverage containers were stacked in the first and third receiving portions 513 and 515.

According to the test results under the above-described conditions, in the case of the container holder 50 in which the beverage containers were vertically stacked on each other according to embodiments, it is seen that agitation performance improves when the agitation tray 40 rotates in one direction to agitate the beverage containers in comparison to when the agitation tray 40 is linearly reciprocated in a direction perpendicular to a longitudinal direction of each of the received beverage containers to agitate the beverage containers. The rotation motion in one direction may represent a motion in which the container holder makes a revolution with respect to a vertical axis as described above, but the beverage containers do not rotate.

Also, a difference in agitation performance will be described as follows.

First, in the case of the linear reciprocating motion, liquid may be agitated through a swing motion in a left/right or lateral direction along a circumferential surface of the beverage container.

Second, in the case where the agitation tray makes a revolution with respect to the vertical axis, liquid may be swung in the left/right or lateral direction along the circumferential surface of the beverage container as wall as may perform a rotation motion in which the liquid collides with front and rear surfaces of the beverage container while moving in the longitudinal direction of the beverage container to change the moving direction.

Thus, it is seen that the liquid is more actively agitated during the agitating motion which makes the revolution with respect to the vertical axis than the agitating motion which is linearly reciprocated. However, the agitation performance according to the two agitation motions may be superior to that according to the conventional swing motion or the motion in which the beverage container rotates.

Figure 45:
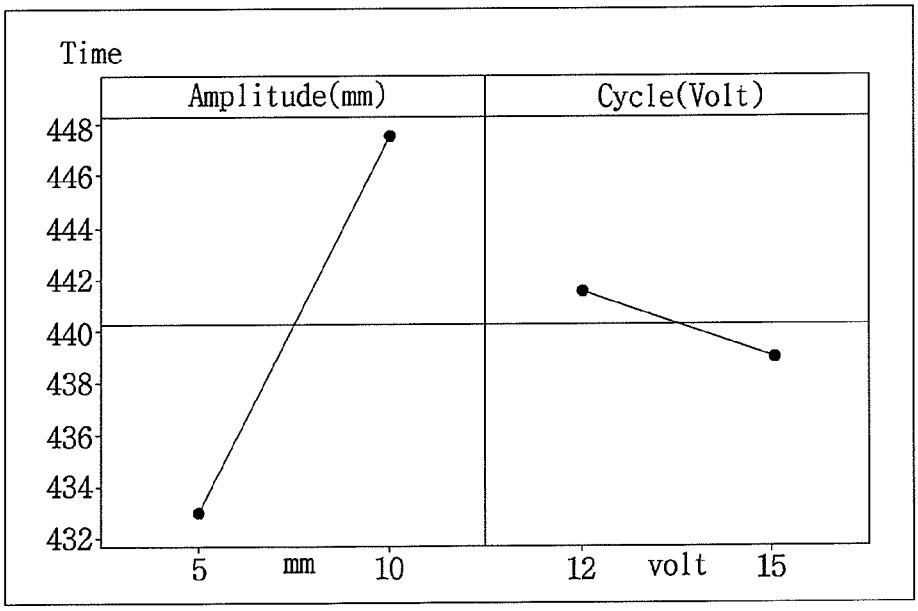
FIG. 45 is a graph illustrating a relationship between amplitude and agitation cycle of the agitation tray and cooling time according to embodiments.

FIG. 45 is a graph illustrating a relationship between amplitude and agitation cycle of the agitation tray and cooling time according to an embodiment. Referring to FIG. 45, under conditions such as a discharge nozzle diameter of about 6.5 mm and a cool air temperature of about −15° C., a cooling performance design of experiment (DOE) was performed while an input voltage to drive a fan and amplitude were respectively changed to a voltage of about 12 V to about 15V and an amplitude of about ±5 mm to about ±10 mm. As the agitation cycle (RPM) is proportional to the input voltage to drive the fan, a unit of the agitation cycle may be defined as a voltage V.

According to the test results, it is seen that agitation performance improves when amplitude and cycle of the agitation tray 40 increase. In the case of the cooling apparatus according to embodiments, when the agitation starts, an operation in which a distance between the discharge nozzle 751 and the beverage container increases and decreases may be repeatedly performed. In this case, a heat transfer effect may slightly decrease in a section in which the discharge nozzle 751 is away from the beverage container. Thus, if the amplitude increases, the distance between the discharge nozzle 751 and the beverage container may increase, reducing heat transfer effect and a cooling time.

Also, if the amplitude decreases, inertia of the beverage container may increase. Thus, as a moving path increases, the agitation cycle may decrease.

According to the cooling time depending on the amplitude and agitation cycle, it is seen that the cool time decreases when the amplitude decreases, and the agitation cycle (RPM) increases.

According to the results obtained through several tests, in consideration of agitation performance and cooling time, it is seen that values for the agitation performance and cooling time are suitable when the amplitude ranges from about 5 mm to about 8 mm, and the agitation cycle (RPM) may range from about 12 V to about 15 V, more particularly, about 13 V.

A minimum distance between the agitation tray 40 and the discharge nozzle 751, that is, a distance when the agitation tray 40 is close to the discharge nozzle 751 is greater than the nozzle diameter D. Thus, the distance may be four times greater than the nozzle diameter D. If the distance is exceeded, the heat-exchange efficiency with the cool air sprayed from the discharge nozzle 751 may be reduced.

Figure 46:
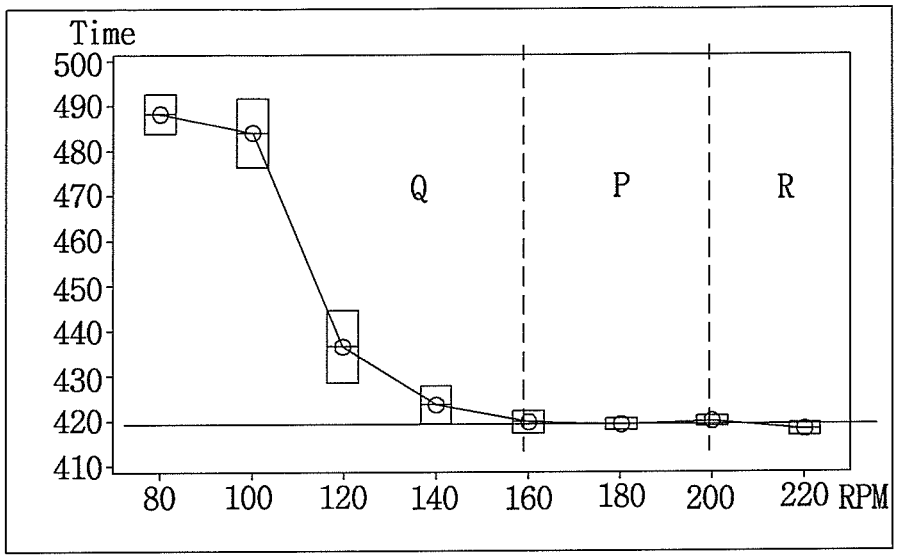
FIG. 46 is a graph illustrating a relationship between agitation cycle and cooling time in the cooling apparatus according to embodiments.

FIG. 46 is a graph illustrating a relationship between agitation cycle and cooling time in the cooling apparatus according to embodiments. Referring to FIG. 46, in a state in which about 335 ml of one beverage container is mounted under a condition of an agitation amplitude of about 5 mm, a change in cooling time is observed through a test while an agitation cycle increases.

According to test results, it is seen that the cooling time decreases when the agitation cycle (RPM) increases. In detail, it was confirmed that a cooling time graph according to agitation cycle is largely divided into three sections. That is, the cooling time graph may be divided into a cooling delay section Q, an agitation-stable section P, and a holding-unstable section R.

The cooling delay section Q may represent a section in which cooling time significantly increases as the agitation cycle decreases, and the holding-unstable section R may represent a section in which a held state of the beverage is unstable as the agitation cycle increases. In a case of the cooling apparatus according to embodiments, as the container holder 50 in which a plurality of beverage containers are vertically stacked on each other is used, a center of gravity of the container holder 50 may be higher. Thus, if the agitation cycle of the agitation tray 40 excessively increases, the container holder 50 may be inverted laterally during agitation without causing a difference in cooling time.

Thus, the reasonable agitation cycle may range from about 120 rpm to about 220 rpm, more particularly, about 160 rpm to about 200 rpm in a state in which one beverage container is mounted. When the number of beverage container increases to two, it is seen that increase in number of beverage containers has less influence on the agitation cycle.

Figure 47:
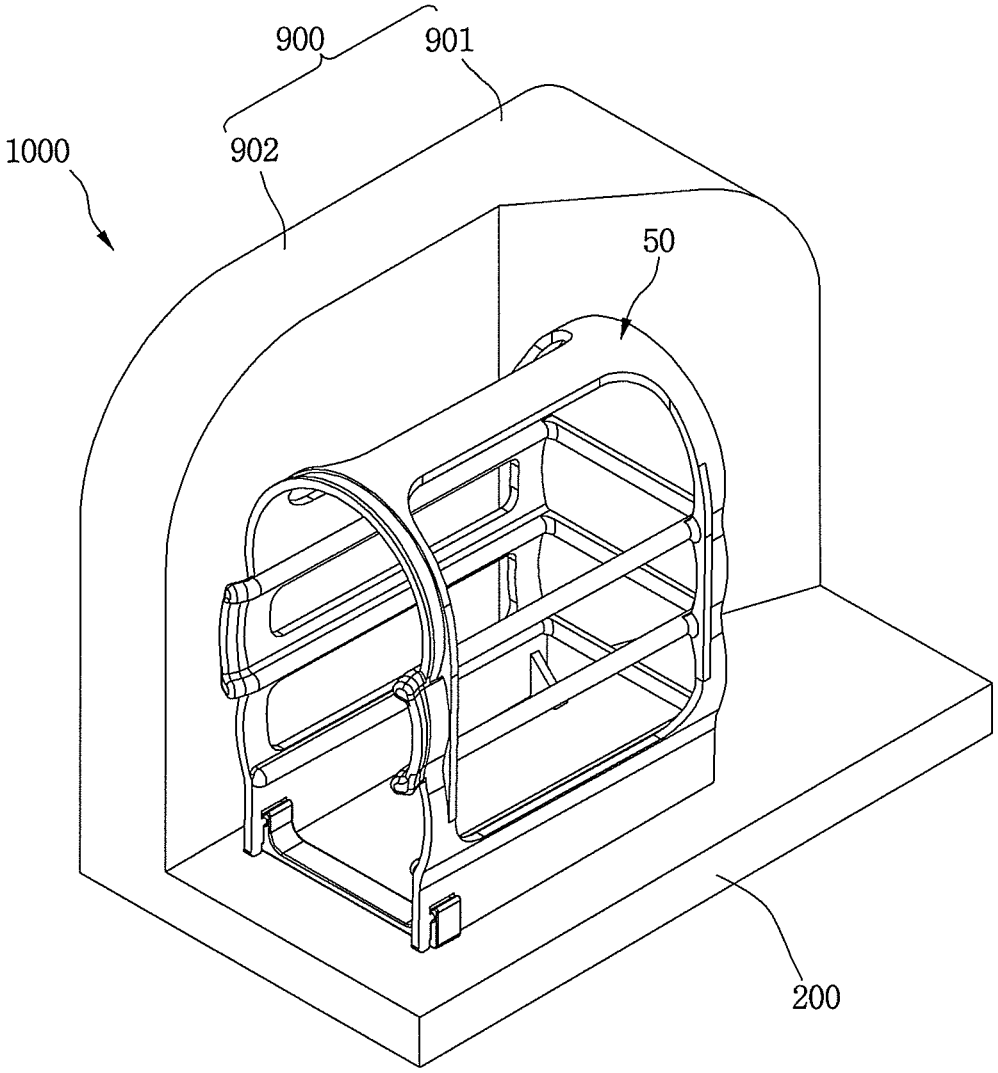
FIG. 47 is a front perspective view of a cooling apparatus according to another embodiment.
Figure 48:
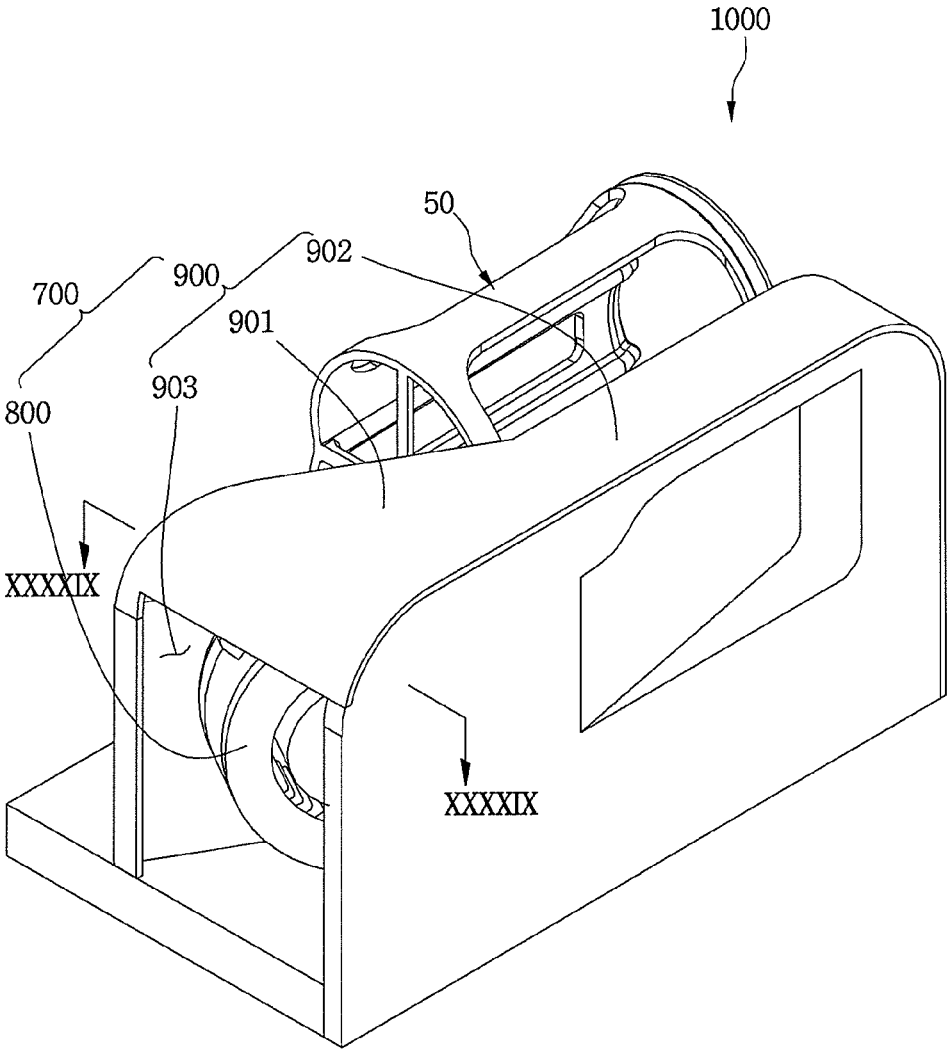
FIG. 48 is a rear perspective view of the cooling apparatus of FIG. 47.
Figure 49:
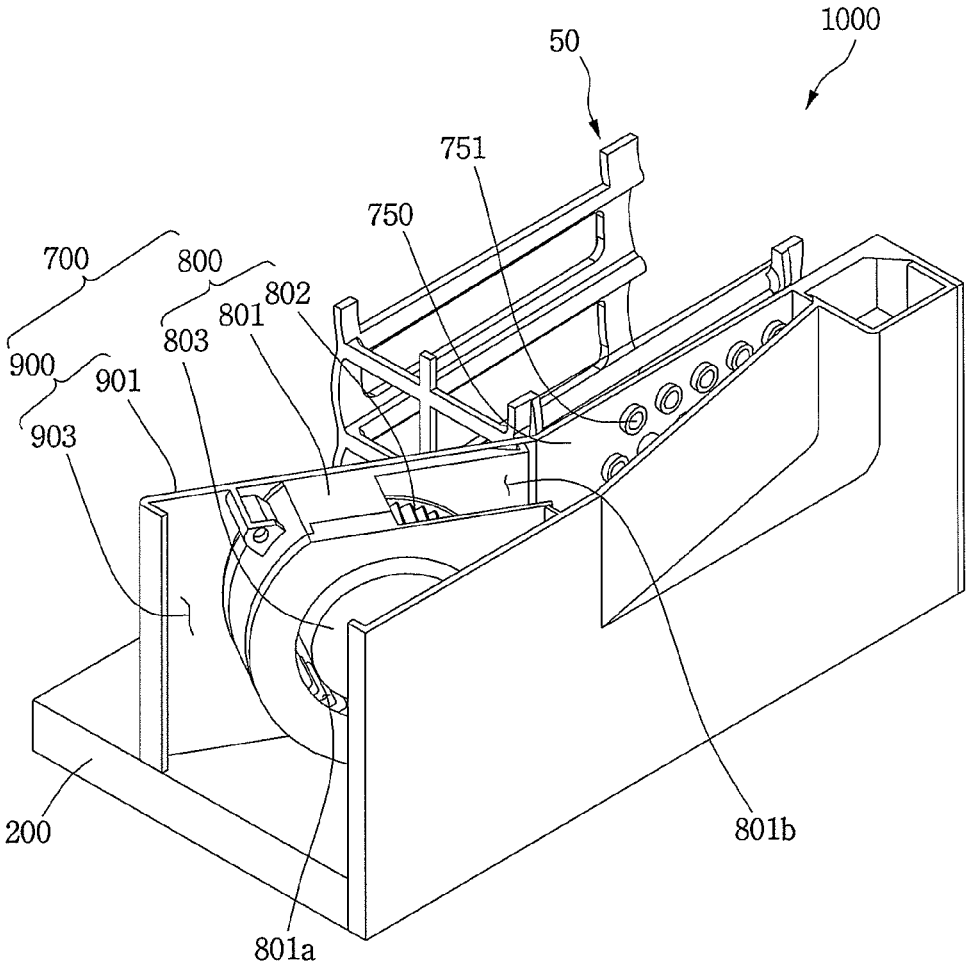
FIG. 49 is a cross-sectional view, taken along line XXXXIX-XXXXIX of FIG. 48.
Figure 50:
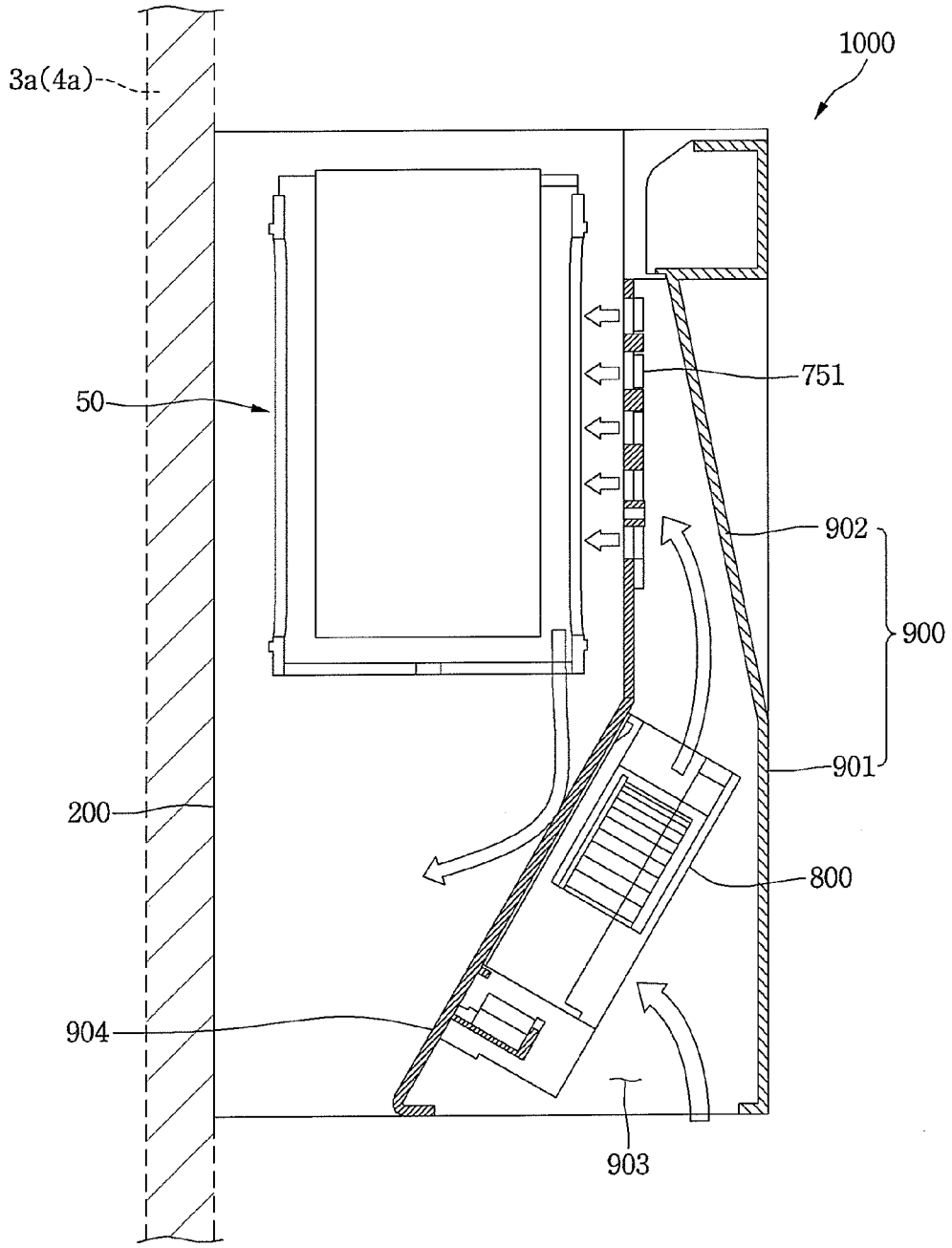
FIG. 50 is a plan view of the cooling apparatus of FIG. 47, when viewed in a state of FIG. 48.

FIG. 47 is a front perspective view of a cooling apparatus according to another embodiment. FIG. 48 is a rear perspective view of the cooling apparatus of FIG. 47. FIG. 49 is a cross-sectional view taken along line XXXXIX-XXXXIX of FIG. 48. FIG. 50 is a plan view of the cooling apparatus of FIG. 47, when viewed in a state of FIG. 48.

Referring to FIGS. 47 to 50, a cooling apparatus 1000 according to another embodiment may utilize the container holder 50 according to the previous embodiment, and may be similar to the previous embodiments except for a blower 700 having a different shape. The cooling apparatus 1000 according to this embodiment may include a base 200, container holder 50 separably mounted on a top surface of the base 200, a duct 900 that extends upward from each of edges of a side surface of the base 200, and a fan 800 accommodated into the duct 900. The duct 900 and the fan 800 may be defined as blower module 700.

In detail, the duct 900 may include a suction duct 901, in which the fan 800 may be accommodated, and a discharge duct 902 that extends from the suction duct 901. The suction duct 901 and the discharge duct 902 may be integrated as one body. Alternatively, the suction duct 901 and the discharge duct 902 may be connected to each other through a separate component. A suction hole 903 may be defined in a side of the suction duct 901.

A side surface of the cooling apparatus 1000 may include a first side surface, on which the suction duct 901 and the discharge duct 902 may be positioned, and a second side surface disposed opposite to the first side surface. When the cooling apparatus 1000 is mounted in a freezer compartment, the second side surface may approach or be closely attached to a side surface of the freezer compartment, and the suction and discharge ducts 901 and 902 may face the side surface of the freezer compartment. Due to the above-described mounting structure, other food or containers received in a side of the cooling apparatus 1000 may be blocked by the suction and discharge ducts 901 and 902 to prevent the food or containers from interfering with the container holder 50. Partition wall 60 according to the previous embodiment may not be separately required.

Of course, in a case of the cooling apparatus 1000 according to this embodiment, the duct 900 may be disposed on the side surface on which the partition wall 60 is disposed to remove the partition wall 60. Also, when the cooling apparatus 1000 is mounted on a freezer compartment door, the second side surface may approach or be closely attached to a back surface of the freezer compartment door.

The discharge duct 902 may extend along the side surface of the container holder 50, and a discharge grille 750 may be mounted on or at a side of the discharge duct 902. The discharge grille 750 may be the same as the discharge grille 75 according to the previous embodiment, and a plurality of discharge nozzles 751 may be provided in the discharge grille 750.

The suction duct 901 may have a width that gradually decreases toward the discharge duct 902, and a rear surface of the discharge duct 902 may be inclined. In detail, the suction duct 901 may include a guide surface 904 having a width that gradually decreases toward the discharge duct 902. Also, the fan 800 may be mounted on an inner side surface of the guide surface 904.

As a rear surface of the discharge duct 902 may be inclined, the discharge duct 902 may have a width that gradually decreases from a point at which the suction duct 901 and the discharge duct 902 meet each other toward a trailing end of the discharge duct 902. That is, although an amount of cool air decreases toward the trailing end of the discharge duct 902, as the discharge duct 902 may have the gradually decreasing width, as discharge pressure may be uniformly maintained at starting and ending portions of the discharge duct 902. In addition, as the rear surface of the discharge duct 902 is inclined in a forward direction, cool air supplied from the suction duct 901 may be smoothly guided toward the discharge grille 750.

The fan 800 may include a fan housing 801 having a suction hole 801*a* and a discharge hole 801*b*, a blower fan 802 accommodated in the fan housing 801, and a fan motor 803 to drive the blower fan 802. The blower fan 802 may be a centrifugal fan or a turbo fan. Of course, the blower fan 802 may be a tangential fan or axial-flow fan. However, the centrifugal fan or turbo fan may be further advantageous so as to minimize a thickness of the suction duct 901.

Referring to FIG. 50, the cool air within the freezer compartment or evaporation chamber, which may be suctioned through the suction hole 903 of the suction duct 901, may be suctioned into the fan housing 801 through the suction hole 801*a* of the fan housing 801. The cool air may be discharged into the discharge duct 902 through the discharge hole 801*b*, and the cool air discharged into the discharge duct 902 may be guided toward the discharge grille 750 by the inclined rear surface of the discharge duct 902. The cool air may be sprayed at a high pressure through the plurality of discharge nozzles 751 provided in the discharge grille 750. The cool air sprayed at the high pressure may collide with a surface of the beverage container to cool the beverage container.

A portion of the cool air colliding with the beverage container may be changed in direction to flow toward the guide surface 904. The cool air flowing toward the guide surface 904 may be guided to a side surface 3*a* of the freezer compartment or a back surface 4*a* of the door by the guide surface 904. Thus, reintroduction of the cool air colliding with the beverage container and then heat-exchanged with the beverage container into the suction hole 903 of the suction duct 901 may be minimized.

In the cooling apparatus according to embodiments disclosed herein, beverages may be vertically stacked to minimize a space for the beverages. Thus, availability of an inner space of a storage compartment may be improved. Also, if a quick cooling function is not performed, the container holder may be separated to convert the partition wall into a container support, thereby receiving food. Thus, loss of storage space due to mounting of the cooling apparatus may be minimized.

Further, as only the container holder is separable, it may be easy to receive or withdraw beverage containers. Furthermore, as the cooling apparatus is separable from the bracket to fix the cooling apparatus to an inside of the storage compartment or a back surface of a door, the bracket adequate for the space in which the cooling apparatus is installed may be selected to improve compatibility with respect to an installation space.

Embodiments disclosed herein provide a cooling apparatus capable of minimizing capacity loss in a storage compartment of a refrigerator even though an amount of cooled object, that is, a beverage can increases, and uniformly agitating and cooling a plurality of beverage cans.

Embodiments disclosed herein also provide a cooling apparatus capable of improving quick cooling efficiency, more particularly, minimizing a phenomenon, in which a portion of cool air supplied into the cooling apparatus is discharged without being heat-exchanged with an object to be cooled, to maximize cooling efficiency or heat-exchange efficiency.

Embodiments also provide a cooling apparatus capable of smoothly agitating beverages in a small-sized refrigerator, and minimizing a moving range or moving trace of a tray for agitation without deteriorating cooling efficiency.

1. Vertical Stacking in Cooling Apparatus

In a cooling apparatus according to embodiments, cooled objects may be vertically stacked on each other in a state in which the cooled objects are laid out or laid on their side. When the cooled objects are vertically stacked, a limitation in which an upper space of the cooling apparatus is not used may be solved to efficiently utilize the inside of a refrigerator or a storage space of a back surface of a door. Also, a limitation in which inner capacity of the refrigerator decreases when the cooled objects are received in a transverse direction may be solved.

According to one embodiment, a cooling apparatus is provided that may include a base fixedly or separably mounted on a storage compartment of a refrigerator or a door to open or close the storage compartment; an agitation tray disposed on a top surface of the base to perform an agitating motion; a container holder, in which a plurality of cooled objects may be vertically stacked on each other in a state in which each of the cooled objects is laid out or laid on their side, the container holder being fixedly or separably mounted on the agitation tray; an agitation driving unit or drive connected to the agitation tray to transmit power for the agitating motion to the agitation tray; a fan assembly or fan that supplies cool air to cool the cooled objects; and a duct assembly or duct that guide the cool air supplied into the fan assembly toward the cooled objects. The container holder may include a front frame; a rear frame; and a connection frame that connects the front frame to the rear frame. Each of the front and rear frames may include left and right support parts or supports that vertically extend to face each other at positions at which the left and right support parts are spaced a predetermined distance from each other; and a plurality of container supports that, respectively, protrude from inner side surfaces of the left and right support parts to support the cooled objects. The plurality of container supports may be arranged to be vertically spaced a predetermined distance from each other so that the plurality of cooled objects is vertically stacked within the container holder.

2. Separation Prevention of Cooled Object

When cooled objects are vertically stacked on each other, cooled objects having various sizes, that is, beverage containers having various diameters have to be stacked, and the beverage containers have to be stably supported to prevent the beverage containers from dropping down due to self-weight thereof after the beverage containers are received.

According to one embodiment, a cooling apparatus is provided that may include a base fixedly or separably mounted on a storage compartment of a refrigerator or a door to open or close the storage compartment; an agitation tray disposed on a top surface of the base to perform an agitating motion; a container holder, in which a plurality of cooled objects may be vertically stacked on each other in a state in which each of the cooled objects is laid out or laid on its side, the container holder being fixedly or separably mounted on the agitation tray; an agitation driving unit or drive connected to the agitation tray to transmit power for the agitating motion to the agitation tray; a fan assembly or fan that supplies cool air to cool the cooled objects; and a duct assembly or duct to guide the cool air supplied into the fan assembly toward the cooled objects. The container holder may include a front frame; a rear frame; and a connection frame that connects the front frame to the rear frame. Each of the front and rear frames may include left and right support parts or supports that vertically extend to face each other at positions at which the left and right support parts are spaced a predetermined distance from each other; an upper support part or support that connects an upper end of the left support part to an upper end of the right support part; and a plurality of container supports, respectively, that protrude from inner side surfaces of the left and right support parts to support the cooled objects. The plurality of container supports may be arranged to be vertically spaced a predetermined distance from each other so that the plurality of cooled objects may be vertically stacked within the container holder, and each of the plurality of container supports may extend by a length capable of connecting the front frame to the rear frame. The container support may line-contact or surface-contact front and rear ends of the cooled objects to stably support the beverage containers.

Also, as the upper support may have an arc shape to surround a half or more of a circumferential surface of the beverage container, the beverage container may be stably supported during the agitation. Also, the upper support may have an arc shape and a predetermined elastic force to allow the left and right supports to approach each other, thereby more stably supporting the beverage container.

3. Uniform Agitation of Plurality of Cooled Objects

When a plurality of cooled objects is vertically stacked on each other, it has to be considered that all of the cooled objects have to be agitated at a uniform agitation intensity regardless of received positions of the cooled objects.

According to another embodiment, a cooling apparatus is provided that may include a base fixedly or separably mounted on a storage compartment of a refrigerator or a door to open or close the storage compartment; an agitation tray disposed on a top surface of the base to perform an agitating motion; a container holder, in which a plurality of cooled objects may be vertically stacked on each other in a state in which each of the cooled objects is laid out or laid on its side, the container holder being fixedly or separably mounted on the agitation tray; an agitation driving unit or device connected to the agitation tray to transmit power for the agitating motion to the agitation tray; a fan assembly or fan that supplies cool air to cool the cooled objects; and a duct assembly or duct that guide the cool air supplied into the fan assembly toward the cooled objects. The container holder may include a front frame; a rear frame; and a connection frame that connects the front frame to the rear frame. A plurality of container supports that supports the cooled objects may protrude from an inner side surface of each of the front and rear frames. The plurality of container supports may be vertically spaced a predetermined distance from each other so that the plurality of cooled objects may be vertically stacked within the container holder. The agitation tray may perform the agitating motion on a horizontal plane by the agitation driving unit, and the agitating motion of the agitation tray may include an agitation component that moves in a direction substantially perpendicular to a longitudinal direction of each of at least the cooled objects. The horizontal plane that the agitation tray performs can be defined as a flat plane that has the same height at every point.

As the cooled objects are agitated in a direction substantially perpendicular to a longitudinal direction of each of the cooled objects, and cool air is supplied in the direction substantially perpendicular to the longitudinal direction of each of the cooled objects, the cool air may continuously collide with the cooled objects during agitation of the cooled objects to improve cooling efficiency. Also, liquid may be actively agitated at an outermost position at which the agitating direction of the cooled objects is changed, and the cool air discharge hole and the beverage container may approach each other at a time point at which the agitating direction is changed, thereby improving heat-exchange efficiency. The longitudinal direction can be defined an extension direction of a straight line through which passing from a center of a front surface of the object to a center of a rear surface of the object in a state where a height of the center of the front surface of the object is the same as a height of the center of the rear surface of the object.

4. Separation Prevention of Cooled Object in Front/Rear Direction During Agitation To vertically stack cooled objects that are laid out or laid on its side, a structure in which the cooled objects are received through a front surface of a container holder may be most efficient. In this case, as the cooled objects may be separated in a front/rear direction of a container holder during agitation, a technical consideration to minimize a possibility of separation of the cooled objects is needed.

According to a still further another embodiment, a cooling apparatus is provided that may include a base fixedly or separably mounted on a storage compartment of a refrigerator or a door to open or close the storage compartment; an agitation tray disposed on a top surface of the base to perform an agitating motion; a container holder, in which a plurality of cooled objects may be vertically stacked on each other in a state in which each of the cooled objects is laid out or laid on its side, the container holder being fixedly or separably mounted on the agitation tray; an agitation driving unit or drive connected to the agitation tray to transmit power for the agitating motion to the agitation tray; a fan assembly or fan that supplies cool air to cool the cooled objects; and a duct assembly or duct that guides the cool air supplied into the fan assembly toward the cooled objects. The container holder may include a front frame; a rear frame; and a connection frame that connects the front frame to the rear frame. Each of the front and rear frames may include left and right support parts or supports that vertically extend to face each other at positions at which the left and right support parts are spaced a predetermined distance from each other; and a plurality of container supports that, respectively, protrude from inner side surfaces of the left and right support part. The plurality of container supports may be vertically spaced a predetermined distance from each other to support the plurality of cooled objects that are vertically stacked on each other. A distance between the left and right support parts of the front frame may be less than a distance between the left and right support parts of the rear frame.

5. Relationship Between Agitation Direction of Cooled Object and Supply Position of Cool Air To reduce a cooling time of a cooled object, a technical consideration to more efficiently cool the cooled object is needed. For example, cool air may always collide with the cooled object during agitation of the cooled object to improve heat-exchange efficiency. As illustrated in FIG. 51, in the case of the cooling apparatus having an agitation mechanism that performs a swing motion according to the related art, cool air may leak at a tailing end of an agitation trace without colliding with the cooled object, deteriorating heat-exchange efficiency. Also, as the cool air is concentratedly sprayed onto the cooled object at a time point at which agitation of the liquid is least, heat-exchange efficiency may be deteriorated.

According to still another embodiment, a cooling apparatus is provided that may include a base fixedly or separably mounted on a storage compartment of a refrigerator or a door to open or close the storage compartment; an agitation tray disposed on a top surface of the base to perform an agitating motion; a container holder, in which a plurality of cooled objects may be vertically stacked on each other in a state in which each of the cooled objects is laid out or laid on its side, the container holder being fixedly or separably mounted on the agitation tray; an agitation driving unit or drive connected to the agitation tray to transmit power for the agitating motion to the agitation tray; a fan assembly or fan that supplies cool air to cool the cooled objects; and a duct assembly or duct that guides the cool air supplied into the fan assembly toward the cooled objects. The container holder may include a front frame; a rear frame; and a connection frame that connects the front frame to the rear frame. A plurality of container supports that supports the cooled objects may protrude from an inner side surface of each of the front and rear frames. The plurality of container supports may be vertically spaced a predetermined distance from each other so that the plurality of cooled objects vertically stacked within the container holder. The agitation tray more perform the agitating motion on a horizontal plane by the agitation driving unit in a state in which the agitation tray is disposed on the base, and the discharge grille may be disposed on a side edge portion of the agitation tray to spray cool air discharged from the discharge grille in a direction substantially perpendicular to a longitudinal direction of each of the cooled object. The longitudinal direction of the cooled object can be defined as the direction from a front end of the agitation tray to a rear end of the agitation tray. The direction substantially perpendicular to a longitudinal direction of the cooled object can be defined as the direction from one of left and right side edges of the agitation tray to the other of left and right side edges of the agitation tray.

6. Interference Prevention Between Storage Goods Received Outside Cooling Apparatus and Container Holder According to still another embodiment, a cooling apparatus is provided that may include a base fixedly or separably mounted on a storage compartment of a refrigerator or a door to open or close the storage compartment; an agitation tray disposed on a top surface of the base to perform an agitating motion; a container holder, in which a plurality of cooled objects may be vertically stacked on each other in a state in which each of the cooled objects is laid out or laid on its side, the container holder being fixedly or separably mounted on the agitation tray; an agitation driving unit or drive connected to the agitation tray to transmit power for the agitating motion to the agitation tray; a fan assembly or fan that supplies cool air to cool the cooled objects; a duct assembly or duct that guides the cool air supplied into the fan assembly toward the cooled objects, the duct assembly having a discharge end disposed on or at one or a first side of the base; and a partition wall assembly or partition wall disposed on the other or a second side of the base, which corresponds to a side opposite to the discharge end, to prevent items received around the base from interfering with the container supports.

In a stationary period during which the cooling apparatus does not operate, the partition wall assembly may be folded to allow a portion on which the container holder is disposed to serve as a food storage space.

7. Uniform Cool Air Supply for Plurality of Cooled Objects

In a cooling apparatus in which a plurality of cooled objects are vertically stacked on each other, another important technical consideration to uniformly supply cool air onto the plurality of cooled objects is needed. More particularly, when the plurality of cooled object are cooled once, cooling ending time points for the received cooled objects may be the same.

According to yet another embodiment, a cooling apparatus is provided that may include a base fixedly or separably mounted on a storage compartment of a refrigerator or a door to open or close the storage compartment; an agitation tray disposed on a top surface of the base to perform an agitating motion; a container holder configured to receive a plurality of objects to be cooled and have a plurality of container supports being vertically spaced a predetermined distance from each other to allow the plurality of objects to be vertically stacked on each other, the container holder being fixedly or separably mounted on the agitation tray; an agitation driving unit or drive connected to the agitation tray to transmit power for the agitating motion to the agitation tray; a fan assembly or fan that supplies cool air to cool the cooled objects; a duct assembly or duct that guides the cool air supplied into the fan assembly toward the cooled objects; and a discharge grille vertically disposed on a discharge end of the duct assembly to spray the cool air in a lateral direction of the container holder toward the cooled objects. The discharge grill may include a plurality of discharge nozzle sets arranged to be vertically spaced a predetermined distance from each other, and a number of discharge nozzle sets corresponding to each of the plurality of cooled objects stacked in the container holder may be the same.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooling apparatus comprising:

a base configured to b fixedly or separably mounted on or in a storage compartment of a refrigerator or a door that opens and closes the storage compartment;

an agitation tray disposed on a top surface of the base and configured to perform agitating motion;

a container holder configured to receive a plurality of objects to be cooled vertically stacked on each other, wherein the container holder is fixedly or separably mounted on the agitation tray;

an agitation drive connected to the agitation tray to transmit power to provide the agitating motion to the agitation tray;

a fan that supplies, cool air to cool the plurality of objects; and a duct that guides, the cool air supplied by the fan toward the plurality of objects, wherein the container holder comprises:

a front frame;

a rear frame; and a connection frame that connects the front frame to the rear frame, wherein each of the front and rear frames comprises:

first and second supports that vertically extend to face each other and that are spaced a predetermined distance apart from each other; and a plurality of container supports that, respectively, protrude from inner side surfaces of the first and second supports to support the plurality of objects, wherein the plurality of container supports are arranged to be vertically spaced a predetermined distance from each other so that the plurality of objects are vertically stacked within the container holder.

2. The cooling apparatus according to claim 1, wherein the agitation tray performs the agitating motion in a substantially horizontal plane.

3. The cooling apparatus according to claim 1, wherein the plurality of container supports, respectively, support an upper circumferential surface and a lower circumferential surface of each of the plurality of objects with respect to a horizontal plane that passes through a center of each of the plurality of objects.

4. The cooling apparatus according to claim 3, wherein the plurality of container supports comprises a plurality of pairs of container supports, wherein each of the respective pairs of container supports protrudes from facing positions on the first and second supports to contact the upper circumferential surface or the lower circumferential surface of a respective one of the plurality of objects, and is disposed at a same height.

5. The cooling apparatus according to claim 3, wherein a container support of the plurality of container supports disposed on the front frame is disposed at a position higher than or equal to a height of a container support of the plurality of container support disposed on the rear frame among the plurality of container supports that contacts the upper circumferential surface or the lower circumferential surface of a respective one of the plurality of objects, such that frontal ends of the objects are higher than rear ends of the objects when the objects are received in the container holder.

6. The cooling apparatus, according to claim 1, further comprising a discharge grill mounted at an outlet end of the duct, wherein the discharge grill comprises a plurality of discharge nozzles, and wherein cool air discharged from the discharge grill is sprayed onto a circumferential surface of each of the plurality of objects from a lateral direction of the container holder.

7. The cooling apparatus according to claim 6, wherein a front surface of the container holder is fully open to receive the plurality of objects through the front surface of the container, holder, and wherein a cool air through hole, through which the cool air discharged from the discharge grill, is sprayed onto a circumferential surface of each of the plurality of objects, is defined in a side surface of the container holder.

8. The cooling apparatus according to claim 7, further comprising a mounting platform that connects a lower end of the front frame to a lower end of the rear frame, wherein the mounting platform comprises:

a first mounting platform that connects a first support of the front frame to a first support of the rear frame; and a second mounting platform that connects a second support of the front frame to a second support of the rear frame.

9. The cooling apparatus according to claim 1, further comprising a holder that connects lower ends of the front frame to each other to prevent the lower ends of the front frame from spreading apart.

10. The cooling apparatus according to claim 9, further comprising a fixing mechanism rotatably mounted on or at a side of the agitation tray to selectively press a top surface of the holder, wherein the fixing mechanism comprises:

a hinge;

a lever that extends from the hinge; and a push button that extends from an edge of the lever in a direction substantially perpendicular to the lever to press a top surface of the holder.

11. The cooling apparatus according to claim 1, further comprises a reception guide, into which at least a portion of the container support disposed on the front frame extends in a forward direction, wherein the reception guide is bent in a shape that expands in the forward direction to guide reception of the plurality of objects.

12. A refrigerator comprising the cooling apparatus according to claim 1.

13. A cooling apparatus, comprising:

a base configured to be fixedly or separably mounted on a storage compartment of a refrigerator or a door that opens and closes the storage compartment;

an agitation tray disposed on a top surface of the base and configured to perform an agitating motion;

a container holder configured to receive a plurality of objects to be cooled vertically stacked on each other, wherein the container holder is fixedly or separably mounted on the agitation tray;

an agitation drive connected to the agitation tray to, transmit power to provide the agitating motion to the agitation tray;

a fan that supplies cool air to cool the plurality of objects; and a duct that guides the cool air supplied by the fan toward the plurality of objects, wherein the container holder comprises:

a front frame;

a rear frame; and a connection frame that connects the front frame to the rear frame, wherein each of the front and rear frames comprises:

first and second supports that vertically extend to face each other and that are spaced a predetermined distance from each other;

an upper support that connects an upper end of the first support to an upper end of the second support; and a plurality of container supports that, respectively; protrude from inner side surfaces of the first and second supports to support the plurality of objects, wherein the plurality of container supports are arranged to be vertically spaced a predetermined distance from each other so that the plurality of objects are vertically stacked within the container holder, and wherein each of the plurality of container supports extends by a length sufficient to connect the front frame to the rear frame.

14. The cooling apparatus according to claim 13, wherein each of the plurality of container supports is configured to line-contact or surface-contact a circumferential surface of a respective one of the plurality of objects along a length from a front end to a rear end of the respective one of plurality of objects.

15. The cooling apparatus according to claim 14, wherein the plurality of container supports, respectively, support an upper circumferential surface and a lower circumferential surface of each of the plurality of objects with respect to a horizontal plane that passes through a center of the respective object.

16. The cooling apparatus according to claim 13, wherein the connection frame connects the upper support of the front frame to the upper support of the rear frame.

17. The cooling apparatus according to claim 16, wherein the upper support has an arc shape which is curved at a predetermined curvature to surround a circumferential surface of each of the plurality of objects as the plurality of objects are inserted into the container holder.

18. The cooling apparatus according to claim 17, wherein a lower end of the upper support is disposed at a position lower than a center of the circumferential surface of each of the plurality of objects as the plurality of objects are inserted into the container holder.

19. The cooling apparatus according to claim 18, wherein a distance, between lower ends of each the upper supports is configured to be less than a diameter of each of the plurality of objects.

20. The cooling apparatus according to claim 17, wherein the upper support has a length sufficient to surround a half or more of the circumferential surface of each of the plurality of objects.

21. The cooling apparatus according to claim 17, further comprising a clamp having a circular arc shape, which is fitted onto an outer circumferential surface of the upper support of the front frame, wherein the clamp provides force, in directions such that the first and second supports of the front frame approach each other.

22. The cooling apparatus according to claim 21, further comprising a holder that connects lower ends of the front frame to each other to prevent the lower ends of the front frame from spreading apart.

23. The cooling apparatus according to claim 22, further comprising a fixing mechanism rotatably mounted on or at a side of the agitation tray to selectively press a top surface of the holder, wherein the fixing mechanism comprises:

a hinge;

a lever that extends from the hinge; and a push button that extends from an edge of the lever in a direction substantially perpendicular to the lever to press a top surface of the holder.

24. A refrigerator comprising the cooling apparatus according to claim 13.

25. The cooling apparatus according to claim 24, wherein a lower end of the upper support is disposed at, a position lower than a center of the circumferential surface of each of the plurality of objects as the plurality of objects are inserted into the container holder.

26. The cooling apparatus according to claim 25, wherein a distance between lower ends of the upper supports is configured to be less than a diameter of each of the plurality of objects.

27. The cooling apparatus according to claim 24, wherein the upper support has a length sufficient to surround a half or more of the circumferential surface of each of the plurality of objects.

28. The cooling apparatus according to claim 24, further comprising a clamp having a circular arc shape, which is fitted onto an outer circumferential surface of the upper support of the front frame, wherein the clamp provides force in directions such Mat the first and second supports of the front frame approach each other.

29. The cooling apparatus according, to claim 28, further comprising a holder that connects lower ends of the front frame to each other to prevent the lower ends of the front frame from spreading apart.

30. The cooling apparatus according to claim 29, further comprising a fixing mechanism rotatably mounted on or at a side of the agitation ray to selectively press a top surface of the holder, wherein the fixing mechanism comprises:

a hinge;

a lever that extends from the hinge; and a push button that extends from an edge of the lever in a direction substantially perpendicular to the lever to press a top surface of the holder.

31. A refrigerator comprising the cooling apparatus according to claim 20.

32. A cooling apparatus, comprising:

a base, configured to be fixedly or separably mounted on or in a storage compartment of a refrigerator or a door that opens and closes the storage compartment;

an agitation tray disposed on a top surface of the base and configured to perform an agitating motion;

a container holder configured to receive a plurality of objects to be cooled vertically stacked on each other, wherein the container holder is fixedly or separably mounted on the agitation tray;

an agitation drive connected to the agitation tray to transmit power to provide the agitating motion to the agitation tray;

a fan that supplies cool air to cool the plurality of objects; and a duct that guides the cool air supplied by the fan toward the plurality of objects, wherein the container holder comprises:

a front frame;

a rear frame; and a connection frame that connects the front frame to the rear frame, wherein a plurality of container supports that, respectively, supports the plurality of objects protrudes from inner side surfaces of the front and rear frames, wherein the plurality of container supports is vertically spaced a predetermined distance from each other so that, the plurality of objects is vertically stacked within the container holder, wherein the agitation tray performs the agitating motion in a substantially horizontal plane, and wherein the agitating motion of the agitation tray comprises an agitation, component that moves in a first direction substantially perpendicular to a longitudinal direction of each of the plurality of objects.

33. The cooling apparatus according to claim 32, wherein the agitation tray alternately moves in the first direction substantially perpendicular to the longitudinal direction of each of the plurality of objects on the substantially horizontal plane and a second direction opposite to the first direction.

34. The cooling apparatus according to claim 33, wherein the agitation drive comprises:

an agitation motor;

at least one agitation disk, a central portion of which is connected to a rotational shaft of the agitation motor to integrally rotate together with the rotational shaft of the agitation motor; and an agitation link that connects the at least one agitation disk to the agitation tray.

35. The cooling apparatus according to claim 34, wherein a first end of the agitation link is connected to an edge of a side surface of the agitation tray and a second end of the agitation link is connected to a position which is spaced apart from a central portion of the at least one agitation disk in a radial direction, and wherein a rotational shaft of the agitation link and the rotational axis of the agitation motor cross each other.

36. The cooling apparatus according to claim 32, wherein the agitation tray circularly moves with respect to a substantially vertical axis, and wherein a front end of the agitation tray is maintained to always face a front side of the cooling apparatus.

37. The cooling apparatus according to claim 36, wherein die agitation tray repeatedly performs successive movement, in the first direction substantially parallel to the longitudinal direction of each of the plurality of objects, a second direction substantially perpendicular to the first direction, a third direction opposite to the first direction, and a fourth direction opposite to the second direction.

38. The cooling apparatus according to claim 32, wherein the agitation drive comprises:

an agitation motor;

a gear assembly connected to a rotational shaft of the agitation motor; and a pair of agitation disks connected to the gear assembly, wherein each of a pair of eccentric shafts protrudes from a position spaced apart from a center of each of the pair of agitation disks in a radial direction and is inserted into the agitation tray.

39. The cooling apparatus according to claim 38, wherein a line that connects centers of the pair of eccentric shafts to each other coincides with a line that equally divides the agitation tray.

40. The cooling apparatus according to claim 39, wherein the pair of agitation disks is gear-coupled to the gear assembly to rotate in a same direction.

41. The cooling apparatus according to claim 40, farther comprising a plurality of tray supports disposed on the base to, respectively, support bottom surfaces of corners of the agitation tray, wherein the agitation tray is maintained in a substantially horizontal state during the agitation by the plurality of tray supports.

42. The cooling apparatus according to claim 41, wherein a circular guide groove is defined in a top surface of each of die plurality of tray supports, wherein a guide protrusion protrudes from each of bottom surfaces of the corners of the agitation tray, and wherein when each of the eccentric shafts rotates, the guide protrusion rotates along the guide groove.

43. A refrigerator comprising the cooling apparatus according to claim 32.

44. A cooling apparatus, comprising:

a base configured to be fixedly or separably mounted on or in a storage compartment of a refrigerator or a door that opens and closes the storage compartment;

an agitation tray disposed on a top surface of the base and configured to perform an agitating motion;

a container holder configured to receive, at least one object to be cooled, wherein the container holder is fixedly or separably mounted on the agitation tray;

an agitation drive connected to the agitation tray to transmit power to provide the agitating motion to the agitation tray;

a fan that supplies cool air to cool the at least one object; and a duct that guides the cool air supplied by the fan toward the at least one object, wherein the agitation tray performs the agitating motion in a substantially horizontal plane, and wherein the agitating motion of the agitation tray comprises an agitation component that moves in a first direction substantially perpendicular to a longitudinal direction of the least one object.

45. The cooling apparatus according to claim 44, wherein the agitation tray alternately moves in the first direction substantially perpendicular to the longitudinal direction of each of the at least one object on the substantially horizontal plane and a second direction opposite to the first direction.

46. The cooling apparatus according to claim 45, wherein the agitation drive comprises:

an agitation motor;

at least one agitation disk, a central portion of which is connected to a rotational shaft of the agitation motor to integrally rotate together with the rotational shaft of the agitation motor; and an agitation link that connects the at least one agitation disk to the agitation tray.

47. The cooling apparatus according to claim 44, wherein the agitation tray circularly moves with respect to a substantially vertical axis, and wherein a front end of the agitation tray is maintained to always face a front side of the cooling apparatus.

48. The cooling apparatus according to claim 47, wherein the agitation tray repeatedly performs successive movement in the first direction substantially parallel to the longitudinal direction of the at least one object, a second direction substantially perpendicular to the first direction, a third direction opposite to the first direction, and a fourth direction opposite to the second direction.

49. The cooling apparatus according to claim 44, wherein the agitation drive comprises:

an agitation motor;

a gear assembly connected to a rotational shaft of the agitation motor; and a pair of agitation disks connected to the gear assembly, wherein each of a pair of eccentric shafts protrudes from a position spaced apart from a center of each of the pair of agitation disks in a radial direction and is inserted into the agitation tray.

* * * * *